US006666658B2

(12) United States Patent
Takeuchi et al.

(10) Patent No.: US 6,666,658 B2
(45) Date of Patent: Dec. 23, 2003

(54) MICROFLUIDIC PUMP DEVICE

(75) Inventors: Yukihisa Takeuchi, Nishikamo-Gun (JP); Tsutomu Nanataki, Toyoake (JP); Iwao Ohwada, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/209,073

(22) Filed: Jul. 31, 2002

(65) Prior Publication Data

US 2003/0026713 A1 Feb. 6, 2003

Related U.S. Application Data

(63) Continuation of application No. 09/268,759, filed on Mar. 16, 1999.

(30) Foreign Application Priority Data

Mar. 3, 1999 (JP) ..... 11-56267
Mar. 15, 1999 (JP) ..... 11-69301

(51) Int. Cl.[7] ..... F04B 17/00
(52) U.S. Cl. ..... 417/322; 417/413.2; 417/413.3
(58) Field of Search ..... 417/322, 413.3, 417/413.2

(56) References Cited

U.S. PATENT DOCUMENTS

| | | | | |
|---|---|---|---|---|
| 4,558,995 A | | 12/1985 | Furukawa et al. | |
| 4,668,374 A | | 5/1987 | Bhagat et al. | |
| 5,336,062 A | | 8/1994 | Richter | |
| 5,417,235 A | | 5/1995 | Wise et al. | |
| 5,529,465 A | * | 6/1996 | Zengerle et al. | 417/413.2 |
| 5,759,014 A | * | 6/1998 | Van Lintel | 417/413.3 |
| 5,862,275 A | | 1/1999 | Takeuchi et al. | |
| 6,116,863 A | * | 9/2000 | Ahn et al. | 417/322 |
| 6,203,291 B1 | * | 3/2001 | Stemme et al. | 417/413.3 |
| 6,283,730 B1 | | 9/2001 | Sasaki et al. | |
| 6,309,189 B1 | | 10/2001 | Rey-Mermet et al. | |
| 6,390,791 B1 | | 5/2002 | Maillefer et al. | 251/129.01 |
| 6,416,294 B1 | | 7/2002 | Zengerle et al. | 417/413.3 |

FOREIGN PATENT DOCUMENTS

| | | | |
|---|---|---|---|
| EP | 0 424 087 A1 | 4/1991 | |
| EP | 0 465 229 A1 | 1/1992 | |
| JP | 62-091676 | 4/1987 | |
| JP | 3-128681 | 5/1991 | |
| JP | 4-86388 | 3/1992 | |
| JP | 5-49270 | 2/1993 | |
| JP | 5-202857 | 8/1993 | |
| JP | 8-51241 | 2/1996 | |
| JP | 8-107238 | 4/1996 | |
| JP | 10-78549 | 3/1998 | |
| JP | 10-110681 | 4/1998 | |
| JP | 10-190086 | 7/1998 | |
| JP | 10-299659 | 11/1998 | |
| WO | 89/7199 | 8/1989 | 417/413.2 |

OTHER PUBLICATIONS

Anzai, Kazuo, "*Preparation of Electronic Materials by Electrophoretic Deposition*," General Institute of Toshiba Corporation, Denki Kagaku 53, No. 1, 1985, pp. 63–68.

(List continued on next page.)

*Primary Examiner*—Cheryl J. Tyler
(74) *Attorney, Agent, or Firm*—Burr & Brown

(57) ABSTRACT

A pump having a main pump body including a casing to which a fluid is supplied, and a pump section, an input valve section, and an output valve section which are provided opposingly to one surface in the casing. Each of the pump section, the input valve section, and the output valve section has an actuator section. The input valve section, the pump section, and the output valve section are provided opposingly to the back surface of the casing for selectively forming a flow passage on the back surface of the casing in accordance with selective displacement action of the input valve section, the pump section, and the output valve section in a direction approaching or separating from the back surface of the casing. The fluid is controlled for its flow in accordance with the selective formation of the flow passage.

2 Claims, 43 Drawing Sheets

OTHER PUBLICATIONS

Goto, Atsushi, et al., "*$PbZrO_3/PbTiO_3$ Composite Ceramics Fabricated by Electrophoretic Deposition*," Tokyo Metropolitan University, Tokyo Medical and Dental University, Proceedings of First Symposium on Higher–Order Ceramic Formation Method Based on Electrophoresis, 1998, pp. 5–6.

Yamashita, Kimihiro, "*Hybridization of Ceramics by Electrophoretic Deposition*," Institute of Medical and Dental Engineering, Tokyo Medical and Dental University, Proceedings of First Symposium on Higher–Order Ceramic Formation Method Based on Electrophoresis, 1998, pp. 23–24.

Koch, Michael, et al., "*A Novel Micromachined Pump Based on Thick–Film Piezoelectric Actuation*," 1997, International Conference on Solid–State Sensors and Actuators, Jun. 16–19, 1997, pp. 353–356.

Gerlach, Torsten, "*Pumping Gases by a Silicon Micro Pump with Dynamic Passive Valuves*," 1997 International Conference on Solid–State Sensors and Acutators, Jun. 16–19, 1997, pp. 357–360.

Bernard, W.L., et al., "*A Titanium–Nickel Shape–Memory Alloy Actuated Micropump*," 1997 International Conference on Solid–State Sensors and Actuators, Jun. 16–19, 1997, pp. 361–364.

Schomburg, W.K.., et al., "*Long–Term Performance Analysis of Thermo–Pneumatic Micropump Actuators*," 1997 International Conference on Solid–State Sensors and Actuators, Jun. 16–19, 1997, pp. 365–368.

Jiang, X. N, "*Experiments and Analysis for Micro–Nozzle/Diffuser Flow and Micro Valveless Pumps*," 1997 International Conference on Solid–State Sensors and Actuators, Jun. 16–19, 1997, pp. 369–372.

Ahn, Si–Hong, et al., *Fabrication and Experiement of Planar Micro Ion Drag Pump*, 1997 International Conference on Solid–State Sensors and Actuators, Jun. 16–19, 1997, pp. 373–376.

Stehr, M., et al., "*The Selfpriming Vamp*," 1997 Internatioanl Conference on Solid–State Sensors and Actuators, Jun. 16–19, 1997, pp. 351–352.

* cited by examiner

10Ea

MICROFLUIDIC PUMP DEVICE

CROSS REFERENCE TO RELATED APPLICATION

This application is a continuation of U.S. Ser. No. 09/268,759, filed Mar. 16, 1999, the entirety of which is incorporated herein by reference.

BACKGROUND OF THE INVENTION

1. Field of the Invention

The present invention relates to a pump. In particular, the present invention relates to a pump which is preferably allowed to have a miniature and thin size.

2. Description of the Related Art

Recently, a microminiature pump has been suggested, in which the viscosity of a liquid is thermally changed so that the change in viscosity is utilized in place of a valve.

The microminiature pump has no mechanical valve, and hence there is no fear of abrasion and malfunction. It is approved that such a microminiature pump can be applied to a device to be embedded in the body to administer a trace amount of medicament and to a small-sized chemical analyzer.

It is considered that such a microminiature pump will be extensively applied in the future, for example, to those concerning the medical and chemical analysis fields. In such application, it is of course important that the pump has a miniature and thin size. Further, it is desirable that the pump has a large discharge amount (movement amount) of fluid although it has the miniature and thin size.

Those made of silicon are known as such a microminiature pump. However, in the case of such a pump, the rigidity of the vibrating section is small, and it is difficult to realize a high speed pumping operation and an increase in discharge amount (movement amount) of fluid.

SUMMARY OF THE INVENTION

The present invention has been made taking such a problem into consideration, an object of which is to provide a pump which has a miniature and thin size and which makes it possible to increase the discharge amount (movement amount) of fluid.

Another object of the present invention is to provide a pump which makes it possible to efficiently perform pressure reduction on the introducing side and pressure application on the discharge side.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Several illustrative embodiments of the pump according to the present invention will be explained below with reference to FIGS. 1 to 47D.

Figure 1:
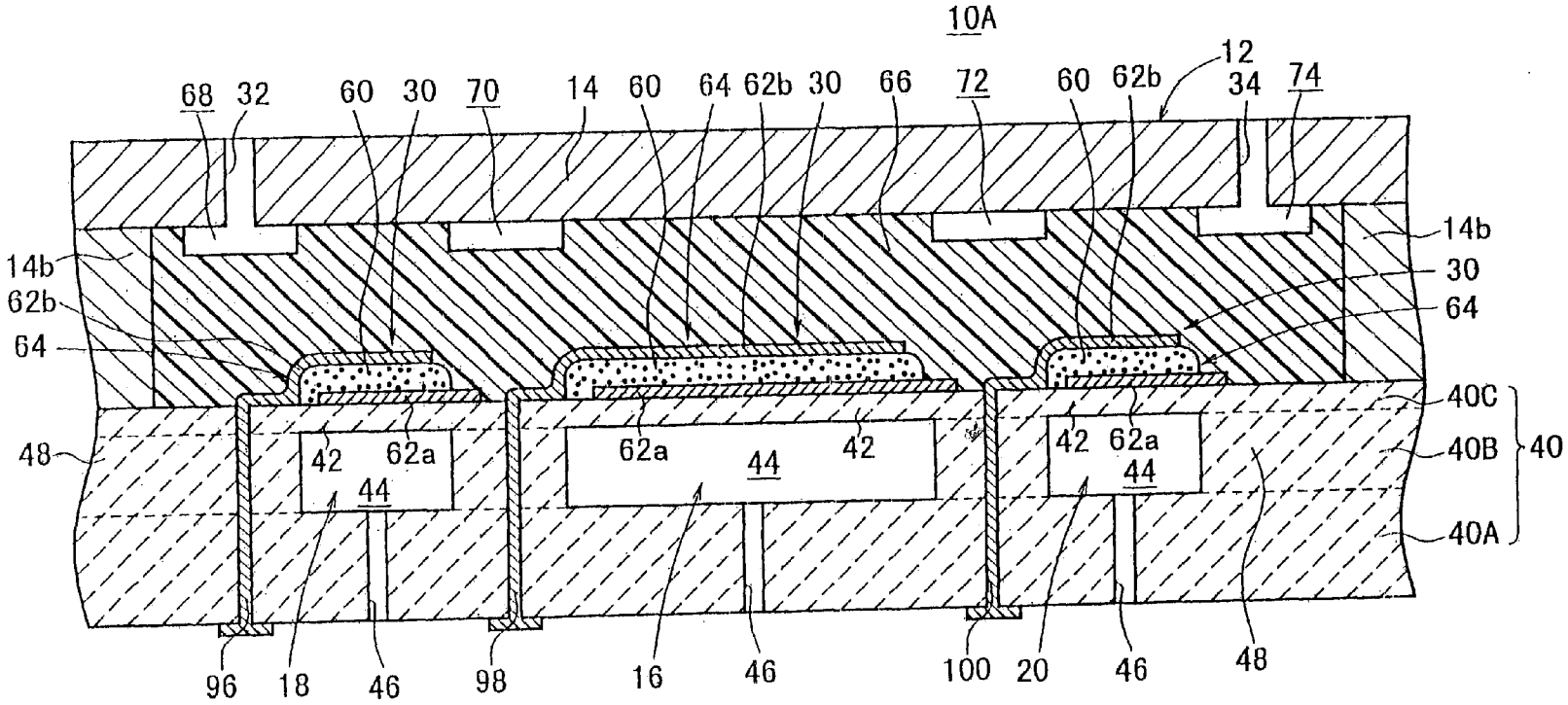
FIG. 1 shows a sectional view illustrating a pump according to a first embodiment.

As shown in FIG. 1, a pump 10A according to a first embodiment has a main pump body 12. The main pump body 12 comprises a casing 14 to which a fluid is supplied, a pump section 16, an input valve section 18, and an output valve section 20 which are provided opposed to one surface in the casing 14. Each of the pump section 16, the input valve section 18, and the output valve section 20 has an actuator section 30.

That is, the pump 10A according to the first embodiment comprises the casing 14 to which the fluid is supplied, the input valve section 18, the pump section 16, and the output valve section 20 which are provided opposed to the back surface of the casing 14, and the main pump body 12 for selectively forming the flow passage on the back surface of the casing 14 in accordance with the selective displacement action in the direction approaching or separating from the input valve section 18, the pump section 16, and the output valve section 20 with respect to the back surface of the casing 14. The pump 10A is constructed such that the flow of the fluid is controlled in accordance with the selective formation of the flow passage.

In the present invention, the term "selective formation of the flow passage" indicates an arbitrary combination of expansion/contraction or opening/closing operation of the pump section 16, the input valve section 18, or the output valve section 20 for effecting the discharge (or pressure application or pressure reduction).

Figure 2:
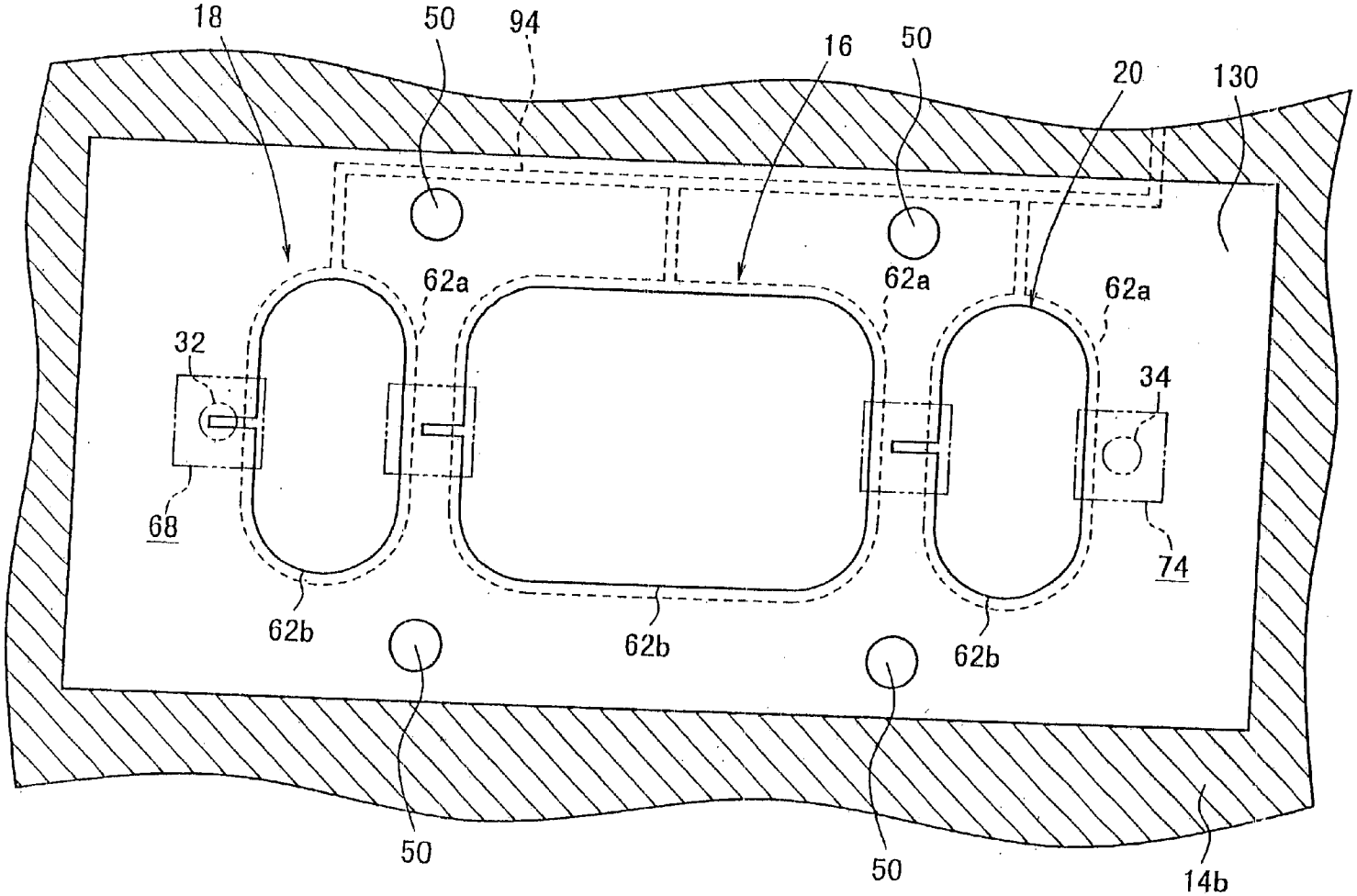
FIG. 2 shows a plan view illustrating a main pump body with a casing being removed, concerning the pump according to the first embodiment.

The casing 14 is formed with an introducing hole 32 for supplying the fluid and a discharge hole 34 for discharging the fluid. As shown in FIG. 2, the input valve section 18, the pump section 16, and the output valve section 20 are arranged in the lateral direction between the introducing hole 32 and the discharge hole 34. In FIG. 2, the region indicated by reference numeral 130 is a portion which is not movable as the input valve section 18, the pump section 16, and the output valve section 20, of an entire portion composed of a constitutive material of a displacement-transmitting section 66 charged between the casing 14 and a substrate 40, i.e., the portion which does not directly participate in the transmittance of displacement of the actuator section 30.

The main pump body 12 includes the substrate 40 composed of, for example, ceramics. The substrate 40 has its first principal surface which is arranged opposed to the back surface of the casing 14. The first principal surface is a continuous surface (flushed surface). Hollow spaces 44, which are used to form vibrating sections 42 at positions corresponding to the pump section 16, the input valve section 18, and the output valve section 20 respectively as described later on, are provided at the inside of the substrate 40. Each of the hollow spaces 44 communicates with the outside via a through-hole 46 having a small diameter provided through the second end surface of the substrate 40.

Portions of the substrate 40, at which the hollow spaces 44 are formed, are thin-walled. The other portions of the substrate 40 are thick-walled. The thin-walled portion has a structure which is suitable to receive the vibration effected by the external stress, and it functions as the vibrating section 42. The portion other than the hollow space 44 is thick-walled, and it functions as a fixed section 48 for supporting the vibrating section 42.

That is, the substrate 40 has a stacked structure comprising a substrate layer 40A as a lowermost layer, a spacer layer 40B as an intermediate layer, and a thin plate layer 40C as an uppermost layer. The substrate 40 can be recognized as an integrated structure including the hollow spaces 44 formed through the spacer layer 40B at the positions corresponding to the pump section 16, the input valve section 18, and the output valve section 20 respectively.

Figure 3:
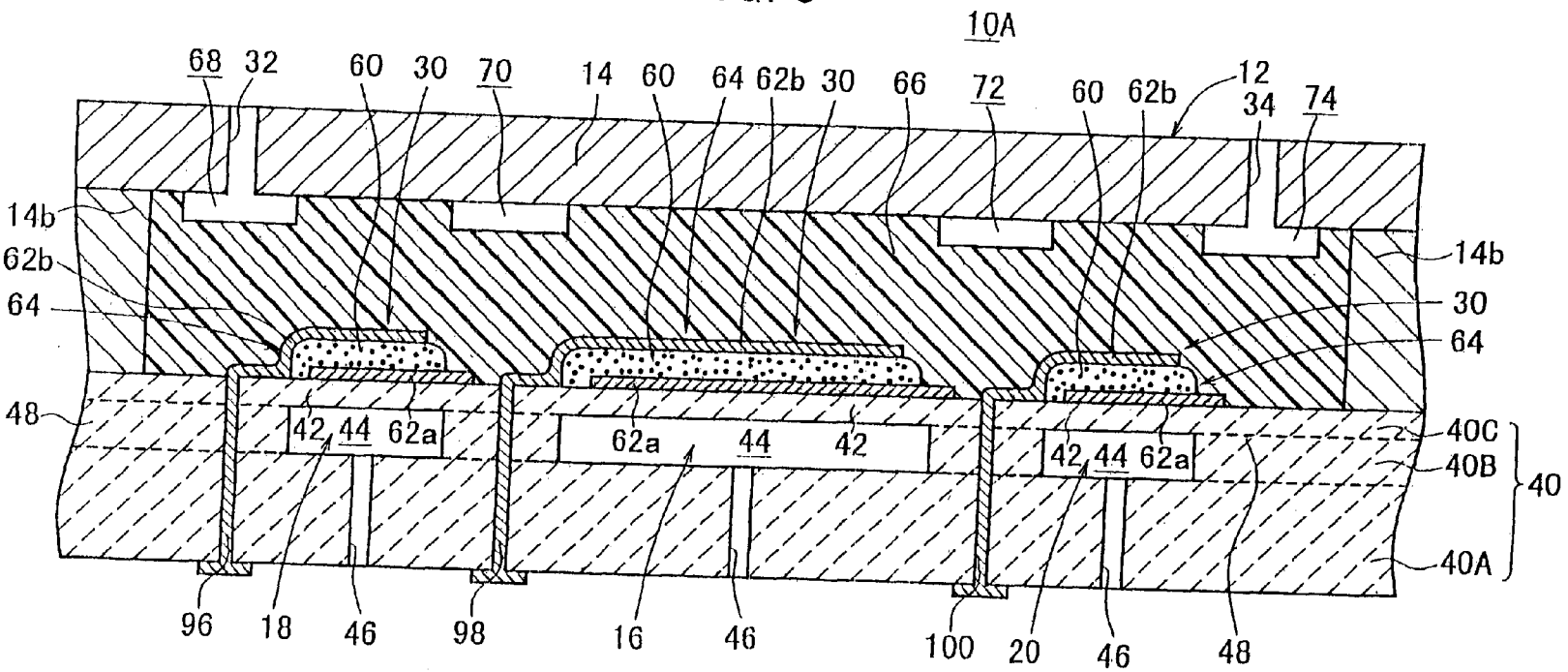
FIG. 3 shows a sectional view illustrating a state in which the depth of a hollow space is decreased in the pump according to the first embodiment.

The spacer layer 40B can be optionally formed to be thin as shown, for example, in FIG. 3 by means of a technique represented, for example, by the screen printing method. Such an arrangement is desirable in view of realization of the thin size of the pump 10A and improvement in characteristics of the actuator section 30.

The substrate layer 40A functions as a reinforcing substrate, and it functions as a substrate for electric wiring as well. The substrate 40 may be formed as a simultaneously integrated sintered product, an integrated product obtained by joining the respective layers by using glass and resin, or a product obtained by additional attachment. In the instance described above, the substrate 40 has the three-layered structure. However, the substrate 40 may have a structure including four or more layers.

Figure 4:
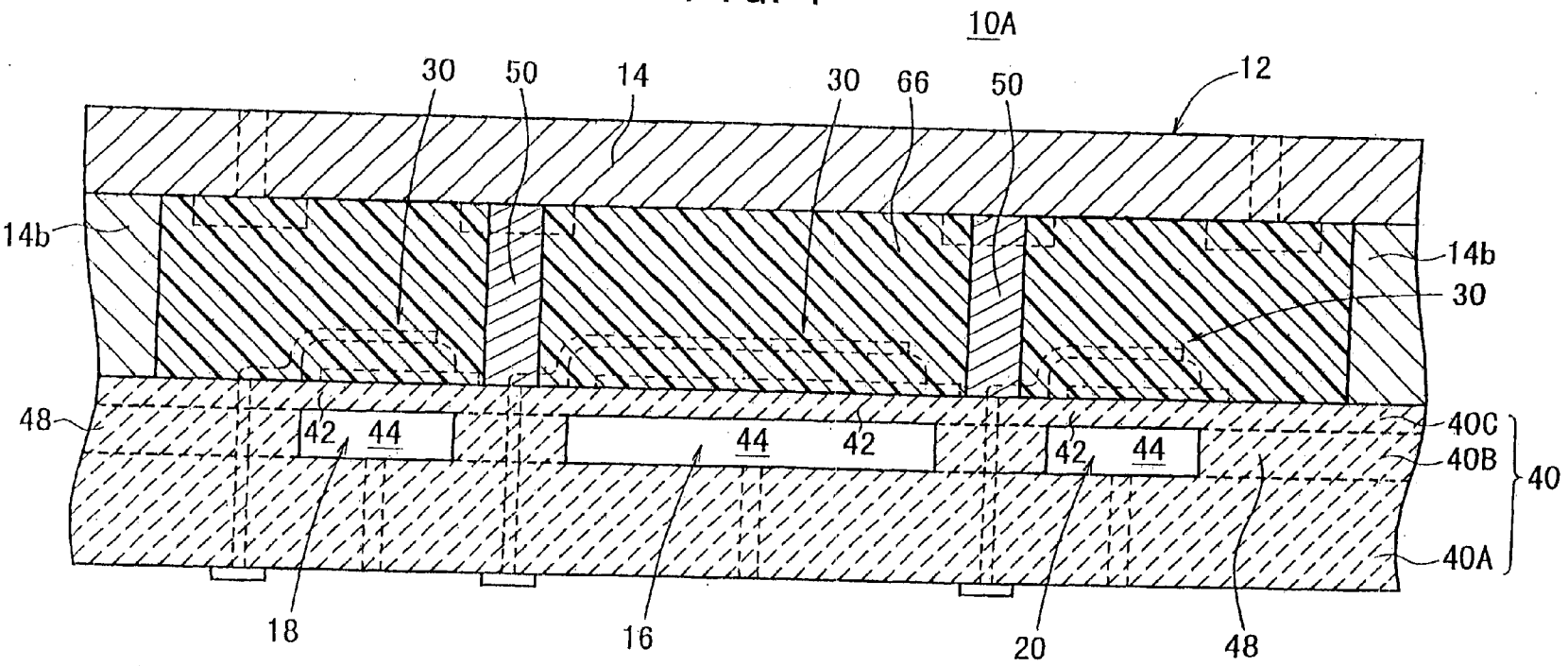
FIG. 4 shows a sectional view illustrating a portion including a support pillar, concerning the pump according to the first embodiment.

As shown in FIGS. 2 and 4, a plurality of support pillars 50, which are disposed in the vicinity of the actuator sections 30, intervene between the casing 14 and the substrate 40, and thus the rigid junction is maintained. As shown in FIGS. 1 and 3, the rigid junction may be maintained by using the outer circumferential fixed section 14*b* of the casing 14. In this case, it is not indispensable to provide the support pillar 50.

It is most desirable that the rigid junction is effected by using the support pillars 50 and the outer circumferential fixed section 14*b* of the casing 14 in combination in order to allow the pump 10 to have certain rigidity.

As shown in FIG. 1, each of the actuator sections 30 comprises the vibrating section 42 and the fixed section 48 described above as well as an operating section 64 including a shape-retaining layer 60 such as a piezoelectric/electrostrictive layer or an anti-ferroelectric layer formed directly on the vibrating section 42, and a pair of electrodes 62 (a lower electrode 62*a* and an upper electrode 62*b*) formed on upper and lower surfaces of the shape-retaining layer 60. The pair of electrodes 62 may have a structure in which they are formed on the upper and lower surfaces of the shape-retaining layer 60 as shown in FIG. 1, or they may have a structure in which they are formed on only the upper or lower surface of the shape-retaining layer 60.

Figure 5:
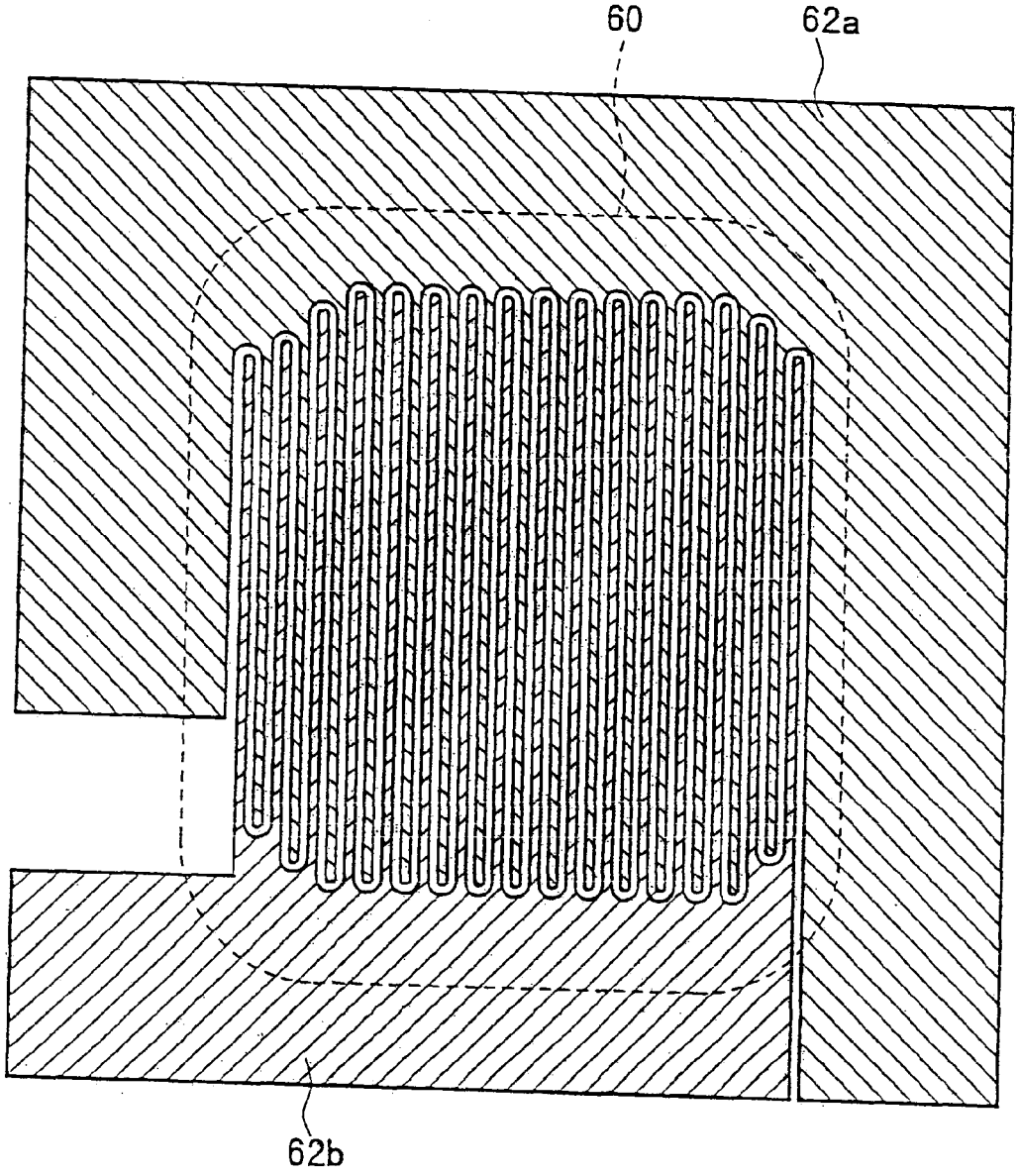
FIG. 5 shows an example of the planar configuration of a pair of electrodes formed on an actuator section.

When the pair of electrodes 62 are formed on only the upper surface of the shape-retaining layer 60, the pair of electrodes 62 may have the following planar configurations. That is, as shown in FIG. 5, it is preferable to adopt a configuration in which a large number of comb teeth face to one another in a complementary manner. Alternatively, it is possible to adopt, for example, a spiral configuration and a branched configuration as disclosed in Japanese Laid-Open Patent Publication No. 10-78549 as well.

Figure 6A:
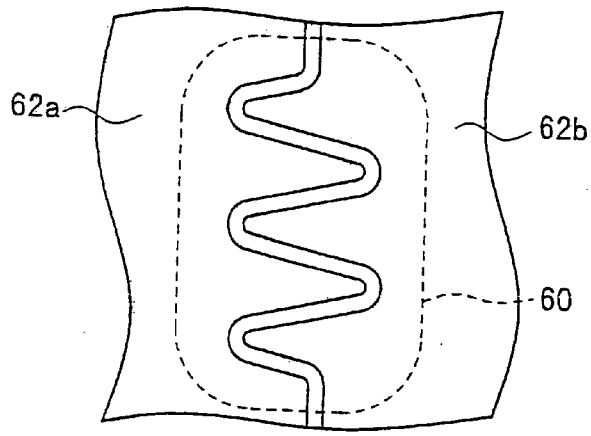
FIG. 6A illustrates an example of comb teeth of the pair of electrodes arranged along the major axis of a shape-retaining layer.
Figure 6B:
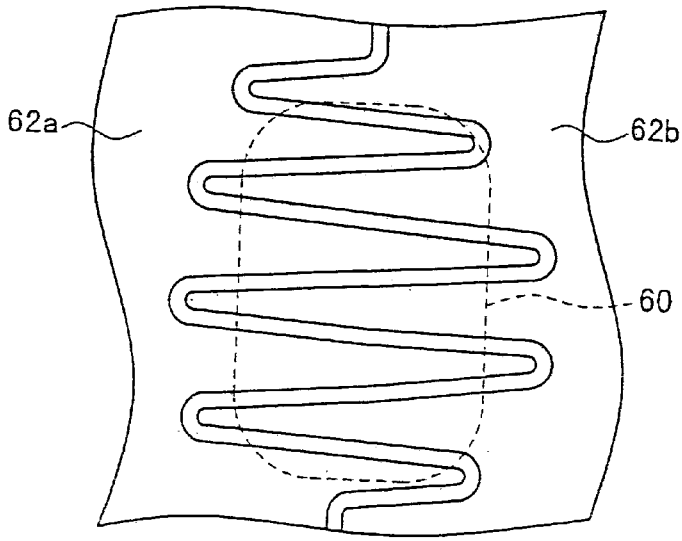
FIG. 6B illustrates another example.

When the planar configuration of the shape-retaining layer 60 is, for example, an elliptic configuration, and the pair of electrodes 60 are formed to have the comb-shaped configuration, for example, then the following forms are available. That is, as shown in FIGS. 6A and 6B, it is possible to use a form in which the comb teeth of the pair of electrodes 62 are arranged along the major axis of the shape-retaining layer 60. Further, as shown in FIGS. 7A and 7B, it is possible to use a form in which the comb teeth of the pair of electrodes 62 are arranged along the minor axis of the shape-retaining layer 60.

Figure 7A:
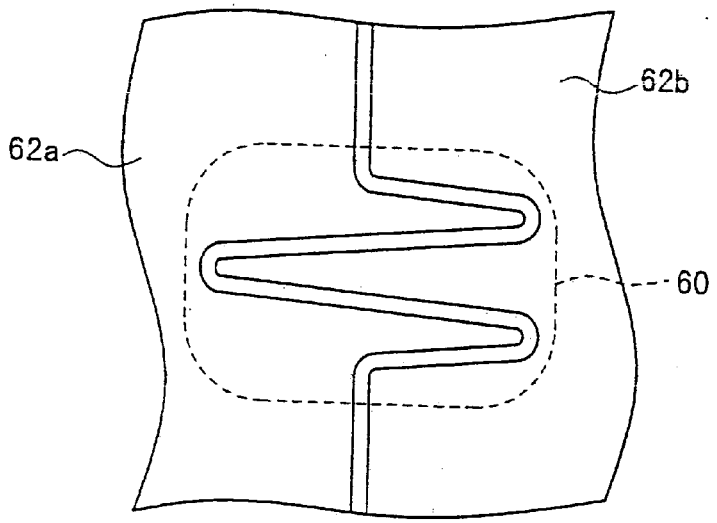
FIG. 7A illustrates an example of comb teeth of the pair of electrodes arranged along the minor axis of the shape-retaining layer.
Figure 7B:
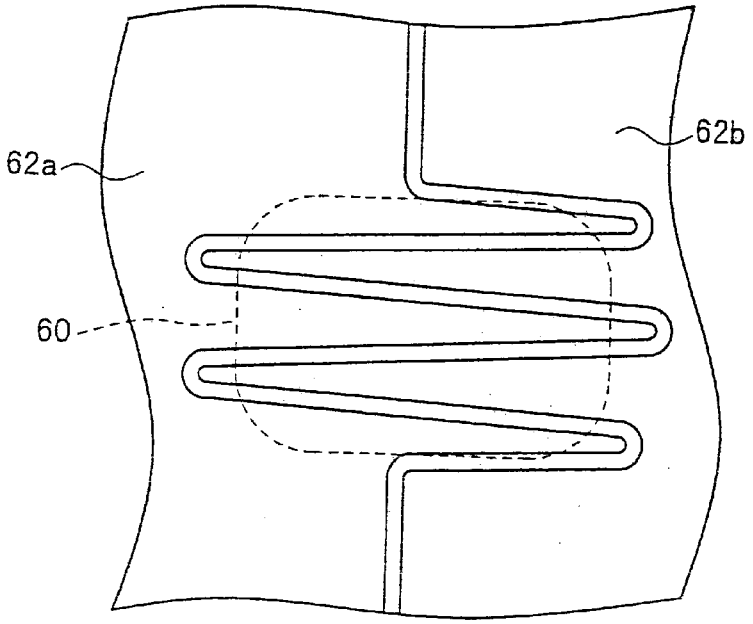
FIG. 7B illustrates another example.

As shown in FIGS. 6A and 7A, it is possible to use the form in which the portion of the comb teeth of the pair of electrodes 62 is included in the planar configuration of the shape-retaining layer 60. Further, as shown in FIGS. 6B and 7B, it is possible to use the form in which the portion of the comb teeth of the pair of electrodes 62 protrudes from in the planar configuration of the shape-retaining layer 60. The form shown in FIGS. 6B and 7B is more advantageous in view of the bending displacement of the actuator section 30.

Figure 11:
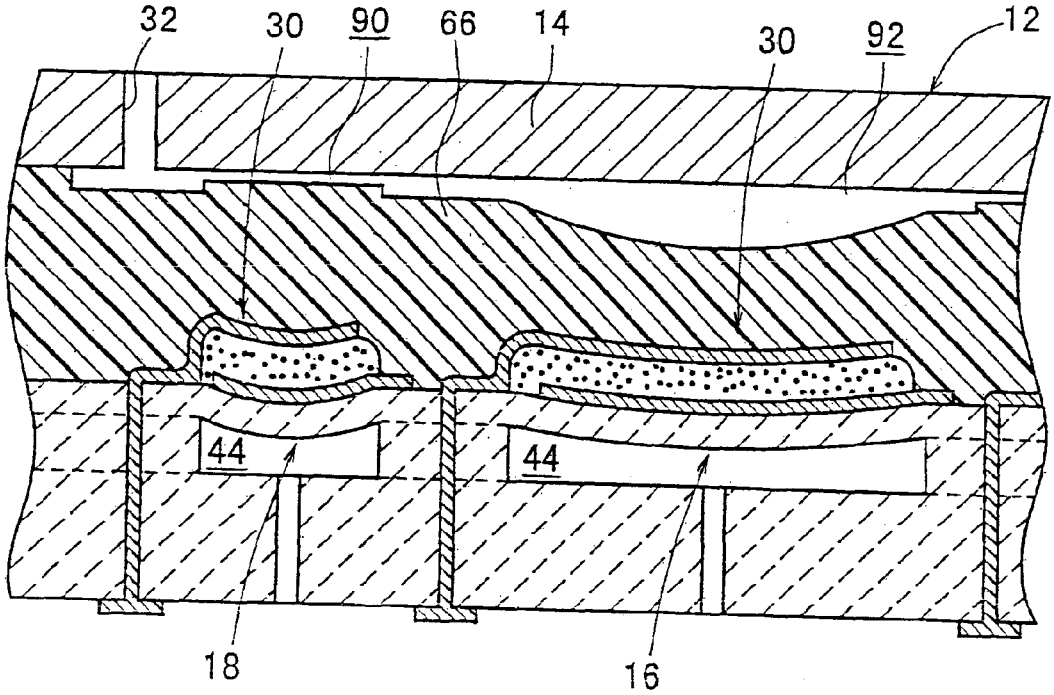
FIG. 11 illustrates a state in which the input valve section and a pump section are driven, concerning the pump according to the first embodiment.

By the way, as shown in FIG. 1, for example, when the pair of electrodes 62 are arranged such that the upper electrode 62*b* is formed on the upper surface of the shape-retaining layer 60, and the lower electrode 62*a* is formed on the lower surface of the shape-retaining layer 60, it is possible to cause the bending displacement in the first direction so that the actuator section 30 is convex toward the hollow space 44, for example, as shown in FIG. 11. Alternatively, it is also possible to cause the bending displacement in the second direction so that the actuator section 44 is convex toward the casing 14.

Figure 8:
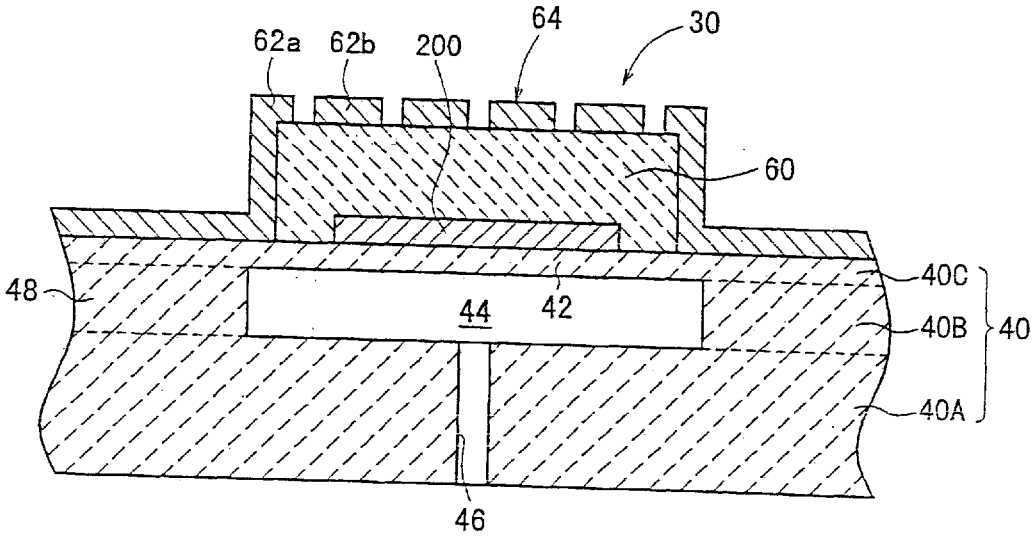
FIG. 8 shows a sectional view illustrating an example in which the shape-retaining layer is provided with a pair of electrodes and an intermediate layer.

The following arrangement is also available as shown in FIG. 8. That is, the pair of electrodes 62*a*, 62*b* are formed on the upper surface of the shape-retaining layer 60, and a metal film layer (i.e., an intermediate layer 200) is formed between the vibrating section 42 and the shape-retaining layer 60. The formation of the intermediate layer 200 makes it possible to enhance the displacement retention ratio to be about 70%, probably because of the following reason.

That is, when the metal film layer (intermediate layer 200), which is soft at a high temperature, is allowed to intervene between the vibrating section 42 and the shape-retaining layer 60, the stress is possibly mitigated, which would be otherwise generated in the shape-retaining layer 60 due to any stress constraint of the vibrating section 42 during the process from the sintering step to the cooling step for the shape-retaining layer 60.

Those preferably used as a material for the intermediate layer 200 include Pt, Pd, and an alloy of the both. The thickness of the intermediate layer 200 is appropriately not less than 1 $\mu$m and not more than 10 $\mu$m. Preferably, the thickness is not less than 2 $\mu$m and not more than 6 $\mu$m, because of the following reason.

That is, if the thickness is less than 1 $\mu$m, the effect of stress mitigation as described above does not appear. If the thickness exceeds 10 $\mu$m, the intermediate layer 200 is peeled off from the vibrating section 42 due to any sintering contraction caused during the sintering step for the intermediate layer 200.

As shown in FIG. 1, the main pump body 12 comprises a displacement-transmitting section 66 formed on each of the actuator sections 30, for transmitting the displacement of each of the actuator sections 30 in the direction toward the back surface of the casing 14.

A circular recess 68 is formed just under the introducing hole 32 at the upper portion of the displacement-transmitting section 66. A rectangular recess 70 is formed between the input valve section 18 and the pump section 16. A rectangular recess 72 is formed between the pump section 16 and the output valve section 20. A circular recess 74 is formed just under the discharge hole 34.

Figure 9:
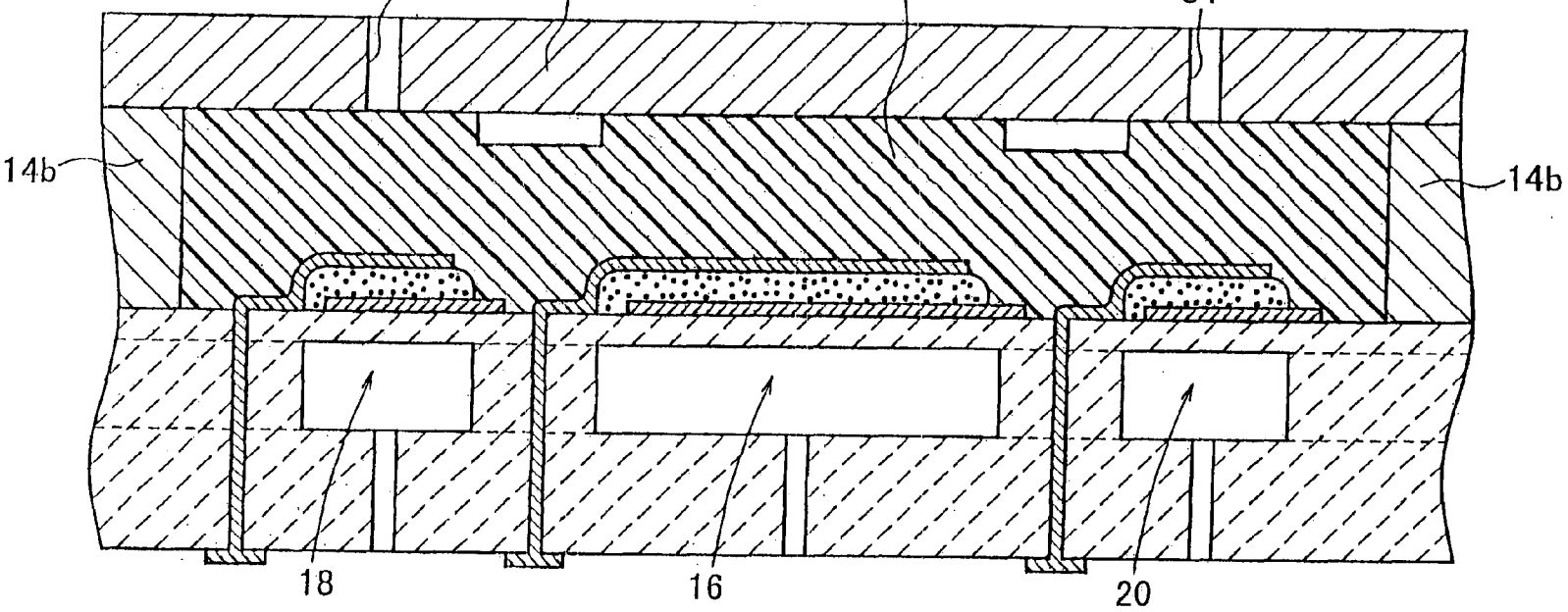
FIG. 9 shows a sectional view illustrating an example in which an introducing hole and a discharge hole are formed just over an input valve section and an output valve section respectively, concerning the pump according to the first embodiment.
Figure 10:
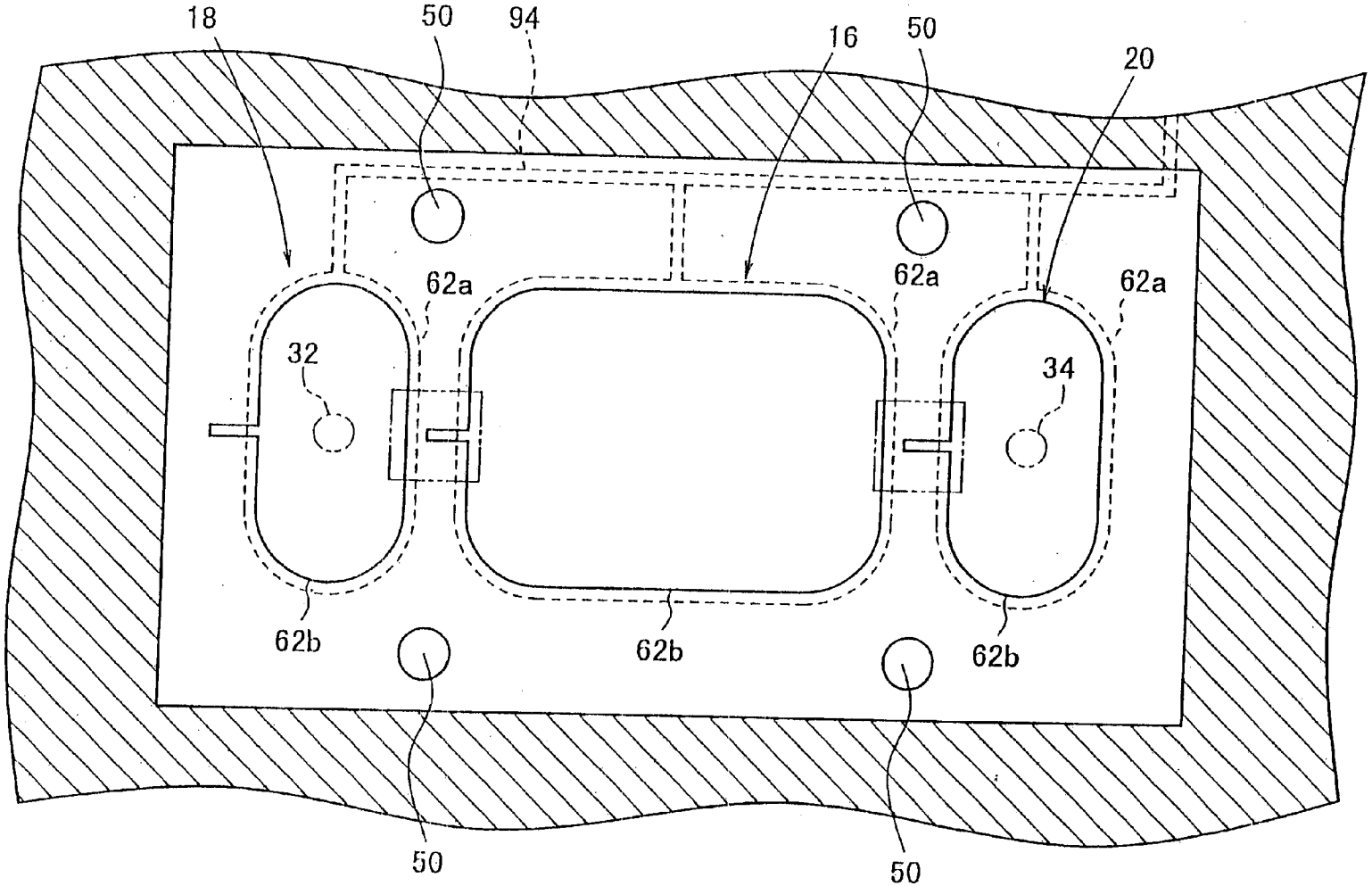
FIG. 10 shows a plan view of the main pump body depicted with the casing being removed, in the example in which the introducing hole and the discharge hole are formed just over the input valve section and the output valve section respectively.

As shown in FIGS. 9 and 10, the recesses 68, 74 can be omitted when the introducing hole 32 and the discharge hole 34 are disposed just over the input valve section 18 and the output valve section 20 respectively. In this arrangement, in addition to the realization of the miniature size, it is also possible to improve the tight contact performance between the displacement-transmitting section 66 and casing 14 and improve the function as the valve.

In the natural state, the end surface of the displacement-transmitting section 66 contacts with the back surface of the casing 14 in the pump 10A according to the first embodiment shown in FIGS. 1 and 3. Starting from this state, for example, when a control voltage indicating "open" is applied to the upper electrode 62*b* of the input valve section 18, then the actuator section 30 of the input valve section 18 makes bending displacement to be convex toward the hollow space 44, i.e., makes bending displacement in the first direction as shown, for example, in FIG. 11, and the end surface of the displacement-transmitting section 66 corresponding to the input valve section 18 is separated from the back surface of the casing 14. Thus, a flow passage 90, which communicates with the introducing hole 32, is formed at a portion corresponding to the input valve section 18.

After that, when a control voltage indicating "open" is applied to the upper electrode 62*b* of the pump section 16, then the actuator section 30 of the pump section 16 makes bending displacement to be convex toward the hollow space 44 as shown in FIG. 11, i.e., makes bending displacement in the first direction, and the end surface of the displacement-transmitting section 66 corresponding to the pump section 16 is separated from the back surface of the casing 14. Thus, flow passages 90, 92, which communicate with the introducing hole 32, are formed at portions corresponding to the input valve section 18 and the pump section 16. The same operation is performed for the output valve section 20 by supplying the control voltage.

When the application of the control voltage, for example, to the pump section 16 and the input valve section 18 is stopped, for example, then the end surface of the displacement-transmitting section 66 corresponding to the pump section 16 and the input valve section 18 contacts with the back surface of the casing 14 again, and the flow passages 90, 92 described above are closed. In other words, the actuator section 30, which is possessed, for example, by the input valve section 18 and the pump section 16, functions as a flow passage-forming means for selectively forming, for example, the flow passages 90, 92 at the portions corresponding to the input valve section 18 and the pump section 16.

In a preferred embodiment, the input valve section 18 and the output valve section 20 are constructed such that large rigidity is obtained while ensuring a displacement amount in a degree to reliably form the flow passage. Accordingly, it is also possible to avoid any fluid leakage. On the other hand, the pump section 16 is preferably constructed such that the displacement amount is increased to obtain a large change in volume while maintaining a certain degree of rigidity. The construction as described above can be controlled by the area, the thickness, and the material of the vibrating section 42, the area and the thickness of the shape-retaining layer 60, and the area of at least the pair of electrodes 62.

On the other hand, when the pair of electrodes 62 are formed and constructed on only the upper surface of the shape-retaining layer 60, or when an anti-ferroelectric is used as the shape-retaining layer 60, then the end surface of the displacement-transmitting section 66 is in a state of being separated from the back surface of the casing 14 in the natural state. Therefore, a control voltage indicating "close" is applied to each of the upper electrodes 62*b* of the input valve section 18, the pump section 16, and the output valve section 20 at the point of time of start of the operation. Accordingly, the bending displacement is effected so that each of the actuator sections 30 is convex toward the back surface of the casing 14, i.e., in the second direction. Thus, the respective end surfaces of the input valve section 18, the pump section 16, and the output valve section 20 contact with the back surface of the casing 14 beforehand.

The application of the control voltage to the input valve section 18, the pump section 16, and the output valve section 20 is selectively stopped to restore the actuator section 30 to the original state. Thus, for example, the flow passages 90, 92 are selectively formed at the portions corresponding to the input valve section 18 and the pump section 16 in an appropriate manner.

Alternatively, for example, as for the pump section 16, the pair of electrodes 62 may be formed on only the upper surface of the shape-retaining layer 60, and as for the input valve section 18 and the output valve section 20, the upper electrode 62*b* and the lower electrode 62*a* may be formed on the upper and lower surfaces of the respective shape-retaining layers 60. It is also possible to use an arrangement in which the components are formed in an inverted manner as compared with the above. When the arrangement as described above is adopted, then the displacement of the actuator section can be enlarged, and the discharge amount of the pump section 16 can be increased, which is desirable.

The voltage is supplied to the respective lower electrodes 62*a* of the pump section 16, the input valve section 18, and the output valve section 20 via a common wiring 94 disposed in the lateral direction of the casing 14. In this case, the common wiring 94 is connected to GND, or an offset voltage is supplied by the aid of a power source. In this arrangement, when a voltage (negative voltage in a direction opposite to the polarization direction) to generate the displacement in the second direction (displacement to be convex toward the back surface at the casing 14) is applied as the offset voltage to the actuator section 30, it is possible to make reliable contact between the casing 14 and the displacement-transmitting section 66.

On the other hand, the voltage is supplied to the respective upper electrodes 62*b* of the pump section 16, the input valve section 18, and the output valve section 20 via through-holes 96, 98, 100 from an unillustrated wiring board (stuck to the second principal surface of the substrate 40) respectively. As described above, it is also possible to allow the second principal surface of the substrate 40 (second principal surface of the substrate layer 40A) to have the function of the wiring board.

An unillustrated insulative film, which is composed of, for example, a silicon oxide film, a glass film, a ceramic film, or a resin film, is allowed to intervene at portions of intersection between the wiring connected to the respective lower electrodes 62*a* and the wiring connected to the respective upper electrodes 62*b* in order to effect mutual insulation between the wirings. It is a matter of course that the formation of the insulative film is unnecessary in some cases depending on the way of wiring.

Next, explanation will be made for each of the constitutive members of the actuator section 30, especially for the selection of, for example, the material of each of the constitutive members, and the formation of the actuator section 30. The formation of the actuator section 30 is described, for example, in Japanese Laid-Open Patent Publication Nos. 3-128681, 5-49270, 8-51241, 8-107238, and 10-190086, an example of which will be explained below.

At first, the vibrating section 42 is preferably made of a highly heat-resistant material, because of the following reason. That is, when the operating section 64 is joined to the vibrating section 42, a structure is used, in which the vibrating section 42 is directly supported without using any material such as an organic adhesive which is inferior in heat resistance. In such a case, the vibrating section 42 is preferably made of a highly heat-resistant material, in order that the quality of the vibrating section 42 is not changed at least during the process for forming the shape-retaining layer 60.

The vibrating section 42 is preferably made of an electrically insulative material in order to electrically separate the wiring connected to the lower electrode 62*a* of the pair of electrodes 62 formed on the substrate 40 from the wiring connected to the upper electrode 62*b*.

Therefore, the vibrating section 42 may be made of a material such as highly heat-resistant metal or porcelain enamel with its metal surface coated with a ceramic material such as glass. However, ceramics is most appropriate.

Those usable as the ceramics for constructing the vibrating section 42 include, for example, stabilized zirconium oxide, aluminum oxide, magnesium oxide, titanium oxide, spinel, mullite, aluminum nitride, silicon nitride, glass, and a mixture thereof. Especially, it is desirable to use aluminum oxide and stabilized zirconium oxide in view of the strength and the rigidity. The stabilized zirconium oxide is especially preferred, for example, because of the fact that the mechanical strength is high even when the thickness of the vibrating section 42 is thin, the toughness is high, and the chemical reactivity is small with respect to the shape-retaining layer 60 and the pair of electrodes 62. The term "stabilized zirconium oxide" includes stabilized zirconium oxide and partially stabilized zirconium oxide. The stabilized zirconium oxide has, for example, a cubic crystalline structure, and hence it does not cause any phase transition.

On the other hand, the zirconium oxide causes phase transition between the cubic and the tetragonal at about 1000° C., and the crack is sometimes formed during the phase transition. The stabilized zirconium oxide contains 1 to 30 molar % of a stabilizer such as calcium oxide, magnesium oxide, yttrium oxide, scandium oxide, ytterbium oxide, cerium oxide, and oxide of rare earth metal. In order to enhance the mechanical strength of the vibrating section 42, it is preferable that the stabilizer contains yttrium oxide. In this case, the yttrium oxide is preferably contained in an amount of 1.5 to 6 molar %, more preferably 2 to 4 molar %. Further, it is preferable to contain aluminum oxide in an amount of 0.1 to 5 molar %.

The crystalline phase may be, for example, a mixed phase of cubic+monoclinic, a mixed phase of tetragonal+monoclinic, or a mixed phase of cubic+tetragonal+monoclinic. Especially, those having a major crystalline phase composed of tetragonal or a mixed phase of tetragonal+cubic are most preferred in view of the strength, the toughness, and the durability.

When the vibrating section 42 is composed of ceramics, a large number of crystal grains constitute the vibrating section 42. In order to enhance the mechanical strength of the vibrating section 42, the average particle size of the crystal grain is preferably 0.05 to 2 $\mu$m, more preferably 0.1 to 1 $\mu$m.

The fixed section 48 is preferably composed of ceramics. However, the fixed section 48 may be composed of the same ceramic material as that of the vibrating section 42, or it may be composed of a ceramic material different from that of the vibrating section 42. Those usable as the ceramics for constructing the fixed section 48 include, for example, stabilized zirconium oxide, aluminum oxide, magnesium oxide, titanium oxide, spinel, mullite, aluminum nitride, silicon nitride, glass, and a mixture thereof, in the same manner as the material for the vibrating section 42.

Especially, those preferably adopted for the substrate 40 to be used for the pump 10A according to the first embodiment include, for example, a material containing a major component of zirconium oxide, a material containing a major component of aluminum oxide, and a material containing a major component of a mixture thereof. Especially, those containing a major component of zirconium oxide are preferred. Clay or the like is sometimes added as a sintering aid. However, it is necessary to regulate the aid component so that those liable to form glass such as silicon oxide and boron oxide are not contained in an excessive amount, because of the following reason. That is, although the material liable to form glass is advantageous to join the substrate 40 and the shape-retaining layer 60, it facilitates the reaction between the substrate 40 and the shape-retaining layer 60, and it is difficult to maintain a predetermined composition of the shape-retaining layer 60. As a result, such a material causes deterioration of element characteristics.

That is, it is preferable that the silicon oxide or the like in the substrate 40 is restricted to be not more than 3%, preferably not more than 1% in a weight ratio. It is noted that the major component refers to a component which exists in a ratio of not less than 50% in a weight ratio.

In order to provide the pair of electrodes 62 and the shape-retaining layer 60 on the vibrating section 42 so that the operating section 64 is formed, a variety of known film formation techniques are appropriately adopted. However, when the shape-retaining layer 60 is formed, various thick film formation techniques are preferably adopted, including, for example, those based on screen printing, spray, coating, dipping, application, and electrophoresis, because of the following reason.

That is, when the thick film formation technique is used, it is possible to form the film on the outer surface of the vibrating section 42 of the substrate 40 by using a paste or a slurry containing a major component of, for example, piezoelectric/electrostrictive ceramic particles having an average particle size of about 0.01 $\mu$m to 7 $\mu$m, preferably about 0.05 $\mu$m to 5 $\mu$m. Thus, it is possible to obtain good element characteristics.

Among the thick film formation techniques, the screen printing method is used especially preferably in view of the fact that the fine patterning can be formed inexpensively. In order to obtain, for example, large displacement at a low operation voltage, it is desirable that the thickness of the shape-retaining layer 60 is preferably not more than 50 $\mu$m, more preferably not less than 3 $\mu$m and not more than 40 $\mu$m.

The electrophoresis method typically makes it possible to form the film at a high density with a high shape accuracy, as well as it has features as described in technical literatures of "DENKI KAGAKU 53, No. 1 (1985), pp. 63–68, written by Kazuo ANZAI" and "Proceedings of First Symposium on Higher-Order Ceramic Formation Method Based on Electrophoresis (1998), pp. 5–6 and pp. 23 to 24". Therefore, it is advantageous to appropriately select the various techniques considering, for example, the required accuracy and the reliability.

The electrode material for constructing the pair of electrodes 62 is not specifically restricted provided that the material is a conductor capable of withstanding oxidizing atmospheres at high temperatures. For example, the material may be a metal simple substance or an alloy. Further, no problem occurs at all even when the material is a mixture of insulative ceramics and a metal simple substance or an alloy thereof.

Those more preferably used include electrode materials containing a major component of a noble metal having a high melting point such as platinum, palladium, and rhodium, or an alloy such as silver-palladium, silver-platinum, and platinum-palladium. Alternatively, those preferably used include cermet materials composed of platinum and a substrate material, for example, a piezoelectric/electrostrictive material.

Among them, it is more preferable and desirable to use a material composed of only platinum or containing a major component of platinum alloy. The ratio of the substrate material added to the electrode material is preferably about 5 to 30% by volume. The ratio of the piezoelectric/electrostrictive material is preferably about 5 to 20% by volume.

The pair of electrodes 62 are formed respectively by using the electrode material as described above in accordance with the aforementioned thick film formation technique or the ordinary film formation method based on the thin film formation method such as sputtering, ion beam, vacuum deposition, ion plating, CVD, and plating. Especially, when the lower electrode 62*a* is formed, various thick film formation techniques are preferably adopted, including, for example, screen printing, spray, dipping, application, and electrophoresis. When the upper electrode 62*b* is formed, the thin film formation method described above is preferably adopted as well in addition to the thick film formation technique to be effected in the same manner as described above. In this embodiment, any of the lower electrode 62*a* and the upper electrode 62*b* is generally formed to have a thickness of not more than 20 $\mu$m, preferably not more than 5 $\mu$m.

The entire thickness of the operating section 64, which is obtained by adding the thickness of the shape-retaining layer 60 to the thicknesses of the lower electrode 62*a* and the upper electrode 62*b*, is generally not more than 100 $\mu$m, preferably not more than 50 $\mu$m.

When the piezoelectric/electrostrictive layer is used as the shape-retaining layer 60, those used for the piezoelectric/electrostrictive layer include, for example, materials containing a major component of lead zirconate lead titanate (PZT system), materials containing a major component of lead magnesium niobate (PMN system), materials containing a major component of lead nickel niobate (PNN system), materials containing a major component of lead zinc niobate, materials containing a major component of lead manganese niobate, materials containing a major component of lead magnesium tantalate, materials containing a major component of lead nickel tantalate, materials containing a major component of lead antimony stannate, materials containing a major component of lead titanate, materials containing a major component of lead magnesium tungstate, materials containing a major component of lead cobalt niobate, and composite materials containing a combination of any of the compounds described above. It is needless to say that the compound as described above is contained as a major component which occupies not less than 50% by weight. Among the ceramics described above, the ceramics containing lead zirconate is most frequently used as the constitutive material for the piezoelectric/electrostrictive layer.

When the piezoelectric/electrostrictive layer is composed of the ceramics, those preferably used include materials obtained by appropriately adding, to the material described above, for example, oxides of lanthanum, barium, niobium, zinc, cerium, cadmium, chromium, cobalt, antimony, iron, yttrium, tantalum, tungsten, nickel, manganese, lithium, strontium, and bismuth, or a combination of any of them, or another compound, for example, those obtained by appropriately adding a predetermined additive to the material described above to provide, for example, the PLZT system.

Among the piezoelectric/electrostrictive materials described above, those advantageously used include, for example, materials containing a major component composed of lead magnesium niobate, lead zirconate, and lead titanate, materials containing a major component composed of lead nickel niobate, lead magnesium niobate, lead zirconate, and lead titanate, materials containing a major component composed of lead magnesium niobate, lead nickel tantalate, lead zirconate, and lead titanate, and materials containing a major component composed of lead magnesium tantalate, lead magnesium niobate, lead zirconate, and lead titanate, as well as those obtained by substituting a part of lead of the material as described above with strontium and/or lanthanum. These materials are recommended as the material to be used when the piezoelectric/electrostrictive layer is formed by the thick film formation technique such as the screen printing described above.

In the case of the piezoelectric/electrostrictive material of the multicomponent system, the piezoelectric/electrostrictive characteristics change depending on the composition of the components. However, it is preferable to use a composition in the vicinity of the phase boundary of the pseudo-cubic/tetragonal/rhombohedral in the case of a three-component system material of lead magnesium niobate-lead zirconate-lead titanate and a four-component system material of lead magnesium niobate-lead nickel tantalate-lead zirconate-lead titanate or lead magnesium tantalate-lead magnesium niobate-lead zirconate-lead titanate which are preferably used in the embodiment of the present invention. Especially, those advantageously adopted include a composition comprising lead magnesium niobate: 15 to 50 molar %, lead zirconate: 10 to 45 molar %, and lead titanate: 30 to 45 molar %, a composition comprising lead magnesium niobate: 15 to 50 molar %, lead nickel tantalate: 10 to 40 molar %, lead zirconate: 10 to 45 molar %, and lead titanate: 30 to 45 molar %, and a composition comprising lead magnesium niobate: 15 to 50 molar %, lead magnesium tantalate: 10 to 40 molar %, lead zirconate: 10 to 45 molar %, and lead titanate: 30 to 45 molar %, because these compositions have a high piezoelectric constant and a high electromechanical coupling factor.

When an anti-ferroelectric layer is used as the shape-retaining layer 60, those desirably used as the anti-ferroelectric layer include those containing a major component of lead zirconate, those containing a major component comprising lead zirconate and lead stannate, those obtained by adding lanthanum oxide to lead zirconate, and those obtained by adding lead zirconate and/or lead niobate to a component comprising lead zirconate and lead stannate.

Especially, when the anti-ferroelectric film containing components composed of lead zirconate and lead stannate as represented by the following composition is applied to the actuator section 30 of the pump 10A according to the first embodiment, it is possible to drive the pump 10A at a relatively low voltage, which is especially preferred.

$Pb_{0.99}Nb_{0.02}[(Zr_xSn_{1-x})_{1-y}Ti_y]_{0.98}O_3$ wherein there are given $0.5<x<0.6$, $0.05<y<0.063$, $0.01<Nb<0.03$.

The anti-ferroelectric layer may be porous. When the anti-ferroelectric is porous, it is desirable that the porosity is not more than 30%.

As described above, the shape-retaining layer 60 and the pair of electrodes 62, which are formed as films on the outer surface of the vibrating section 42 of the substrate 40, may be heat-treated (sintered) every time when the respective films are formed to give a structure integrated with the substrate, specifically with the vibrating section 42. Alternatively, the shape-retaining layer 60 and the pair of electrodes 62 may be formed, followed by simultaneous heat treatment (sintering) to simultaneously join the respective films to the vibrating section 42 in an integrated manner.

It is noted that the heat treatment (sintering) for the electrode film to obtain the integrated structure is sometimes unnecessary depending on the type of the technique for forming the pair of electrodes 62.

A temperature of about 500° C. to 140° C. is generally adopted as the heat treatment (sintering) temperature for integrating the vibrating section 42 with the shape-retaining layer 60 and the pair of electrodes 62. Especially preferably, a temperature within a range of 1000° C. to 140° C. is advantageously selected. Further, when the film-shaped shape-retaining layer 60 is heat-treated, it is preferable to perform the heat treatment (sintering) while controlling the atmosphere together with an evaporation source for the shape-retaining layer 60 so that the composition of the shape-retaining layer 60 is not unstable at a high temperature. Further, it is also recommended to adopt a technique in which an appropriate cover member is placed on the shape-retaining layer 60 to perform the sintering so that the surface of the shape-retaining layer 60 is not directly exposed to the sintering atmosphere. In this case, a member composed of a material similar to the material of the substrate is used as the cover member.

On the other hand, it is preferable that the displacement-transmitting section 66 has a hardness of such a degree that the displacement of the actuator section 30 can be directly transmitted in the direction toward the casing 14. Therefore, those preferably used as the material for the displacement-transmitting section 66 include, for example, rubber, organic resin, organic adhesive film, and glass. However, no problem occurs even when the electrode layer itself, the piezoelectric material, or the material such as ceramic as described above is used. Those most preferably used include organic resins of epoxy, acrylic, silicone, and polyolefine, mixtures thereof, and organic adhesive films. Further, it is also effective to mix each of them with a filler to suppress and control contraction upon curing.

The displacement-transmitting section 66 may be connected to the actuator section 30 as follows. That is, when the material as described above is used for the displacement-transmitting section 66, then the displacement-transmitting section 66 made of the material as described above is stacked by using an adhesive, or a method is used in which a solution, a paste, or a slurry of the material as described above is subjected to, for example, coating. More specifically, the displacement-transmitting section 66 is preferably formed on the operating section 64 by means of, for example, screen printing, dipping, spinner, gravure printing, dispenser, application, and application with brush.

When the displacement-transmitting section 66 is connected to the operating section 64, it is preferable that the material for the displacement-transmitting section 66 is also used as an adhesive. The displacement-transmitting section 66 may be provided as a single layer. Alternatively, it is also desirable that the displacement-transmitting section 66 is provided as multiple layers to control the adhesive function and the contact/separation function. Especially, when an organic adhesive film is used, it can be used as an adhesive by applying the heat, which is preferred.

Those used as the constitutive material for the casing 14 include, for example, glass, quartz, plastic such as acrylic resin, ceramics, and metal. Those preferably used for the casing 14 have a hardness of such a degree that no deformation occurs when the displacement-transmitting section 66 makes contact therewith, while making it possible to maintain the rigidity of, for example, the pump section 16 and the input valve section 18.

Those preferably used for the outer circumferential fixed section 14*b* of the casing 14 and the support pillar 50 can maintain the rigidity of, for example, the pump section 16 and the input valve section 18 as well. Those used as the constitutive material for the support pillar 50 include, for example, glass, quartz, resin, plastic such as acrylic resin, ceramics, and metal. Especially preferably, the support pillar 50 is formed of a material which has a quality similar to that of the displacement-transmitting section 66 but which is hard and difficult to be deformed as compared with the displacement-transmitting section 66, in order to ensure the contact and the separation effected by the displacement-transmitting section 66.

Figure 12A:
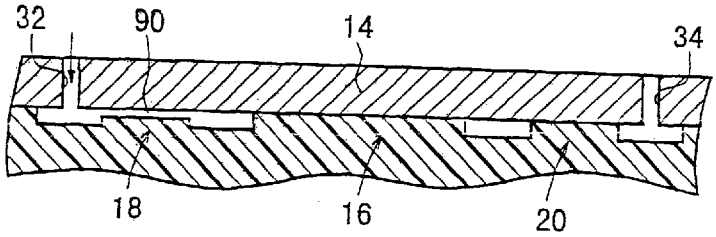
FIGS. 12A to 12F illustrate the operation of the pump according to the first embodiment.

Next, the operation of the pump 10A according to the first embodiment will be briefly explained with reference to FIGS. 3, 12A to 12F. At first, starting from the initial state shown in FIG. 3, i.e., from the state in which no flow passage is formed between the displacement-transmitting section 66 and the casing 14, the control voltage is applied to the upper electrode 62*b* of the actuator section 30 of the input valve section 18. Accordingly, as shown in FIG. 12A, the input valve section 18 makes bending displacement in the first direction, and the end surface of the displacement-transmitting section 66 (FIG. 3) corresponding to the input valve section 18 is separated from the back surface of the casing 14. Thus, the flow passage 90, which communicates with the introducing hole 32, is formed at the portion corresponding to the input valve section 18. At this time, the portion of the flow passage 90 corresponding to the input valve section 18 has a low pressure. Therefore, the fluid, which exists at the outside of the casing 14, is introduced into the flow passage 90 via the introducing hole 32.

Figure 12B:
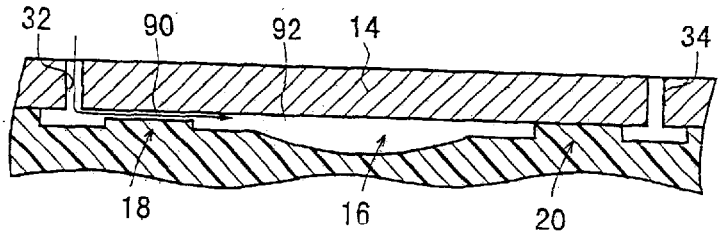
Figure 13:
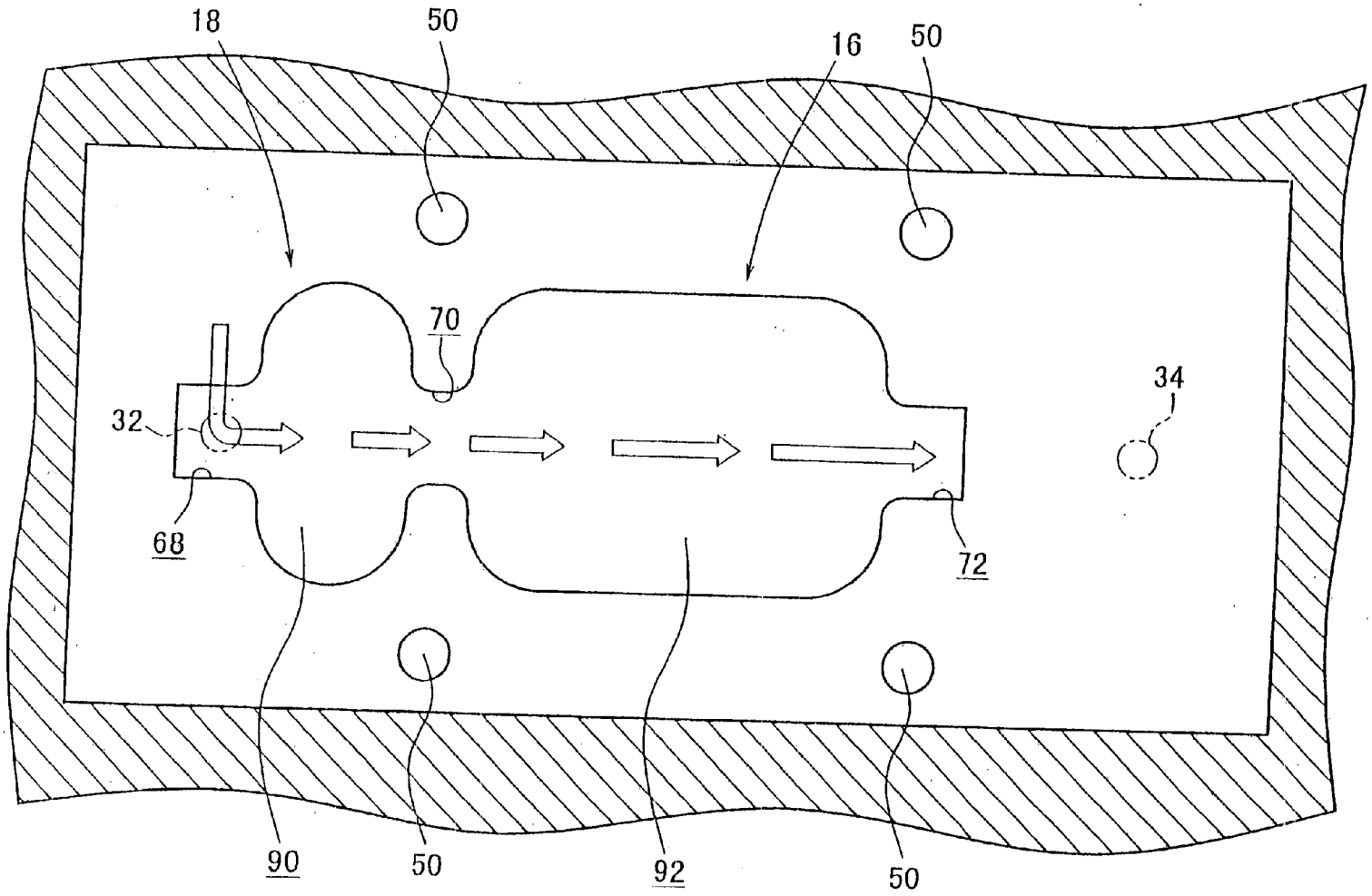
FIG. 13 illustrates an example in which the input valve section and the pump section are driven to form flow passages at the input valve section and the pump section.

Subsequently, as shown in FIG. 12B, the control voltage is applied to the upper electrode 62*b* of the actuator section 30 of the pump section 16. Accordingly, the pump section 16 makes bending displacement in the first direction, and the end surface of the displacement-transmitting section 66 (FIG. 3) corresponding to the pump section 16 is separated from the back surface of the casing 14. Thus, the flow passage 92 is formed at the portion corresponding to the pump section 16. As a result, the flow passages 90, 92, which communicate with the introducing hole 32, the input valve section 18, and the pump section 16, are formed. At this time, as shown in FIG. 13 as well, the flow passage 92 of the flow passages 90, 92 corresponding to the pump section 16 has a low pressure. Therefore, the fluid, which has been introduced via the introducing hole 32, is introduced into the flow passage 92 formed over the pump section 16.

Figure 12C:
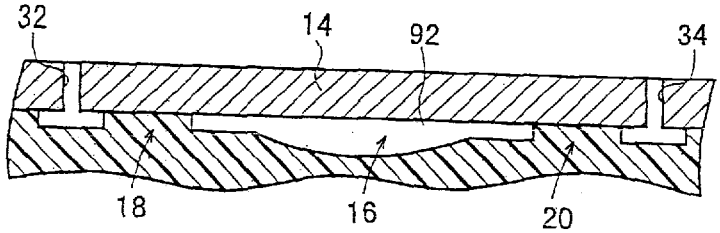

Subsequently, as shown in FIG. 12C, when the supply of the control voltage to the input valve section 18 is stopped, then the input valve section 18 is restored to the original position, and the end surface of the displacement-transmitting section 66 (FIG. 3) corresponding to the input valve section 18 contacts with the back surface of the casing 14. Accordingly, the flow passage 92 is formed at only the portion corresponding to the pump section 16. That is, the closed space 92 is formed by the input valve section 18 and the output valve section 20, giving a state in which the fluid is charged in the space 92.

Figure 12D:
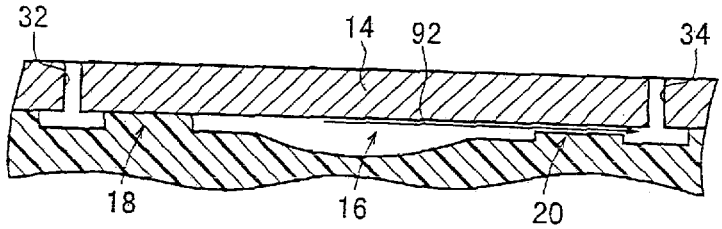

Subsequently, as shown in FIG. 12D, the control voltage is applied to the upper electrode 62*b* of the actuator section 30 of the output valve section 20. Accordingly, the output valve section 20 makes bending displacement in the first direction, and the end surface of the displacement-transmitting section 66 (FIG. 3) corresponding to the output valve section 20 is separated from the back surface of the casing 14. Thus, the flow passage 102 is formed at the portion corresponding to the output valve section 20. As a result, the flow passages 92, 102, which communicate with the pump section 16, the output valve section 20, and the discharge hole 34, are formed.

Figure 12E:
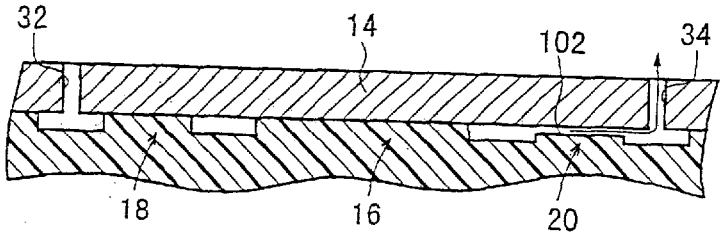
Figure 14:
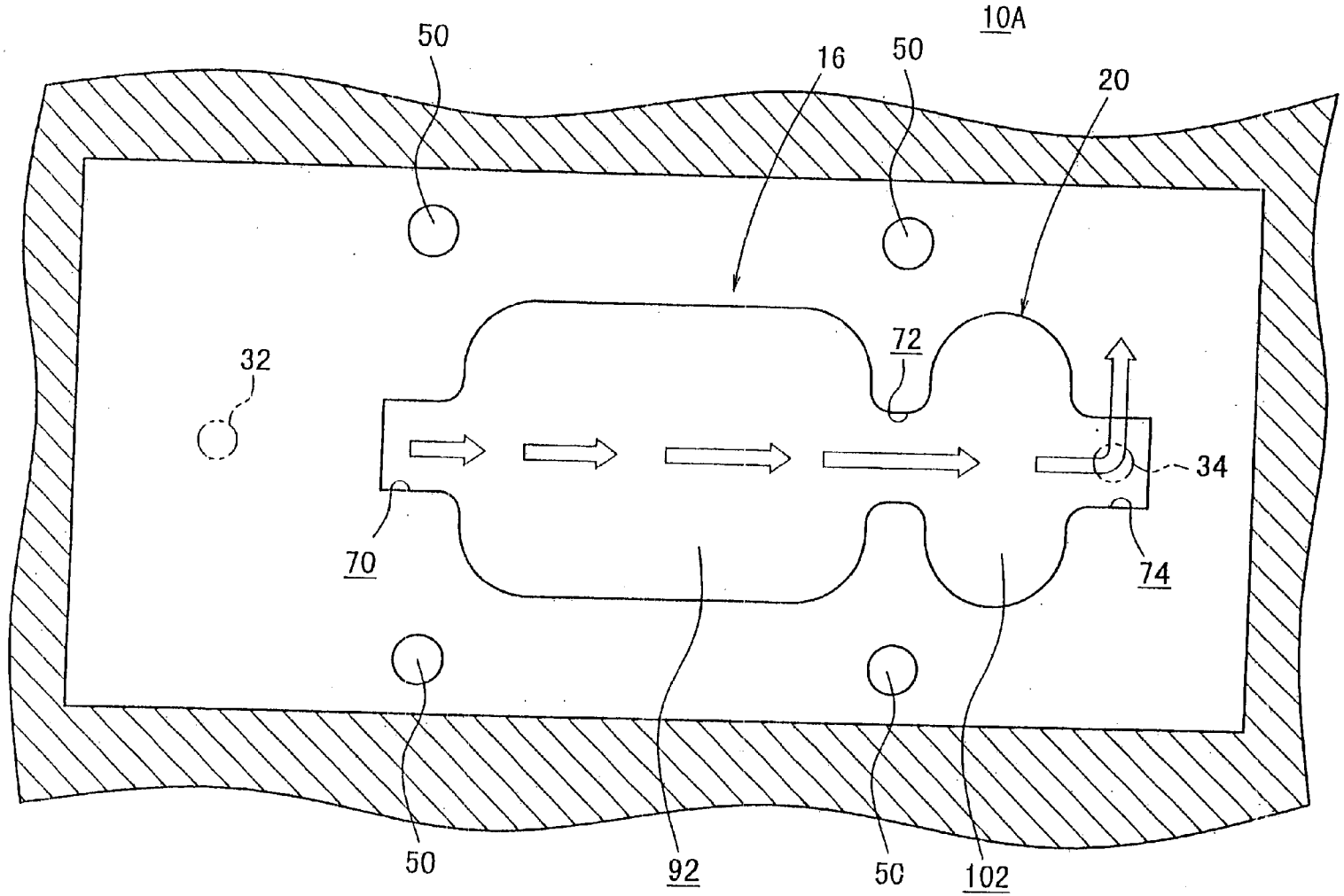
FIG. 14 illustrates an example in which the pump section and the output valve section are driven to form flow passages at the pump section and the output valve section.

Subsequently, as shown in FIG. 12E, when the supply of the control voltage to the pump section 16 is stopped, then the pump section 16 is restored to the original position, and the end surface of the displacement-transmitting section 66 (FIG. 3) corresponding to the pump section 16 contacts with the back surface of the casing 14. Accordingly, as shown in FIG. 14 as well, the fluid, which has been located at the pump section 16, is extruded toward the discharge hole 34, and the fluid is discharged to the outside of the casing 14.

Figure 12F:
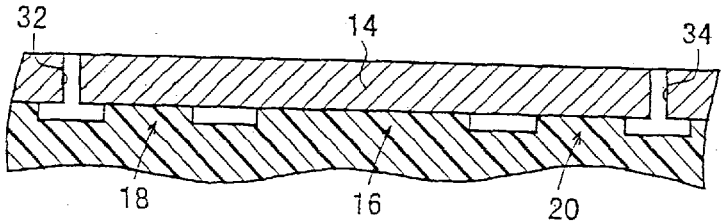

Finally, as shown in FIG. 12F, when the supply of the control voltage to the output valve section 20 is stopped, then the output valve section 20 is restored to the original position, and the end surface of the displacement-transmitting section 66 (FIG. 3) corresponding to the output valve section 20 contacts with the back surface of the casing 14. Accordingly, the remaining fluid, which has been located at the output valve section 20, is extruded toward the discharge hole 34, and the fluid is discharged to the outside of the casing 14.

As described above, the pump 10A according to the first embodiment comprises the main pump body 12 including the casing 14 to which the fluid is supplied, and the input valve section 18, the pump section 16, and the output valve section 20 which are provided opposingly to the back surface of the casing 14, for selectively forming the flow passage on the back surface of the casing 14 in accordance with the selective displacement action of the input valve section 18, the pump section 16, and the output valve section 20 in the direction to make approach or separation with respect to the back surface of the casing 14, wherein the flow of the fluid is controlled by selectively forming the flow passage. Accordingly, it is possible to facilitate the realization of the miniature and thin size of the main pump body 12. Therefore, it is possible to make application to a variety of techniques including, for example, those concerning the medical and chemical analysis fields.

In the first embodiment, the actuator section 30, which is provided for the input valve section 18, the pump section 16, and the output valve section 20 respectively, comprises the shape-retaining layer 60, the operating section 64 having at least one pair of electrodes 62 formed on the shape-retaining layer 60, the vibrating section 42 for supporting the operating section 64, and the fixed section 48 for supporting the vibrating section 42 in a vibrating manner. Further, the displacement action of the actuator section 30, which is generated by applying the voltage to the pair of electrodes 62, is transmitted via the displacement-transmitting section 66 in the direction toward the casing 14. Therefore, the selective formation of the flow passage described above can be reliably effected. The selective formation of the flow passage can be easily effected by means of the electric operation. Further, it is possible to efficiently make the pressure reduction for the introducing side and the pressure application for the discharge side.

Especially, the vibrating section 42 and the fixed section 48 are made of ceramics. Therefore, the rigidity of the main pump body 12 is enhanced, and it is possible to achieve the high speed displacement action of the actuator section 30. This results in the increase in operation frequency of the displacement, making it possible to achieve the increase in discharge amount (movement amount) of the fluid. That is, in this embodiment, it is possible to realize the miniature size and the light weight of the main pump body 12, and it is possible to simultaneously realize the increase in discharge amount (movement amount) of the fluid.

According to the fact described above, the pump 10A concerning the first embodiment can be constructed as a pressure-applying pump and a pressure-reducing pump. It is possible to increase the attainable pressure and quicken the period required to arrive at the attainable pressure. Therefore, even when the atmosphere outside the casing 14 is at a reduced pressure, it is possible to sufficiently operate the input valve section 18, the pump section 16, and the output valve section 20.

The displacement of the actuator section 30 is transmitted via the displacement-transmitting section 66. Therefore, it is possible to construct the input valve section 18 and the output valve section 20 which are excellent in sealing performance (tight contact performance). Especially, in the natural state (initial state), the end surface of the displacement-transmitting section 66 is allowed to make contact with the back surface of the casing 14. Therefore, it is unnecessary to provide any fluid pool in the main pump body 12. Thus, it is possible to further contemplate the miniature size.

The shape-retaining layer 60 is constructed by using the piezoelectric layer and/or the electrostrictive layer and/or the anti-ferroelectric layer. Therefore, it is possible to improve the response performance, and it is possible to further facilitate the increase in operation frequency of the displacement as described above.

When the fluid is gas to be used in the pump 10A according to the first embodiment, it is desirable that the depth of the recesses 70, 72 formed on the both sides of the pump section 16 is preferably larger than 0 mm and not more than 0.1 mm in view of the security for the compressibility and the pressure reduction ratio, more desirably 0.1 $\mu$m to 10 $\mu$m in view of the security for the resistance of the flow passage, the compressibility, and the pressure reduction ratio.

Figure 15:
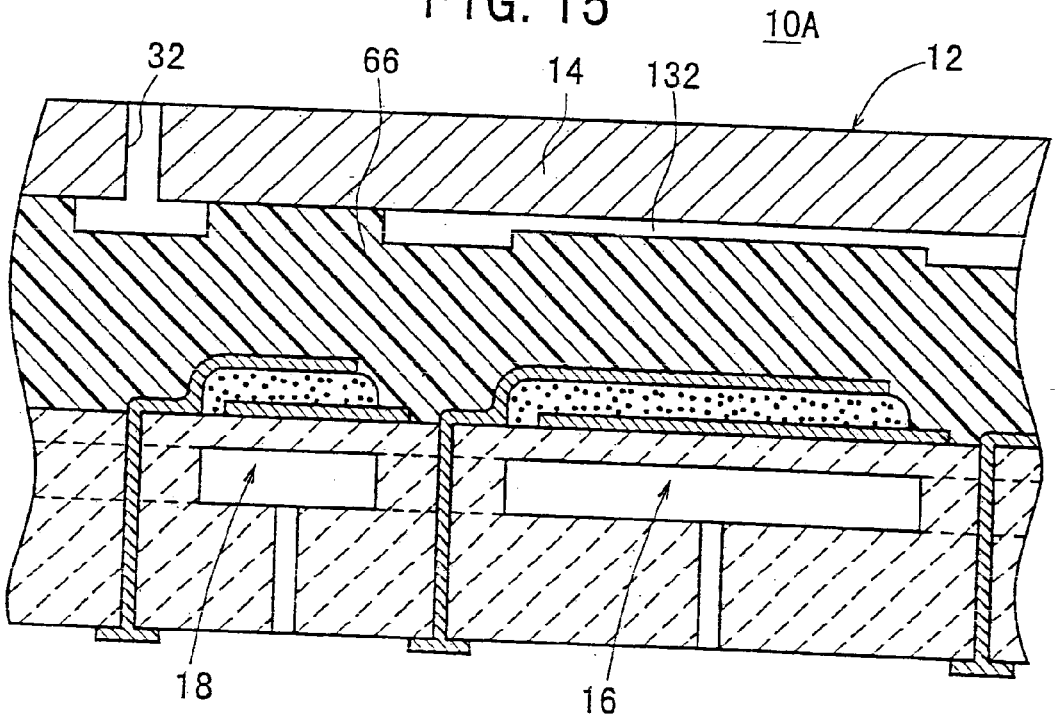
FIG. 15 shows a sectional view illustrating an example in which a gap is formed between an end surface of a displacement-transmitting section and a back surface of the casing in the pump according to the first embodiment.

The pump 10A according to the first embodiment is formed such that the end surface of the displacement-transmitting section 66 is allowed to make contact with the back surface of the casing 14 when the displacement of the actuator section 30 of the pump section 16 is in the state of making nearest approach to the back surface of the casing 14 (i.e., in the case of the natural state). Alternatively, as shown in FIG. 15, a gap 132 may be formed between the end surface of the displacement-transmitting section 66 and the back surface of the casing 14. In this arrangement, the compressibility and the pressure reduction ratio are lowered.

However, this arrangement is advantageous in response performance. Especially, when liquid is used as the fluid, no problem occurs even when the gap 132 is provided, because of the importance of the change in volume of the flow passage.

Next, explanation will be made for several modified embodiments of the pump 10A according to the first embodiment with reference to FIGS. 16 to 24.

Figure 16:
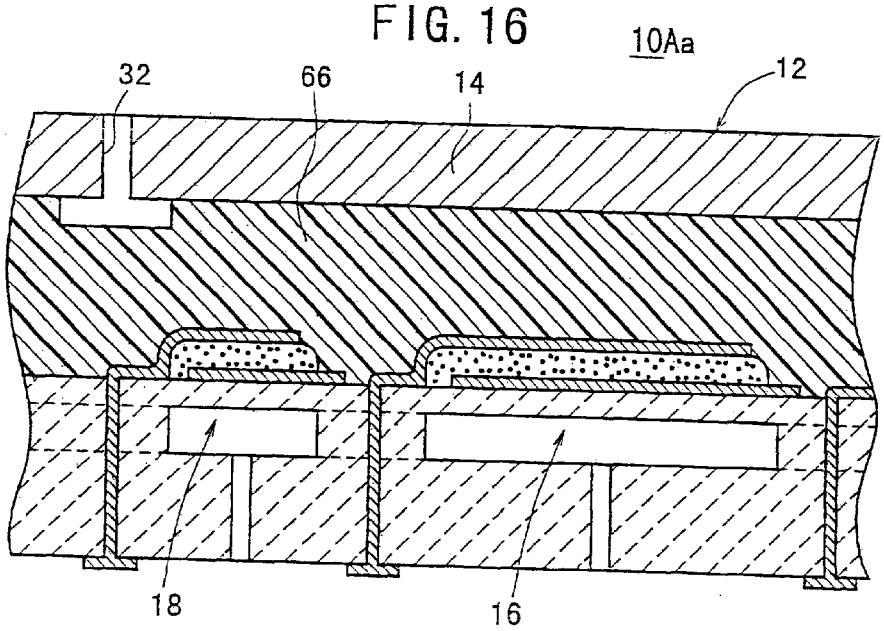
FIG. 16 shows a cross-sectional arrangement illustrating a pump according to a first modified embodiment concerning the first embodiment.

At first, as shown in FIG. 16, a pump 10Aa according to a first modified embodiment utilizes the so-called crosstalk in which the displacement actions of the input valve section 18 and the pump section 16 are actively transmitted to the adjoining portions, for example, without forming the rectangular recess 70 (see FIG. 3) in the displacement-transmitting section 66.

Figure 17:
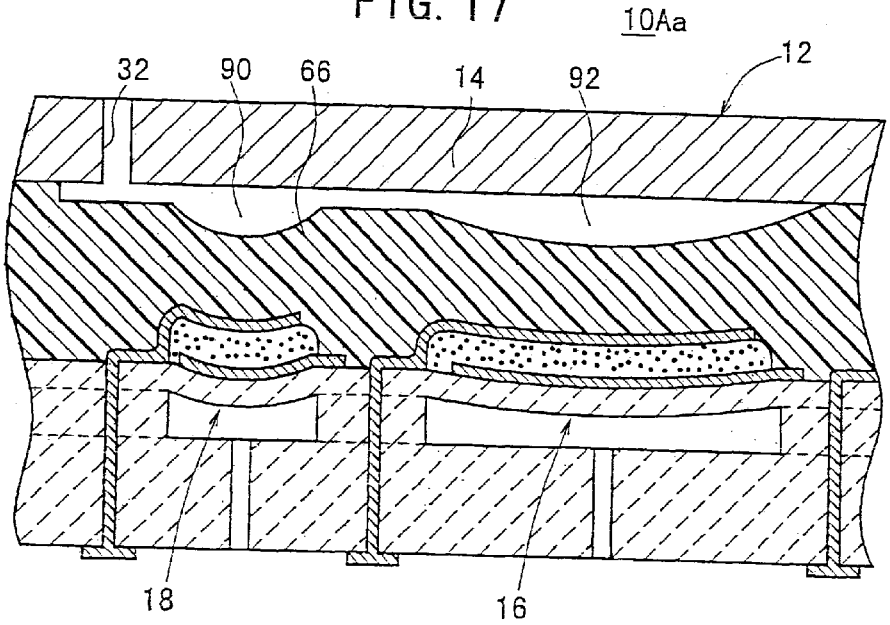
FIG. 17 illustrates a state in which the pump according to the first modified embodiment concerning the first embodiment is operated.

Accordingly, as shown in FIG. 17, when the input valve section 18 and the pump section 16 are simultaneously displaced in the first direction, the flow passages 90, 92, which communicate with each other, are formed from the introducing hole 32 to the pump section 16. This situation is also provided for the pump section 16 and the output valve section 20 in the same manner as described above.

When the fluid is gas, the flow passage can be optionally formed between the input valve section 18 and the pump section 16 and between the pump section 16 and the output valve section 20. In other words, the flow passage space disappears when it is unnecessary. Therefore, it is possible to increase the compressibility and the pressure reduction ratio between the casing 14 and the pump section 16, which is preferred.

Figure 18:
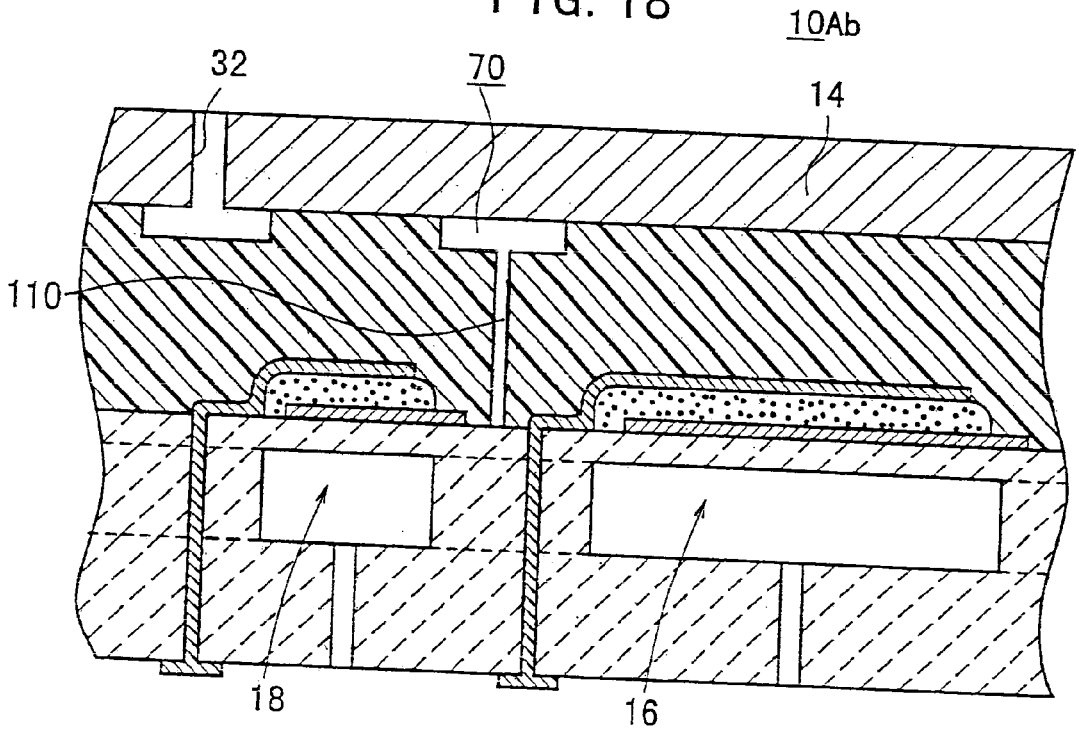
FIG. 18 shows a cross-sectional arrangement illustrating a pump according to a second modified embodiment concerning the first embodiment.

As shown in FIG. 18, a pump 10Ab according to a second modified embodiment comprises a slit 110 which is provided, for example, between the input valve section 18 and the pump section 16 in the displacement-transmitting section 66 so that the crosstalk is not transmitted to adjoining portions to realize independent operation for the respective sections. In this embodiment, the provision of the slit 110 is not limited only for the displacement-transmitting section 66, but it may be also provided between the actuator sections 30 through the substrate 40. Of course, the rectangular recess 70 shown in FIGS. 1 and 3 also makes it possible to effectively avoid the crosstalk, which is desirable to further enhance the response performance.

Figure 19:
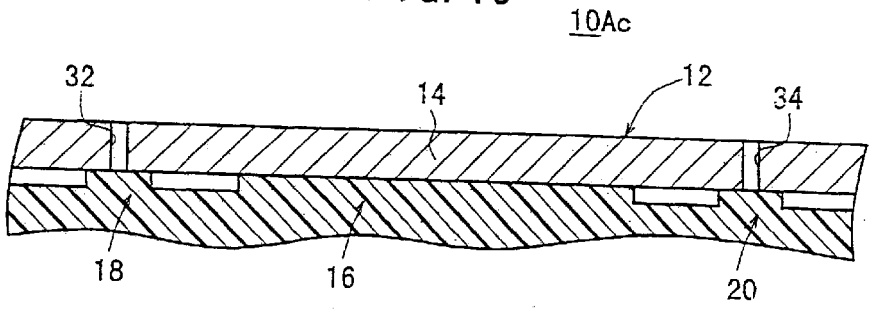
FIG. 19 shows a cross-sectional arrangement illustrating a pump according to a third modified embodiment concerning the first embodiment.

As shown in FIG. 19, a pump 10Ac according to a third modified embodiment has a structure comprising the input valve section 18 disposed just under the introducing hole 32, and the output valve section 20 disposed just under the discharge hole 34. According to this structure, it is possible to further miniaturize the size of the main pump body 12.

Figure 20:
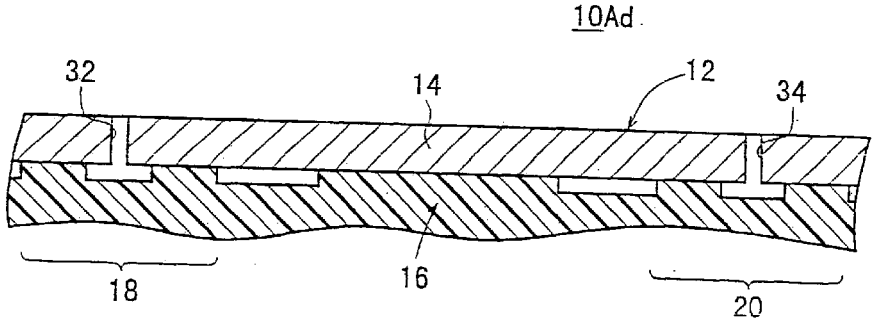
FIG. 20 shows a cross-sectional arrangement illustrating a pump according to a fourth modified embodiment concerning the first embodiment.

As shown in FIG. 20, a pump 10Ad according to a fourth modified embodiment comprises the input valve section 18 disposed just under the introducing hole 32, in which the portion of the displacement-transmitting section 66 corresponding to the input valve section 18 is formed to have a ring-shaped configuration. The pump 10Ad further comprises the output valve section 20 disposed just under the discharge hole 34, in which the portion of the displacement-transmitting section 66 corresponding to the output valve section 20 is formed to have a ring-shaped configuration.

Figure 21:
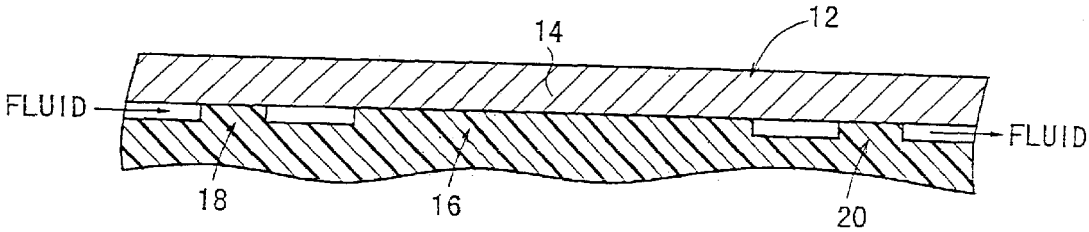
FIG. 21 shows a cross-sectional arrangement illustrating a pump according to a fifth modified embodiment concerning the first embodiment.

As shown in FIG. 21, a pump 10Ae according to a fifth modified embodiment is operated such that the fluid is introduced in the lateral direction along the back surface of the casing 14, and the fluid is discharged in the lateral direction along the back surface of the casing 14 as well.

Figure 22:
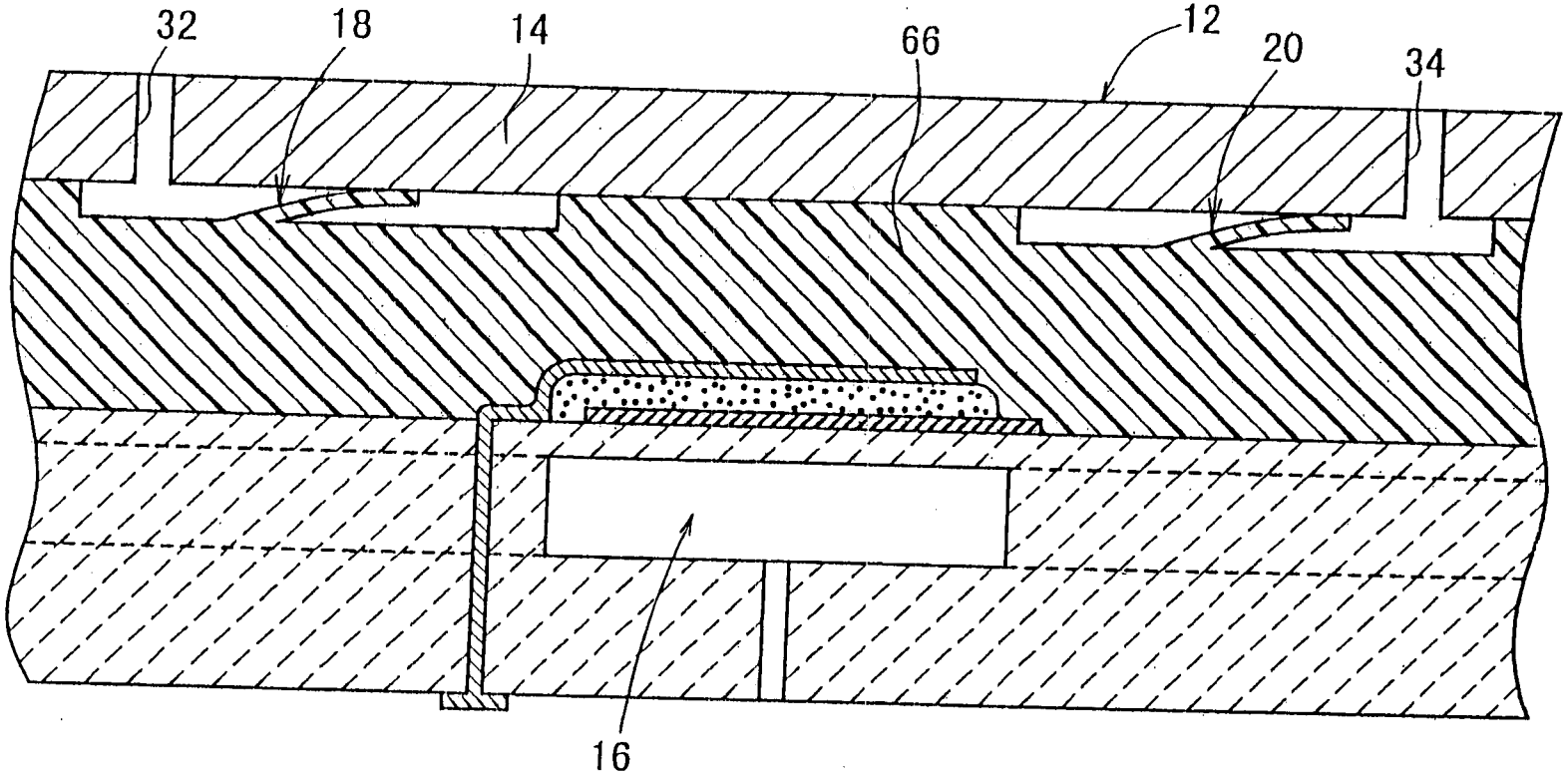
FIG. 22 shows a cross-sectional arrangement illustrating a pump according to a sixth modified embodiment concerning the first embodiment.

As shown in FIG. 22, a pump 10Af according to a sixth modified embodiment comprises the input valve section 18 and the output valve section 20 each of which has a shape of a check valve.

Although the illustration is not shown, it is a matter of course that the pump 10Af is constructed as follows. That is, the input valve section 18 has a shape of a check valve, and the output valve section 20 is based on the use of the actuator section 30. Alternatively, the input valve section 18 is based on the use of the actuator section 30, and the output valve section 20 has a shape of a check valve.

Figure 23:
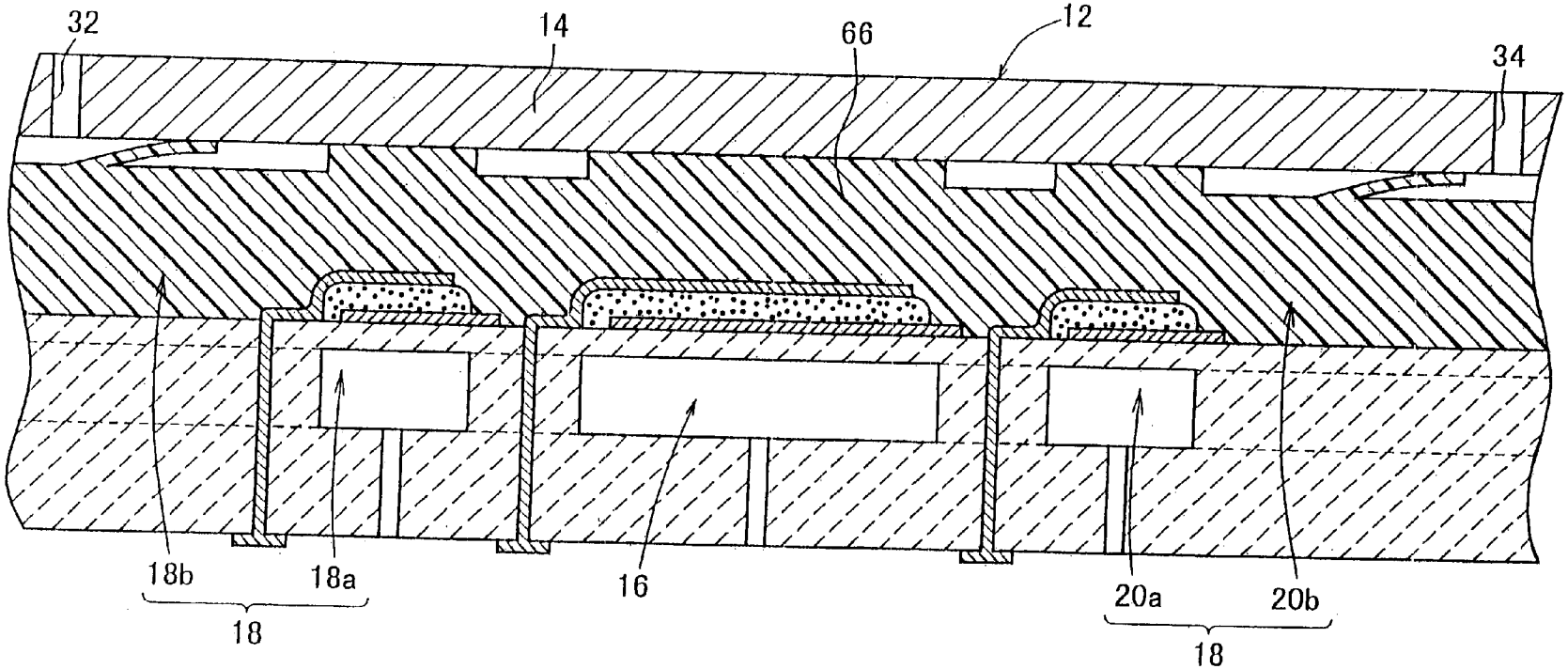
FIG. 23 shows a cross-sectional arrangement illustrating a pump according to a seventh modified embodiment concerning the first embodiment.

As shown in FIG. 23, a pump 10Ag according to a seventh modified embodiment has the input valve section 18 which comprises a first input valve section 18*a* based on the use of the actuator section 30 shown in FIGS. 1 and 3 and a second input valve section 18*b* having the shape of the check valve shown in FIG. 22. Further, the output valve section 20 comprises a first output valve section 20*a* based on the use of the actuator section 30 shown in FIGS. 1 and 3 and a second output valve section 20*b* having the shape of the check valve shown in FIG. 22.

Figure 24:
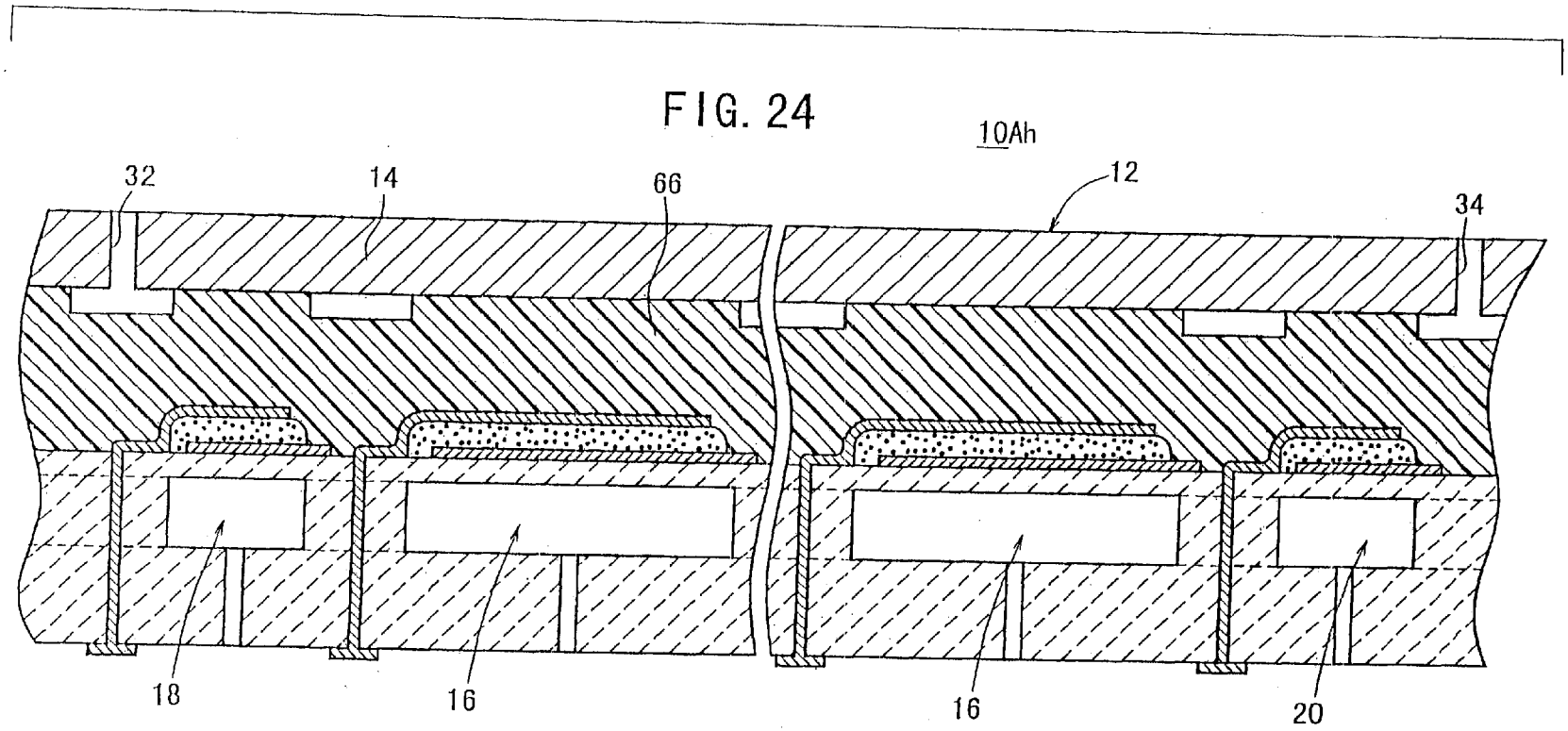
FIG. 24 shows a cross-sectional arrangement illustrating a pump according to an eighth embodiment concerning the first embodiment.

As shown in FIG. 24, a pump 10Ah according to an eighth modified embodiment is constructed in the same manner as the pump 10A according to the first embodiment. However, the former is different from the latter in that the pump section 16 is not single, but a plurality of pump sections 16 are provided and arranged between the input valve section 18 and the output valve section 20. In this embodiment, it is possible to greatly increase the discharge amount of the fluid discharged by effecting the main pump body 12 while maintaining the rigidity. It is also possible to efficiently feed the fluid.

Next, a pump 10B according to a second embodiment will be explained with reference to FIGS. 25 and 26.

Figure 25:
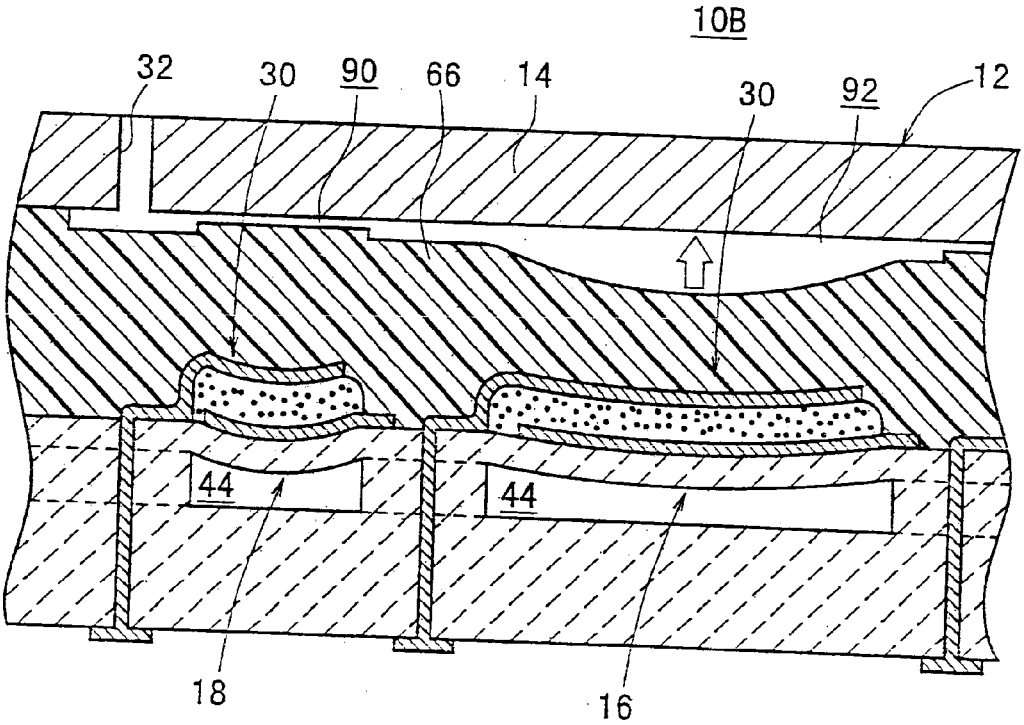
FIG. 25 shows a sectional view illustrating a pump according to a second embodiment.
Figure 26:
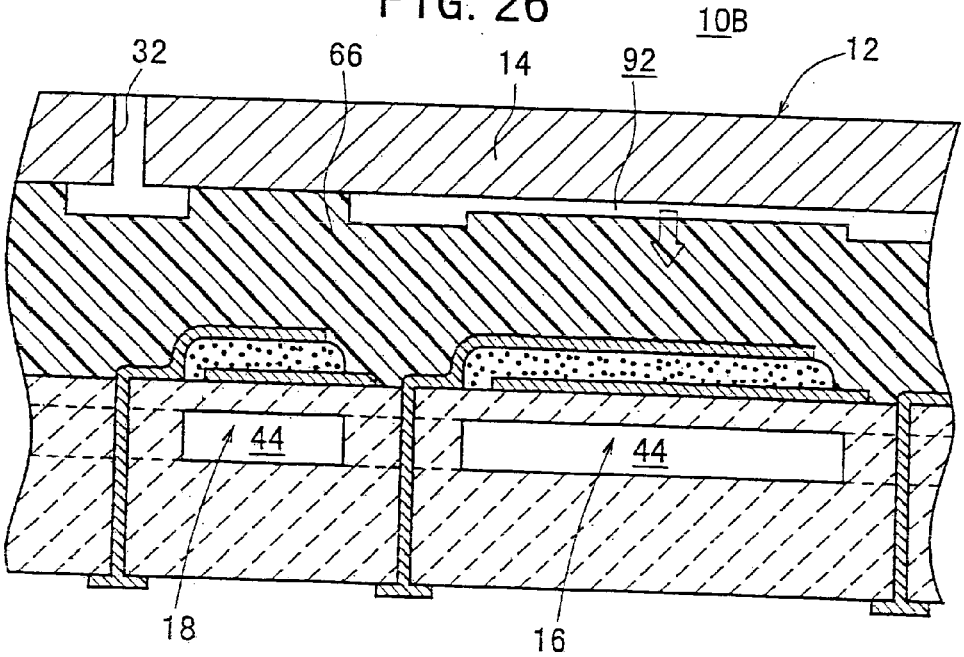
FIG. 26 shows a sectional view illustrating another exemplary pump according to the second embodiment.

As shown in FIGS. 25 and 26, the pump 10B according to the second embodiment is constructed in approximately the same manner as the pump 10A according to the first embodiment. However, the former is different from the latter in that the through-hole 46 (see FIG. 1 or 3), which penetrates through the substrate layer 40A to communicate with the hollow space 44, is sealed, and the gap 132 is formed between the end surface of the displacement-transmitting section 66 and the back surface of the casing 14 when the displacement of the actuator section 30 of the pump section 16 makes nearest approach to the back surface of the casing 14.

As shown in FIG. 25, it is assumed that pressure of the flow passage 92 of the pump section 16 is $P_1$, and the pressure of the hollow space 44 of the pump section 16 is $P_2$. When the flow passage 92 of the pump section 16 is contracted to apply the pressure, the hollow space 44 is sealed (the through-hole 46 shown in FIG. 1 is sealed) beforehand so that there is given $P_2 \geqq P_1$. Thus, it is possible to help the pressure-applying action of the pump section 16.

Further, as shown in FIG. 26, when the flow passage 92 of the pump section 16 is expanded to reduce the pressure, the hollow space 44 is sealed (the through-hole 46 shown in FIG. 1 is sealed) beforehand so that there is given $P_2 \leqq P_1$. Thus, it is possible to help the pressure-reducing action of the pump section 16.

As described above, in the pump 10B according to the second embodiment, the through-hole 46 of the hollow space 44 is sealed so that the pressure in the hollow space 44 is a predetermined pressure. Accordingly, it is possible to help the operation of, for example, the pump section 16, the input valve section 18, and the output valve section 20. Thus, it is possible to improve the response performance.

Next, two modified embodiments of the pump 10B according to the second embodiment will be explained with reference to FIGS. 27 to 29.

Figure 27:
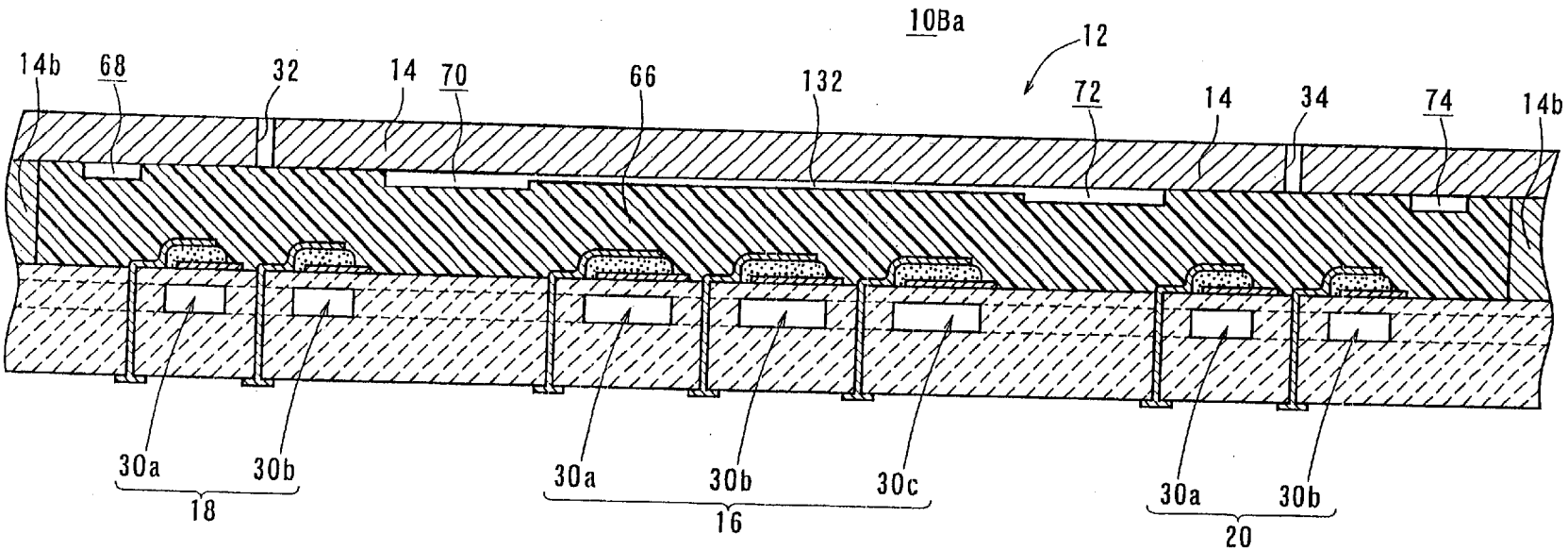
FIG. 27 shows a sectional view illustrating a pump according to a first modified embodiment concerning the second embodiment.
Figure 28:
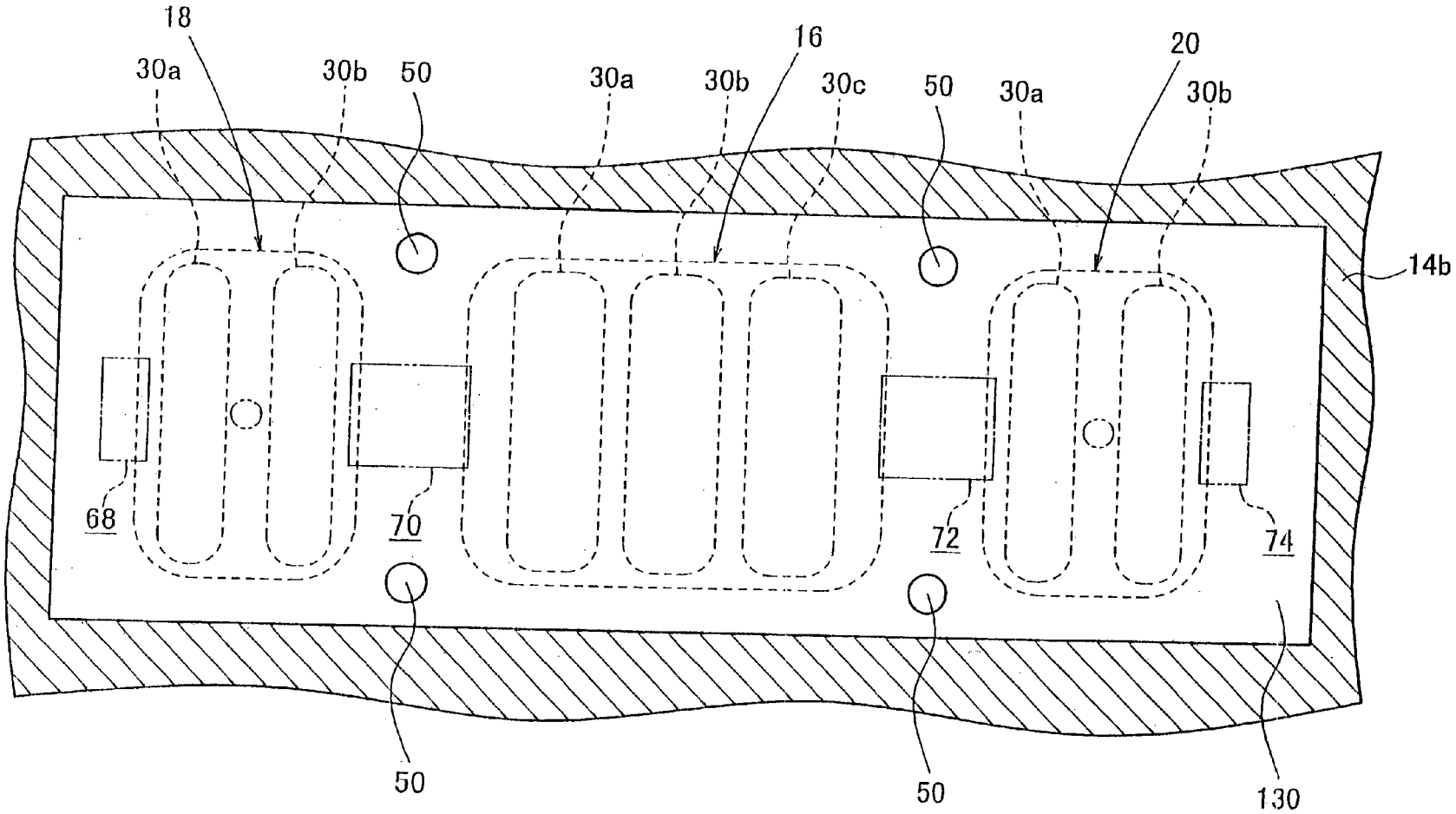
FIG. 28 shows a plan view illustrating a main pump body with a casing being removed, concerning the first modified embodiment of the pump according to the second embodiment.

At first, as shown in FIGS. 27 and 28, a pump 10Ba according to a first modified embodiment is constructed in approximately the same manner as the pump 10B according to the second embodiment. However, the former is different from the latter in the following points. That is, the introducing hole 32 is formed just over the input valve section 18, the discharge hole 34 is formed just over the output valve section 20, and the through-holes 46 (see FIG. 1) communicating with the respective hollow spaces 44 are sealed. Further, the pump section 16 includes a plurality of (three in the illustrated embodiment) actuator sections 30*a* to 30*c*, the input valve section 18 includes a plurality of (two in the illustrated embodiment) actuator sections 30*a*, 30*b*, and the output valve section 20 includes a plurality of (two in the illustrated embodiment) actuator sections 30*a*, 30*b*. As shown in FIG. 28, each of the actuator sections 30*a* to 30*c* may be constructed to have an oblong planar configuration.

Additionally, the gap 132 is formed between the end surface of the displacement-transmitting section 66 over the pump section 16 and the back surface of the casing 14 in a state in which the displacement of each of the actuator sections 30*a* to 30*c* of the pump section 16 makes nearest approach to the back surface of the casing 14.

Figure 29:
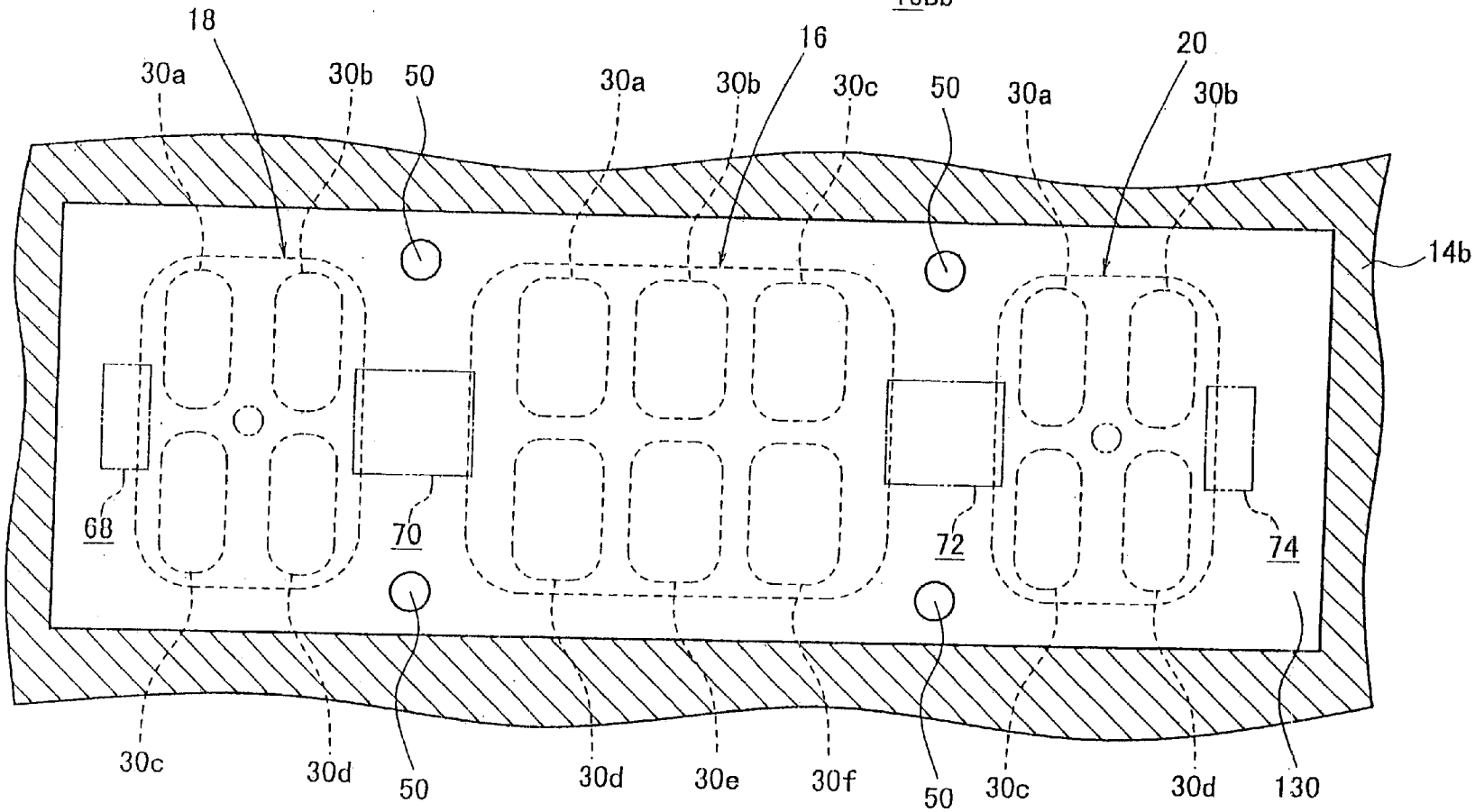
FIG. 29 shows a plan view illustrating a main pump body with a casing being removed, concerning a second modified embodiment of the pump according to the second embodiment.

Next, as shown in FIG. 29, a pump 10Bb according to a second modified embodiment is constructed in approximately the same manner as the pump 10Ba according to the first embodiment described above. However, the former is different from the latter in that the pump section 16 includes a plurality of (six in the illustrated embodiment) actuator sections 30*a* to 30*f*, the input valve section 18 includes a plurality of (four in the illustrated embodiment) actuator sections 30*a* to 30*d*, and the output valve section 20 includes a plurality of (four in the illustrated embodiment) actuator sections 30*a* to 30*d*.

As shown in FIG. 29, each of the actuator sections 30*a* to 30*f* is constructed to be a miniature actuator section having a shape which is short in the longitudinal direction as compared with the oblong actuator sections 30*a* to 30*c* of the pump 10Ba according to the first embodiment. In this arrangement, it is possible to avoid the disadvantage of enlargement of the entire size.

Each of the pumps 10Ba, 10Bb according to the first and second modified embodiments has the pump section 16, the input valve section 18, and the output valve section 20 each of which comprises the plurality of actuator sections. Therefore, it is possible to improve the rigidity of the pump section 16, the input valve section 18, and the output valve section 20.

Next, a pump 10C according to a third embodiment will be explained with reference to FIGS. 30 to 32.

Figure 30:
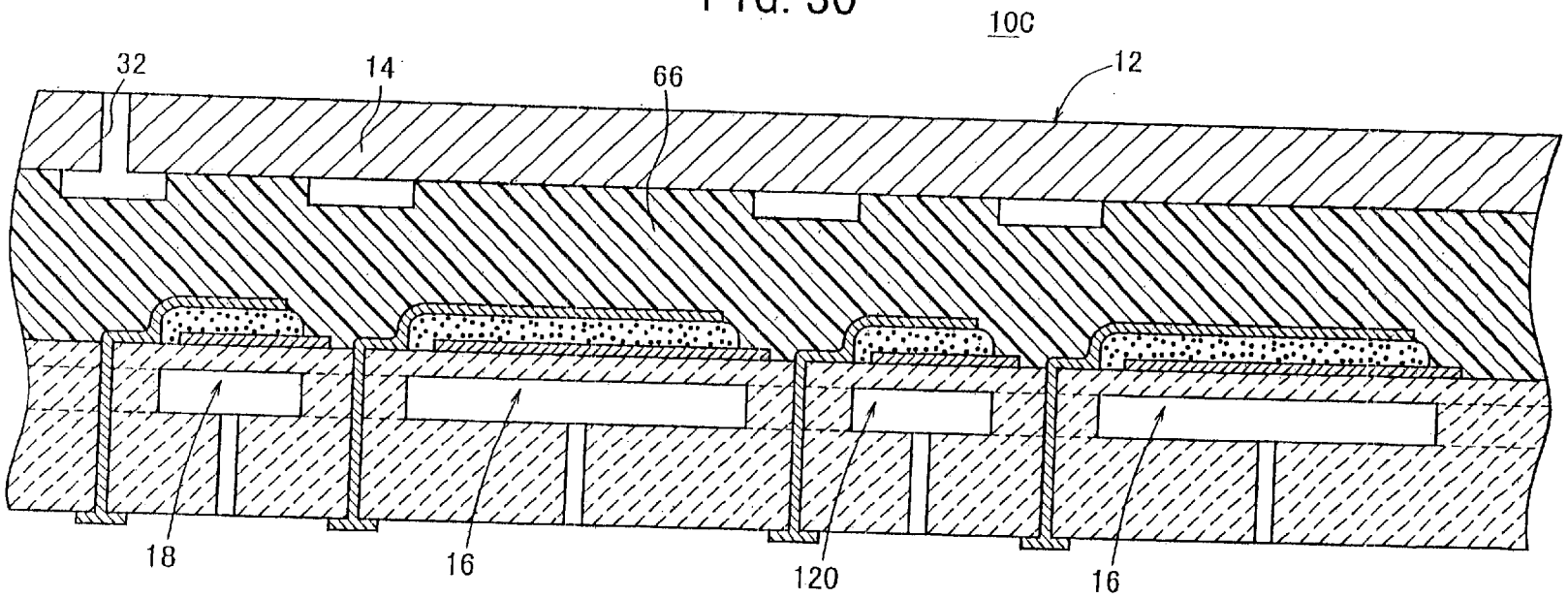
FIG. 30 shows a sectional view illustrating a pump according to a third embodiment.

As shown in FIG. 30, the pump 10C according to the third embodiment is constructed in the same manner as the pump 10Ah according to the eight modified embodiment (see FIG. 24). However, the former is different from the latter in that valve sections 120 are arranged between the pump sections 16 respectively.

Figure 31:
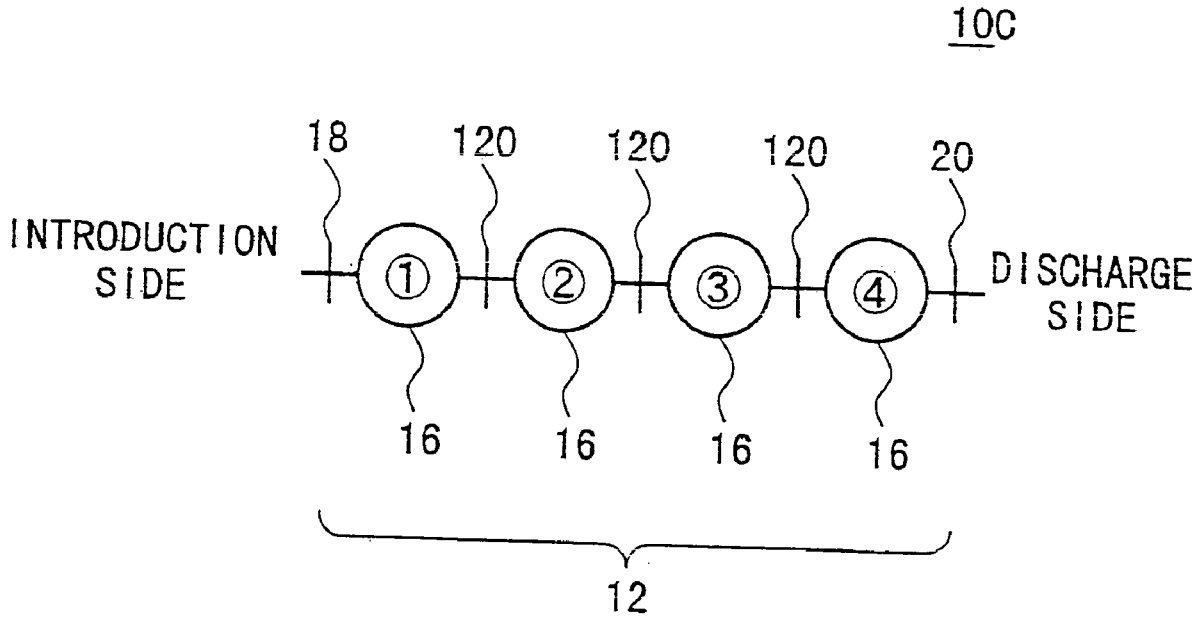
FIG. 31 shows a model illustrating the pump according to the third embodiment.

In order to simplify the illustration, as shown in FIG. 31, the configuration of the pump section 16 is simply represented by a circle (○), and each of the input valve section 18, the output valve section 20, and the valve section 120 is simply depicted by a vertical line (|).

As shown in FIG. 31, when the pump 10C is used, then the input side (the side of the input valve section 18) of the main pump body 12 is connected to the introduction side, and the output side (the side of the output valve section 20) of the main pump body 12 is connected to the discharge side. After that, the respective pump sections 16 are successively driven to allow the fluid to flow. During this process, if the introduction side is a closed space, the pressure of the closed space is reduced. Therefore, in this situation, the main pump body 12 functions as a pressure-reducing pump. On the other hand, if the discharge side is a closed space, the pressure of the closed space is increased. Therefore, in this situation, the main pump body 12 functions as a pressure-applying pump.

Figure 32:
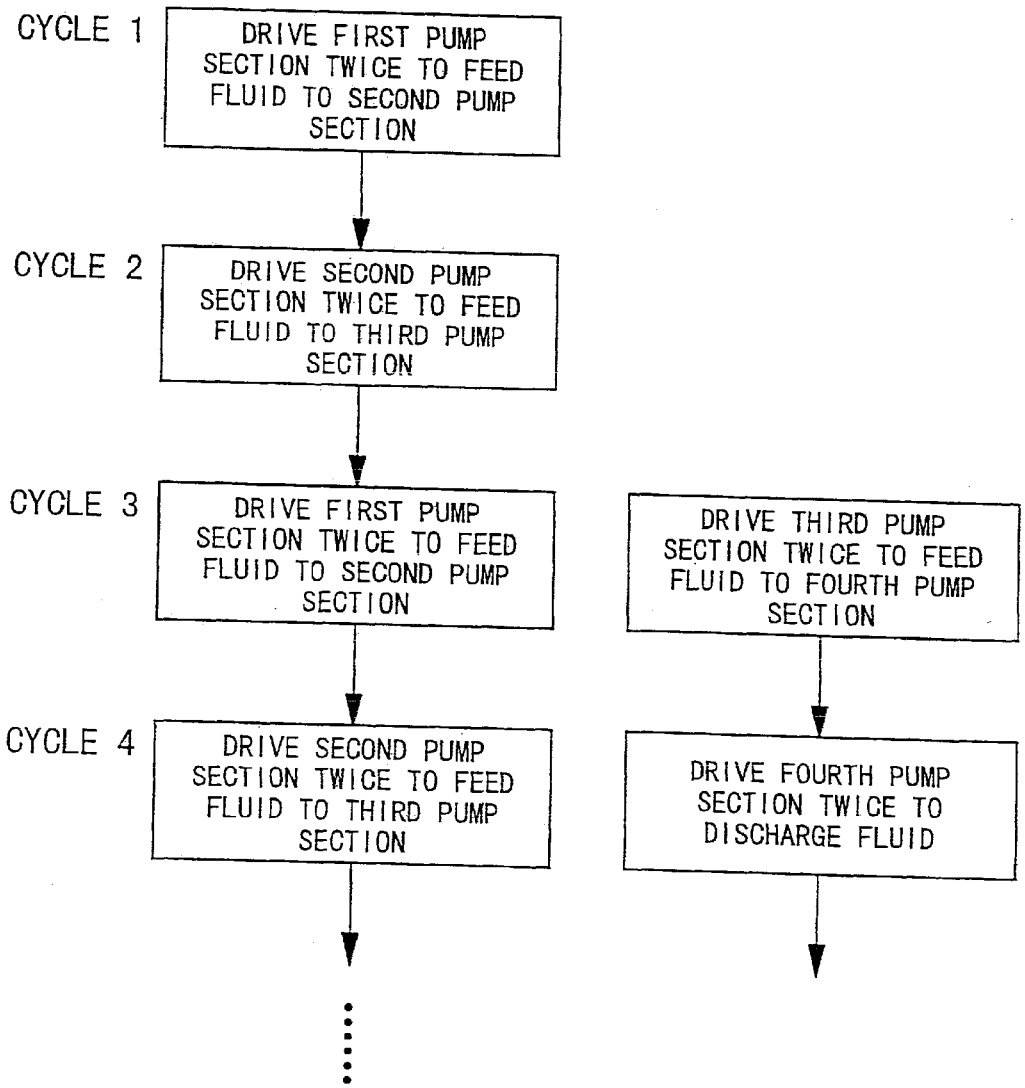
FIG. 32 shows a driving sequence for the pump according to the third embodiment.

A driving sequence for the pump sections 16 (designated as the first to fourth pump sections 16*a* to 16*d*) is shown, for example, in FIG. 32. In Cycle 1, the first pump section 16*a* is driven twice to feed the fluid to the second pump section 16*b*. In Cycle 2 in the next step, the second pump section 16*b* is driven twice to feed the fluid to the third pump section 16*c*.

In Cycle 3 in the next step, the first pump section 16*a* is driven twice to feed the fluid to the second pump section 16*b*. Simultaneously, the third pump section 16*c* is driven twice to feed the fluid to the fourth pump section 16*d*.

In Cycle 4 in the next step, the second pump section 16*b* is driven twice to feed the fluid to the third pump section 16*c*. Simultaneously, the fourth pump section 16*d* is driven twice to discharge the fluid via the output valve section 20.

Subsequently, Cycle 3 and Cycle 4 are successively repeated in the same manner as described above. Thus, the fluid is successively fed to the first to fourth pump sections, and it is discharged via the output valve section 20.

Next, several modified embodiments of the pump 10C according to the third embodiment will be explained with reference to FIGS. 33 to 41.

Figure 33:
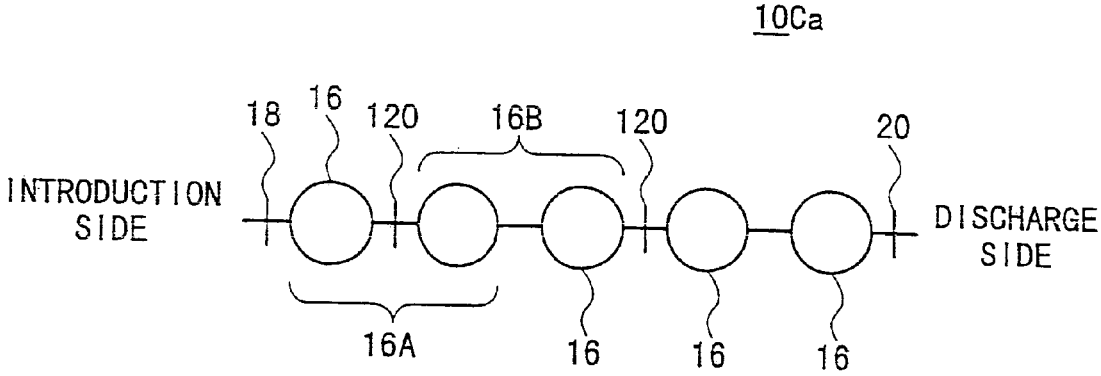
FIG. 33 shows a model illustrating a first modified embodiment of the pump according to the third embodiment.

As shown in FIG. 33, a pump 10Ca according to a first modified embodiment is constructed in the same manner as the pump 10C according to the third embodiment. However, the former is different from the latter in that a set 16A comprising the valve section 120 connected between the adjacent pump sections 16, and a set 16B comprising no valve section 120 connected between the adjacent pump sections 16 are arbitrarily combined and connected.

Figure 34:
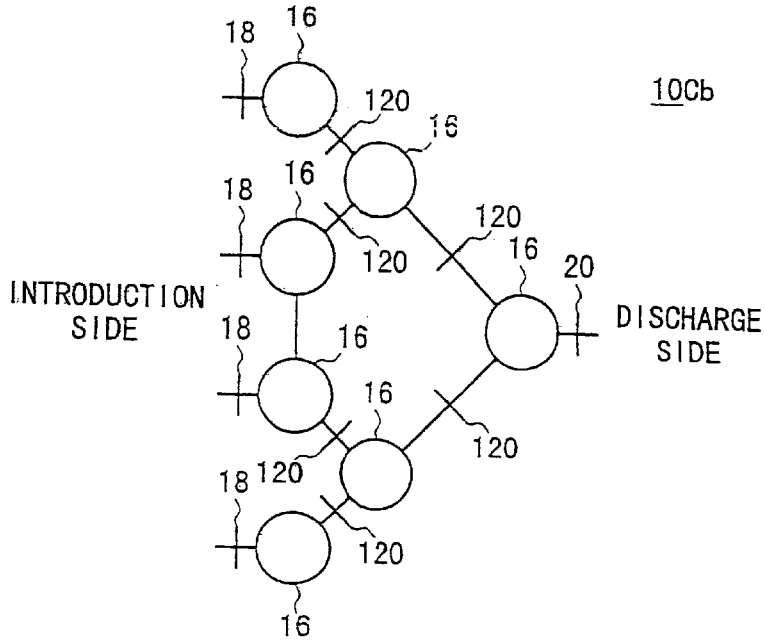
FIG. 34 shows a model illustrating a second modified embodiment of the pump according to the third embodiment.

As shown in FIG. 34, a pump 10Cb according to a second modified embodiment is constructed in the same manner as the pump 10C according to the third embodiment. However, the former is different from the latter in that a plurality of pump sections 16 are connected in parallel on the introduction side, and a plurality of pump sections 16 are connected in a branched form toward the discharge side.

In this embodiment, as in the pump 10Ca according to the first modified embodiment shown in FIG. 33, it is also preferable to adopt an arbitrary combination of a set 16A comprising the valve section 120 connected between the adjacent pump sections 16, and a set 16B comprising no valve section 120 connected between the adjacent pump sections 16.

Figure 35:
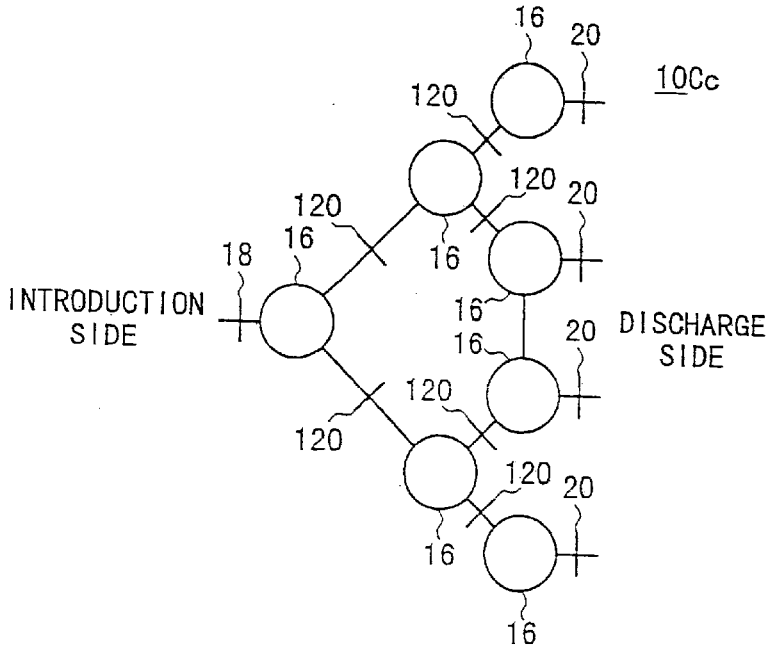
FIG. 35 shows a model illustrating a third modified embodiment of the pump according to the third embodiment.

As shown in FIG. 35, a pump 10Cc according to a third modified embodiment is different in that a plurality of pump sections 16 are connected in parallel on the discharge side, and a plurality of pump sections 16 are connected in a branched form toward the introduction side. In this embodiment, it is also preferable to adopt the arrangement of the pump 10Ca according to the first modified embodiment shown in FIG. 33.

Figure 36A:
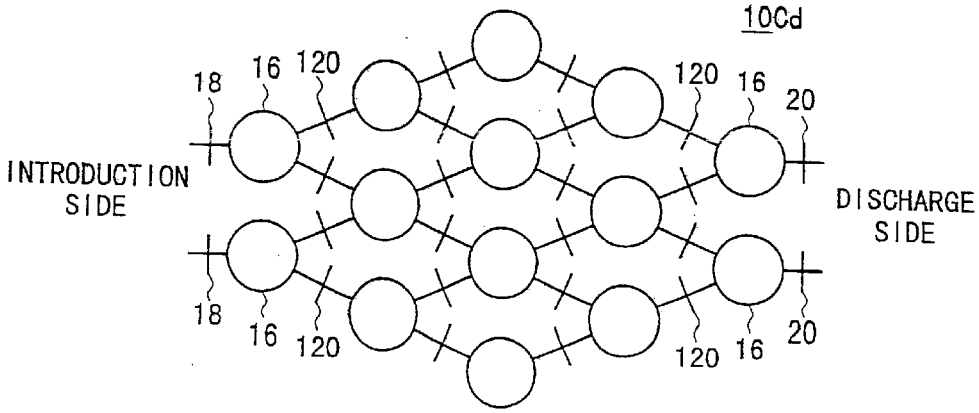
FIGS. 36A to 36C show models illustrating fourth modified embodiments of the pump according to the third embodiment.
Figure 36B:
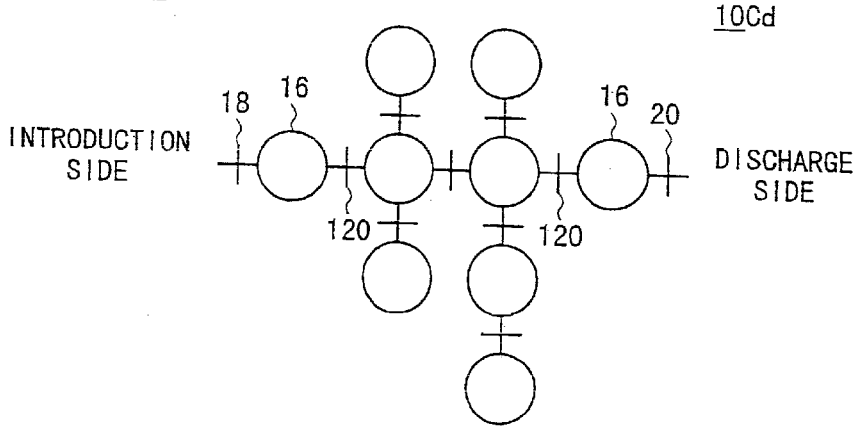
Figure 36C:
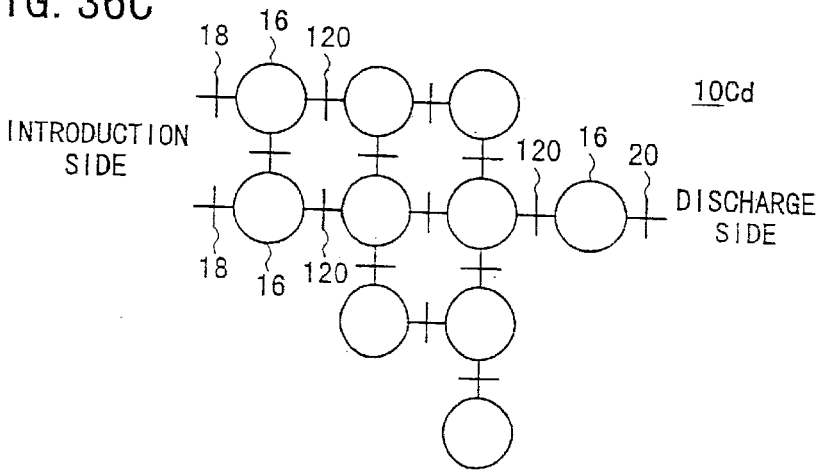

Further, as in a pump 10Cd according to a fourth modified embodiment shown in FIGS. 36A to 36C, it is also preferable to arbitrarily combine the series connection and the parallel connection of a plurality of pump sections 16 between the introduction side and the discharge side. In these cases, it is also preferable to adopt the arrangement of the pump 10Ca according to the first modified embodiment shown in FIG. 33.

Each of the pumps 10Ca to 10Cd according to the first to fourth modified embodiments is able to function as a pressure-reducing pump and a pressure-applying pump in the same manner as the pump 10C according to the third embodiment.

Figure 37:
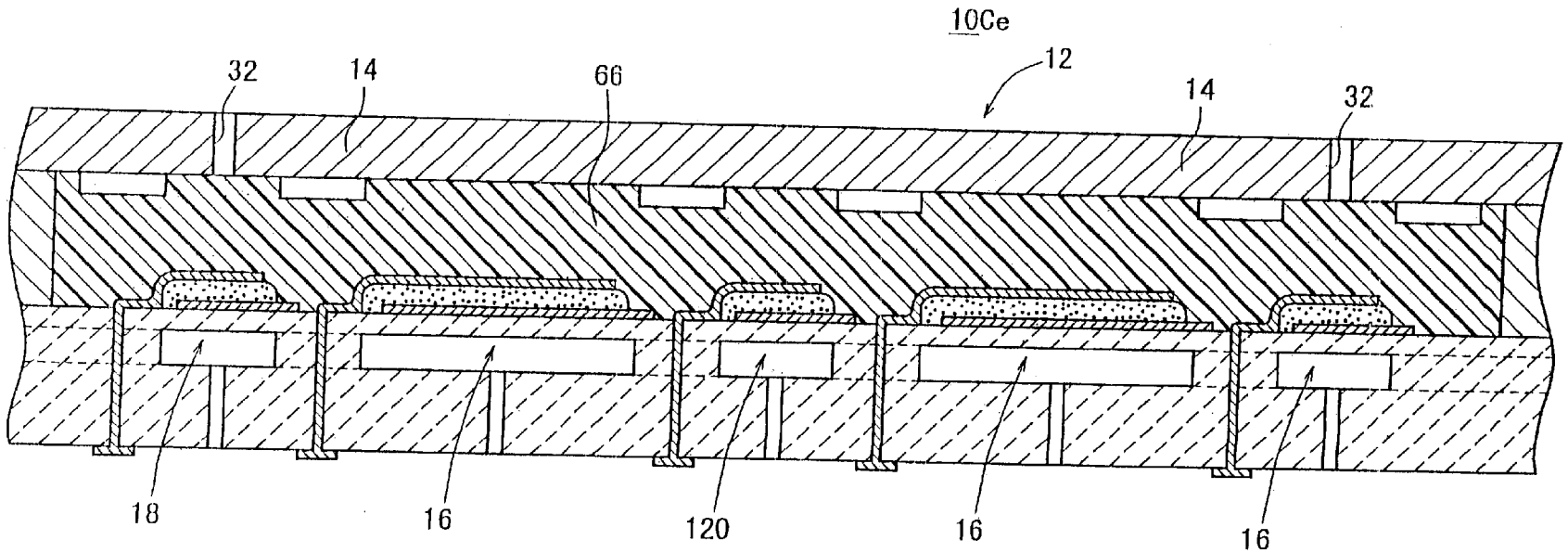
FIG. 37 shows a sectional view illustrating a fifth modified embodiment of the pump according to the third embodiment.
Figure 38:
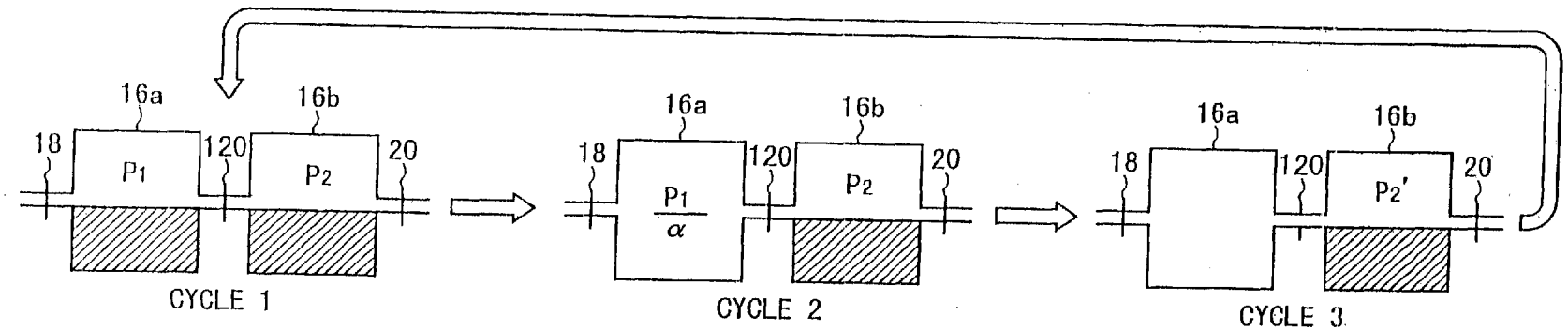
FIG. 38 shows a model illustrating the pressure-reducing operation effected by a fifth modified embodiment of the pump according to the third embodiment.
Figure 39:
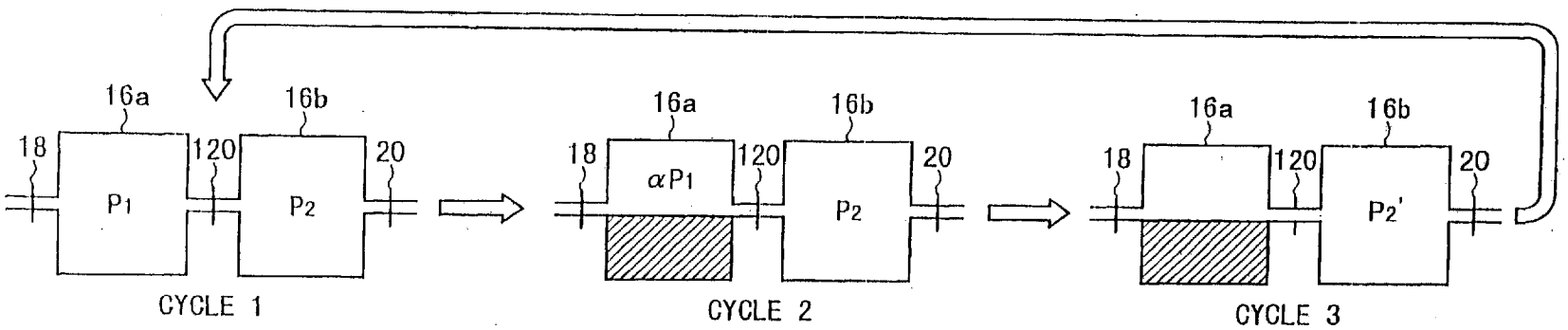
FIG. 39 shows a model illustrating the pressure-applying operation effected by the fifth modified embodiment of the pump according to the third embodiment.

As shown in FIG. 37, a fifth modified embodiment lies in an arrangement comprising the input valve section 18, the first pump section 16*a,* the valve section 120, the second pump section 16*b,* and the output valve section 20. In this arrangement, explanation will now be made with reference to FIGS. 38 and 39 for the pressure-reducing operation and the pressure-applying operation effected by a pump 10Ce according to the fifth modified embodiment. In order to simply and conveniently illustrate the pressure-reducing operation and the pressure-applying operation effected by the pump 10Ce according to the fifth modified embodiment, FIGS. 38 and 39 diagrammatically depict the input valve section 18, the first pump section 16*a,* the valve section 120, the second pump section 16*b,* and the output valve section 20. In the following description, the volumes of the flow passages of the input valve section 18, the valve section 120, and the output valve section 20 are neglected.

At first, the pressure-reducing operation will be explained referring to numerical expressions as well. Explanation will be firstly made for the pump 10Ce according to the fifth modified embodiment, concerning a case in which the first pump section 16*a* on the introduction side is operated in a plurality of times to reduce the pressure to the limit by the aid of the first and second pump sections 16*a,* 16*b*.

In the initial state (Cycle 1), the input valve section 18, the valve section 120, and the output valve section 20 are in the closed state, and the flow passages of the first and second pump sections 16*a,* 16*b* are in the state of contraction. In this situation, both of the pressures of the first and second pump sections 16*a,* 16*b* are at the initial value (for example, 1 atm). It is assumed that the volume of each of the flow passages of the first and second pump sections 16*a,* 16*b* during the contraction is $v_c$, and the volume of each of the flow passages during the expansion is $v_0$. In this embodiment, a relationship of $v_c=\alpha\cdot v_0$ holds, wherein $\alpha$ indicates the compressibility (>1).

In Cycle 2 in the next step, when only the flow passage of the first pump section 16*a* is expanded in the state in which all of the input valve section 18, the valve section 120, and the output valve section 20 are closed, the pressure of the flow passage of the first pump section 16*a* is $P_1/\alpha$.

In Cycle 3 in the next step, when the valve section 120 is in the open state, the flow passages of the first and second pump sections 16*a,* 16*b* communicate with each other. Accordingly, the second pump section 16*b* is subjected to pressure reduction. At this time, the pressure of the second pump section 16*b* is represented by the following expression (1).

$$P_2' = \frac{P_2 \times V_c + \frac{P_1}{\alpha} \times V_0}{V_c + V_0} = \frac{P_2 + P_1}{1+\alpha} \tag{1}$$

When the pressure is reduced to the limit by means of the plurality of times of operation of the first pump section 16*a,* the pressure of the second pump section 16*b* is represented by the following expression (2). It is noted that the second pump section 16*b* is not operated.

$$P_2^\infty = \frac{P_2^\infty + P_1}{(1+\alpha)} \therefore P_2^\infty = \frac{1}{\alpha} P_1 \tag{2}$$

When the multistage structure is provided, in which a large number of pump sections 16 are connected in series as in the pump 10C according to the third embodiment shown in FIG. 30, the pressure of the third pump section is represented by the following expression (3). Similarly, the pressure of the nth pump section is represented by the following expression (4).

$$P_3^\infty = \left(\frac{1}{\alpha}\right) P_2^\infty = \left(\frac{1}{\alpha}\right)\cdot\left(\frac{1}{\alpha}\right)\cdot P_1 \tag{3}$$

$$P_n^\infty = \left(\frac{1}{\alpha}\right)^{n-1} \cdot P_1 \tag{4}$$

At this point of time, as for the nth pump section itself, its flow passage has not been expanded. Therefore, in accordance with the expansion of the flow passage of the nth pump section, the pressure of the nth pump section is the pressure represented by the expression (5).

$$P_n^\infty = \left(\frac{1}{\alpha}\right)^{n-1} \cdot P_1 \times \left(\frac{1}{\alpha}\right) = \left(\frac{1}{\alpha}\right)^{n} \cdot P_1 \tag{5}$$

According to the expression (5), it is understood that the pressure can be reduced limitlessly in principle owing to the use of the multistage structure of the pump sections 16.

Next, explanation will be made for a case in which a large number of pump sections 16 are connected in series, and the respective pump sections 16 are allowed to perform the expanding action once to reduce the pressure.

The following expression (6) is derived from the expression (1) described above. It is noted that the second pump section itself is not operated.

$$P_2' = \frac{P_2 + P_1}{1+\alpha} = \frac{P_2}{1+\alpha} + \frac{P_1}{1+\alpha} = \frac{1}{1+\alpha} + \frac{1}{1+\alpha} \tag{6}$$

($P_1$ and $P_2$ have initial values of 1 atm.)

Similarly, concerning the third pump section and the second pump section, the pressure of the third pump section is represented by the following expression (7).

$$P_3' = \frac{P_3 + P_2'}{1+\alpha} = \frac{P_3 + \frac{P_2 + P_1}{1+\alpha}}{1+\alpha} = \frac{1}{1+\alpha} + \frac{1}{(1+\alpha)^2} + \frac{1}{(1+\alpha)^2} \tag{7}$$

($P_1$, $P_2$, and $P_3$ have initial values of 1 atm.)

Similarly, concerning the nth pump section and the (n-1)th pump section, the pressure of the nth pump section is represented by the following expression (8).

$$P_n' = \sum_{k=1}^{n-1} \frac{1}{(1+\alpha)^k} + \frac{1}{(1+\alpha)^{n-1}} = \frac{1}{\alpha} + \left(1 - \frac{1}{\alpha}\right)\cdot\left(\frac{1}{1+\alpha}\right)^{n-1} \tag{8}$$

Further, in view of the expansion of the nth pump section itself, the pressure of the nth pump section is represented by the following expression (9).

$$P''_n = \frac{P'_n}{\alpha} = \frac{1}{\alpha^2} + \frac{\alpha - 1}{\alpha^2} \cdot \left(\frac{1}{1+\alpha}\right)^{n-1} \tag{9}$$

According to the expression (9), it is understood that when the pump sections 16 are provided in the multiple stages, the reduced pressure is converged on the limit value of $1/\alpha^2$.

Next, the pressure-applying operation will be explained with reference to numerical expressions as well. At first, explanation will be made for the pump 10Ce according to the fifth modified embodiment, concerning a case in which the first pump section 16*a* on the introduction side is operated in a plurality of times to apply the pressure to the limit by the aid of the first and second pump sections 16*a,* 16*b*.

In the initial state (Cycle 1), the input valve section 18, the valve section 120, and the output valve section 20 are in the closed state, and the flow passages of the first and second pump sections 16*a,* 16*b* are in the state of expansion.

In Cycle 2 in the next step, when only the flow passage of the first pump section 16*a* is contracted in the state in which all of the input valve section 18, the valve section 120, and the output valve section 20 are closed, the pressure of the flow passage of the first pump section 16*a* is $\alpha P_1$.

In Cycle 3 in the next step, when the valve section 120 is in the open state, the flow passages of the first and second pump sections 16*a,* 16*b* communicate with each other. Accordingly, the second pump section 16*b* is subjected to pressure application. At this time, the pressure of the second pump section 16*b* is represented by the following expression (10).

$$P'_2 = \frac{P_2 v_0 + \alpha P_1 v_c}{v_0 + v_c} = \frac{\alpha(P_2 + P_1)}{1+\alpha} \tag{10}$$

When the pressure is applied to the limit by means of the plurality of times of operation of the first pump section 16*a,* the pressure of the second pump section 16*b* is represented by the following expression (11). It is noted that the second pump section 16*b* is not operated.

$$P_2^\infty = \frac{\alpha(P_2^\infty + P_1)}{(1+\alpha)} \therefore P_2^\infty = \alpha P_1 \tag{11}$$

When the multistage structure is provided, in which a large number of pump sections 16 are connected in series as in the pump 10C according to the third embodiment shown in FIG. 30, the pressure of the third pump section is represented by the following expression (12). Similarly, the pressure of the nth pump section is represented by the following expression (13).

$$P_3^\infty = \alpha P_2^\infty = \alpha^2 \cdot P_1 \tag{12}$$

$$P_n^\infty = \alpha^{n-1} \cdot P_1 \tag{13}$$

At this point of time, as for the nth pump section itself, its flow passage has not been expanded. Therefore, in accordance with the expansion of the flow passage of the nth pump section, the pressure of the nth pump section is the pressure represented by the expression (14).

$$P_n^\infty = \alpha^{n-1} \cdot P_1 \times \alpha = \alpha^n \cdot P_1 \tag{14}$$

According to the expression (14), it is understood that the pressure can be increased limitlessly in principle owing to the use of the multistage structure of the pump sections 16.

Next, explanation will be made for a case in which a large number of pump sections 16 are connected in series, and the respective pump sections 16 are allowed to perform the expanding action once to apply the pressure.

The following expression (15) is derived from the expression (10) described above. It is noted that the second pump section itself is not operated.

$$P'_2 \frac{\alpha(P_2 + P_1)}{1+\alpha} = \frac{\alpha}{1+\alpha} + \frac{\alpha}{1+\alpha} \tag{15}$$

($P_1$ and $P_2$ have initial values of 1 atm.)

Similarly, concerning the third pump section and the second pump section, the pressure of the third pump section is represented by the following expression (16).

$$P'_3 = \frac{\alpha(P_3 + P'_2)}{1+\alpha} = \frac{\alpha\left(P_3 + \frac{\alpha(P_2 + P_1)}{1+\alpha}\right)}{1+\alpha} = \frac{\alpha}{1+\alpha} + \frac{\alpha^2}{(1+\alpha)^2} + \frac{\alpha^2}{(1+\alpha)^2} \tag{16}$$

($P_1$, $P_2$, and $P_3$ have initial values of 1 atm.)

Similarly, concerning the nth pump section and the (n-1)th pump section, the pressure of the nth pump section is represented by the following expression (17).

$$P'_n = \sum_{k=1}^{n-1} \frac{\alpha^k}{(1+\alpha)^k} + \frac{\alpha^{n-1}}{(1+\alpha)^{n-1}} = \alpha + (1-\alpha) \cdot \frac{\alpha^{n-1}}{(1+\alpha)^{n-1}} \tag{17}$$

Further, in view of the expansion of the nth pump section itself, the pressure of the nth pump section is represented by the following expression (18).

$$P''_n = \alpha \cdot P'_n = \alpha^2 + (\alpha - \alpha^2) \cdot \frac{\alpha^{n-1}}{(1+\alpha)^{n-1}} \tag{18}$$

According to the expression (18), it is understood that when the pump sections 16 are provided in the multiple stages, the applied pressure is converged on the limit value of $\alpha^2$.

Next, as shown in 40A, a pump 10Cf according to a sixth embodiment is constructed in the same manner as the pump 10Ce according to the fifth embodiment (see FIG. 37). However, the former is different from the latter in that the gap 132 is formed between the end surface of the displacement-transmitting section 66 and the back surface of the casing 14 at the portions corresponding to the first and second pump sections 16*a,* 16*b* and the valve section 120 when the displacement of each of the actuator sections 30 of the first and second pump sections 16*a,* 16*b* and the valve section 120 makes nearest approach to the back surface of the casing 14.

The pump 10Cf according to the sixth modified embodiment is preferably used irrelevant to whether the fluid is gas or liquid, because of the following reason.

That is, the pump 10Cf according to the sixth modified embodiment has the displacement-transmitting section 66 which does not make contact with the casing 14. Therefore, the first and second pump sections 16*a,* 16*b* can be operated at a high speed.

Further, for example, if there is no gap 132 between the casing 14 and the displacement-transmitting section 66 for the second pump section 16*b* in the contracted state, the flow passage 140 is not subjected to the pressure reduction even if the first pump section 16*a* is operated to make expansion. In such an arrangement, the pressure reduction can be effected up to a region before the second pump section 16*b* (see Interval A in FIG. 40B). Therefore, such an arrangement is disadvantageous when the pressure reduction is subsequently effected by the expansion of the second pump section 16*b*.

Figure 40A:
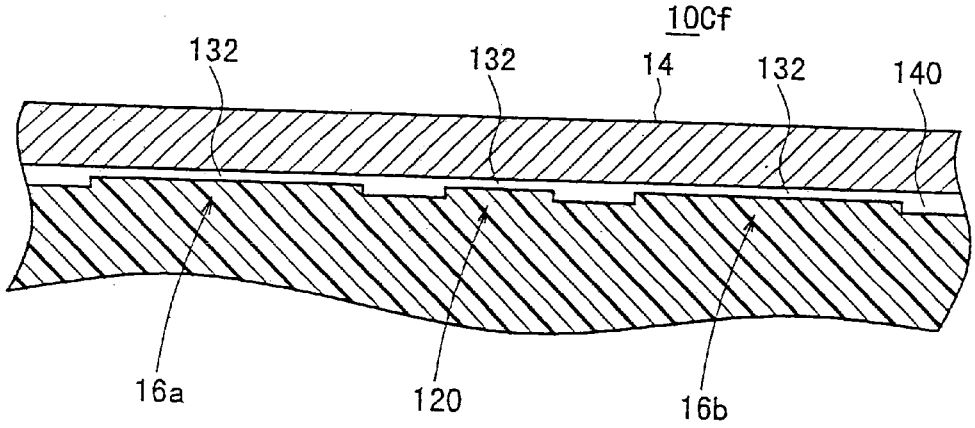
FIG. 40A shows a sectional view illustrating a sixth modified embodiment of the pump according to the third embodiment.
Figure 40B:
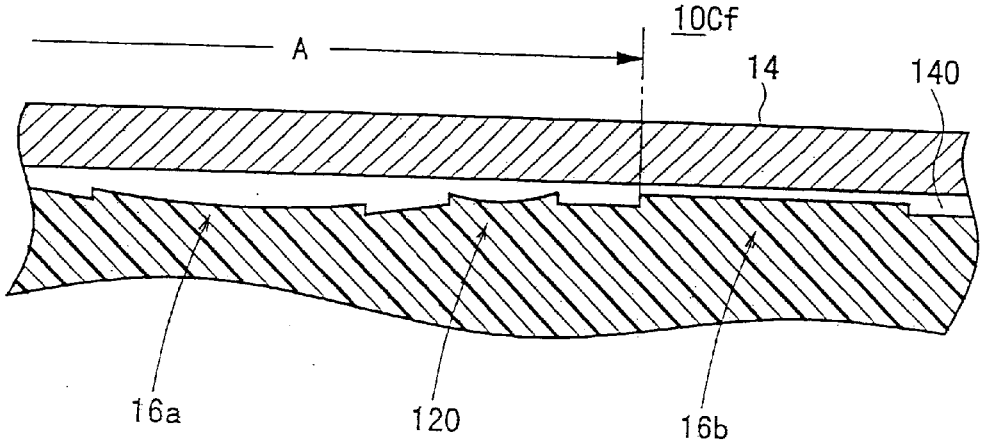
FIG. 40B shows a sectional view illustrating a situation in which a first pump section is operated in the sixth modified embodiment of the pump according to the third embodiment.

Accordingly, when the gap 132 is formed between the casing 14 and the displacement-transmitting section 66 for the second pump section 16*b* in the contracted state as in the pump 10Cf according to the sixth modified embodiment, the pressure reduction can be effected up to flow passage 140 in accordance with the expanding operation of the first pump section 16*a* as shown in FIG. 40B. As described above, the flow passage 140 can be subjected to the pressure reduction before the expansion of the second pump section 16*b*. Therefore, the pump 10Cf according to the sixth embodiment is advantageous during the contraction process effected by the expansion of the second pump section 16*b*. This feature is also advantageous when the pressure is applied.

Figure 41:
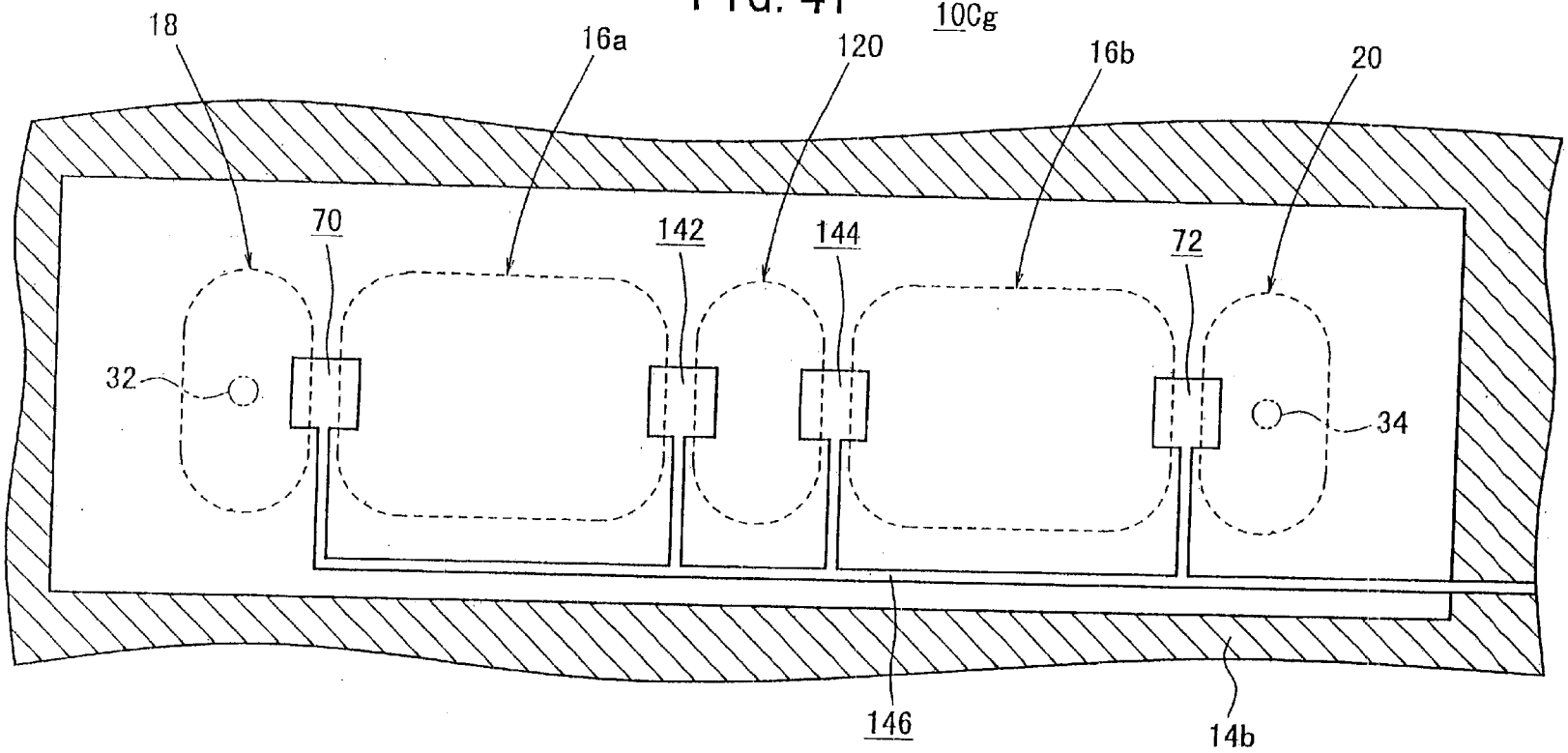
FIG. 41 shows a plan view illustrating a main pump body with a casing being removed, concerning a seventh modified embodiment of the pump according to the third embodiment.

Next, as shown in FIG. 41, a pump 10Cg according to a seventh modified embodiment is constructed in the same manner as the pump 10C according to the third embodiment. However, the former is different from the latter in that a communication passage 146 is formed to make a bypass among the flow passage (recess) 70 formed between the input valve section 18 and the first pump section 16*a* which are adjacent to one another, the flow passage (recess) 142 formed between the first pump section 16*a* and the valve section 120 which are adjacent to one another, the flow passage (recess) 144 formed between the valve section 120 and the second pump section 16*b* which are adjacent to one another, and the flow passage (recess) 72 formed between the second pump section 16*b* and the output valve section 20 which are adjacent to one another.

In this embodiment, the gap 132 is not formed between the displacement-transmitting section 66 and the casing 14 upon the contraction of the first and second pump sections 16*a,* 16*b*.

The formation of the communication passage 146 makes it possible to previously reduce or apply the pressure for the portion of the flow passage on the discharge side by the aid of the communication passage 146, in the same manner as in the pump 10Cf according to the sixth modified embodiment. Accordingly, all of the flow passages, which are disposed in the region ranging from the introduction side to the discharge side, can be collectively subjected to the pressure application or the pressure reduction in an identical manner. Therefore, this embodiment is advantageous to effect the pressure reduction and the pressure application.

By the way, for example, the pump 10A according to the first embodiment has been constructed such that the recesses 70, 72 for constructing the flow passages are provided at the respective portions of the end surface of the displacement-transmitting section 66 between each of the input valve section 18, the pump section 16, and the output valve section 20. Alternatively, the following arrangement is also preferable as in a pump 10D according to a fourth embodiment shown in FIG. 42A. That is, the-end surface of the displacement-transmitting section 66 is made to be flat (flushed surface), and spacers 150 are formed on the back surface of the casing 14. Thus, the flow passages corresponding to the recesses 70, 72 are successfully formed.

Figure 42A:
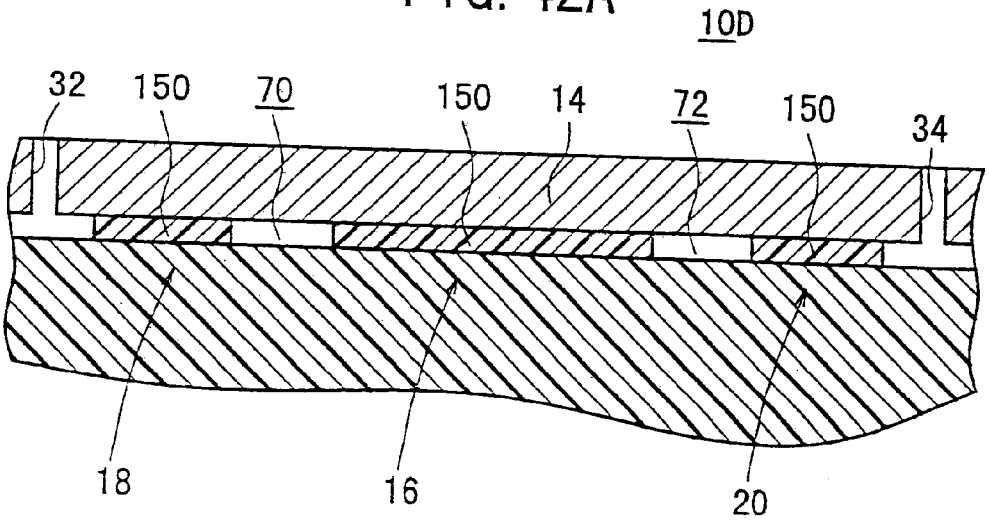
FIG. 42A shows a sectional view illustrating a pump according to a fourth embodiment.
Figure 42B:
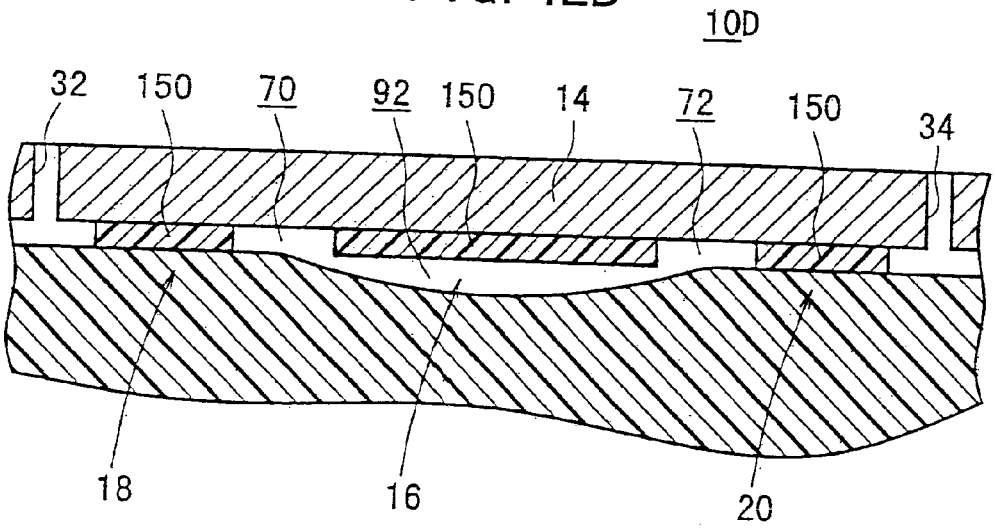
FIG. 42B shows a sectional view illustrating a situation in which a pump section is operated in the pump according to the fourth embodiment.

In this embodiment, as shown in FIG. 42B, for example, when the actuator section 30 of the pump section 16 is operated to expand the pump section 16, then the displacement-transmitting section 66 corresponding to the pump section 16 is separated from the spacer 150, and the flow passage 92 is formed just under the spacer 150 of the pump section 16.

Figure 43:
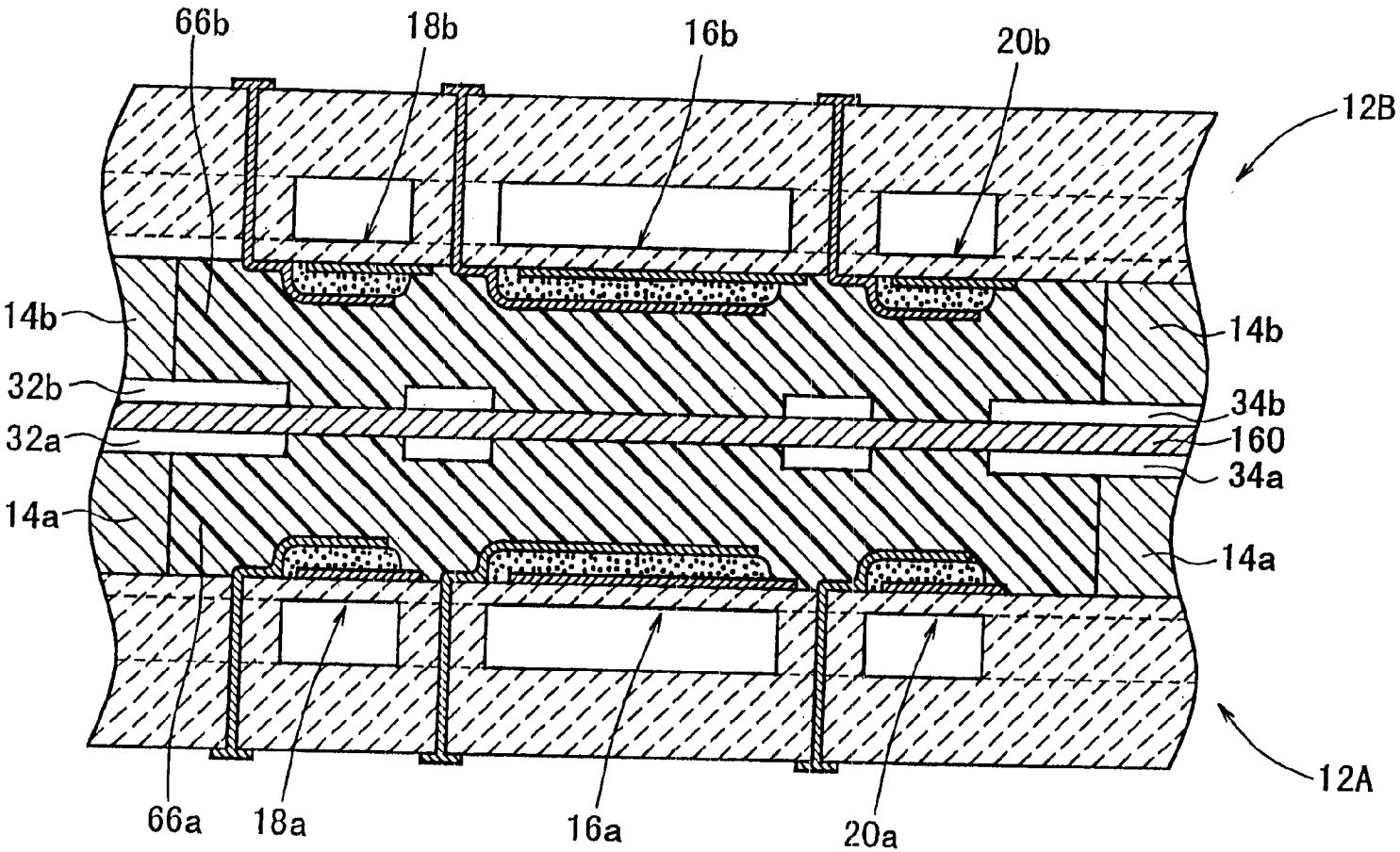
FIG. 43 shows a sectional view illustrating a pump according to a fifth embodiment.

Next, a pump 10E according to a fifth embodiment will be explained with reference to FIG. 43.

The pump 10E according to the fifth embodiment is constructed such that two main pump bodies (first and second main pump bodies 12A, 12B), each of which is constructed in the same manner as the main pump body 12 of the pump 10A according to the first embodiment, are stuck to one another with an intermediate support plate 160 being interposed therebetween, wherein their displacement-transmitting sections 66*a,* 66*b* are disposed opposingly to the intermediate support plate 160 respectively. The intermediate support plate 160 is fixed and interposed by the fixed sections 14*a,* 14*b* each of which is disposed at the outer circumference of the casing 14.

Specifically, the first main pump body 12A includes the first input valve section 18*a,* the first pump section 16*a,* the first output valve section 20*a,* and the first displacement-transmitting section 66*a*. The second main pump body 12B includes the second input valve section 18*b,* the second pump section 16*b,* the second output valve section 20*b,* and the second displacement-transmitting section 66*b*.

The first and second input valve sections 18*a,* 18*b* are opposed to one another, the first and second pump sections 16*a,* 16*b* are opposed to one another, and the first and second output valve sections 20*a,* 20*b* are opposed to one another, while interposing the intermediate support plate 160 therebetween respectively. Further, the first and second displacement-transmitting sections 66*a,* 66*b* are arranged such that they abut against the intermediate support plate 160 respectively.

The first and second introducing holes 32*a,* 32*b* are formed on the respective introduction sides of the first and second input valve sections 18*a,* 18*b,* through the outer circumferential fixed sections 14*a,* 14*b* of the casings 14 respectively. The first and second discharge holes 34*a,* 34*b* are formed on the respective discharge sides of the first and second output valve sections 20*a,* 20*b* respectively.

In this embodiment, it is preferable that the first and second main pump bodies 12A, 12B are supported with certain rigidity by using the intermediate support plate 160 and/or unillustrated support pillars for supporting the intermediate support plate 160. Alternatively, it is also preferable that the first and second main pump bodies 12A, 12B are supported with certain rigidity by using the intermediate support plate 160 and/or the outer circumferential fixed sections 14*a,* 14*b* for supporting the intermediate support plate 160.

In the pump 10E according to the fifth embodiment, the fluid is successively fed by selectively forming the flow passage for the fluid on the plate surface of the intermediate support plate 160 in accordance with the selective displacement action of the first and second input valve sections 18*a,* 18*b,* the first and second pump sections 16*a,* 16*b,* and the first and second output valve sections 20*a,* 20*b* in the direction to make approach or separation with respect to the plate surface of the intermediate support plate 160.

The pump 10E according to the fifth embodiment also makes it possible to facilitate the realization of the miniature and thin size of the first and second main pump bodies 12A, 12B, in the same manner as in the pump 10A according to the first embodiment. It is possible to make application to a variety of techniques including, for example, those concerning the medical and chemical analysis fields.

Figure 44:
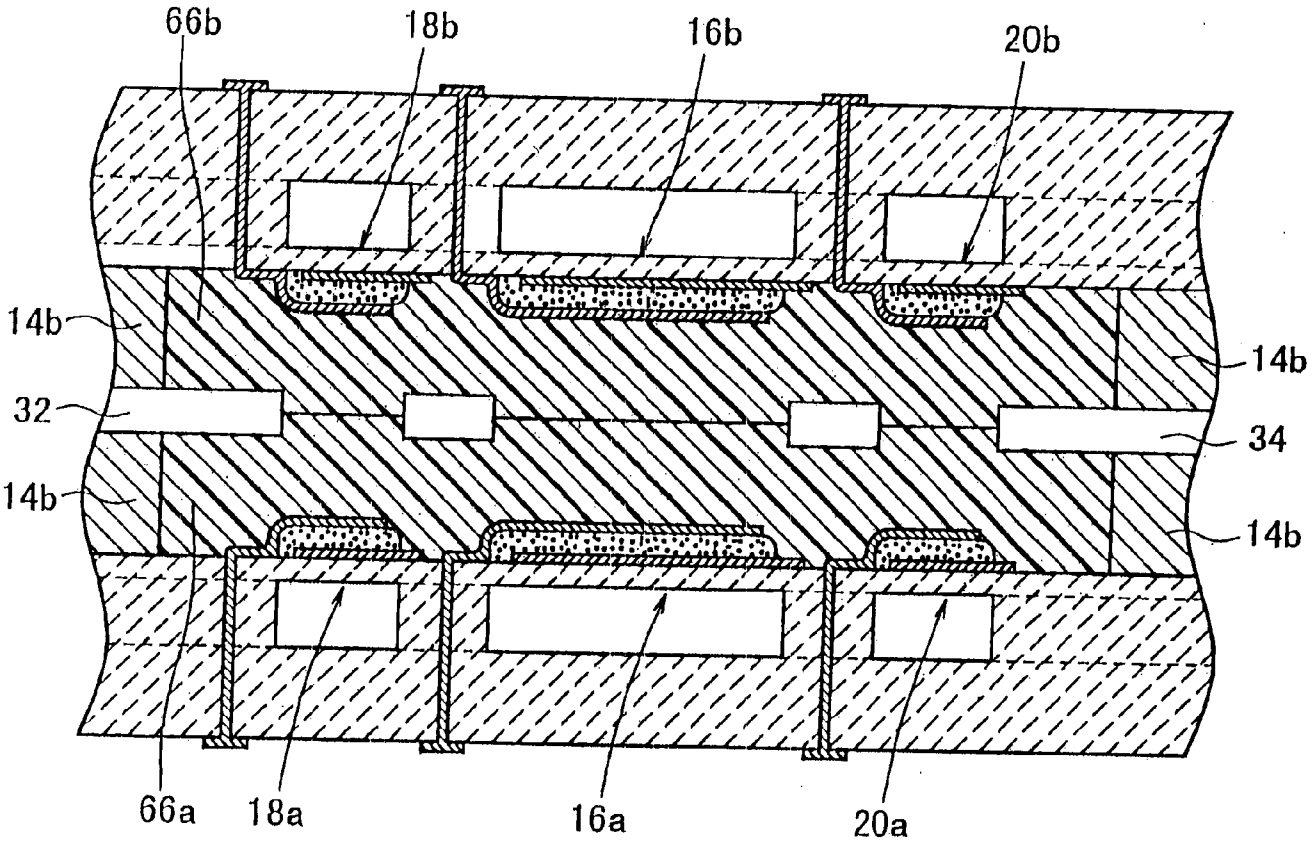
FIG. 44 shows a sectional view illustrating a modified embodiment of the pump according to the fifth embodiment.

A modified embodiment 10Ea of the pump 10E according to the fifth embodiment may be constructed, for example, as shown in FIG. 44. That is, the intermediate support plate 160 is removed. The first and second input valve sections 18*a,* 18*b* are opposed to one another, the first and second pump sections 16*a,* 16*b* are opposed to one another, and the first and second output valve sections 20*a,* 20*b* are opposed to one another. Further, the respective end surfaces of the first and second displacement-transmitting sections 66*a,* 66*b* make mutual abutment.

In this embodiment, the first and second main pump bodies 12A, 12B may be supported with certain rigidity by using the unillustrated casing 14 and/or the unillustrated support pillars for supporting the casing 14. Alternatively, the first and second main pump bodies 12A, 12B may be supported with certain rigidity by using the casing 14 and/or the outer circumferential fixed sections 14*a,* 14*b* for supporting the casing 14.

Figure 45:
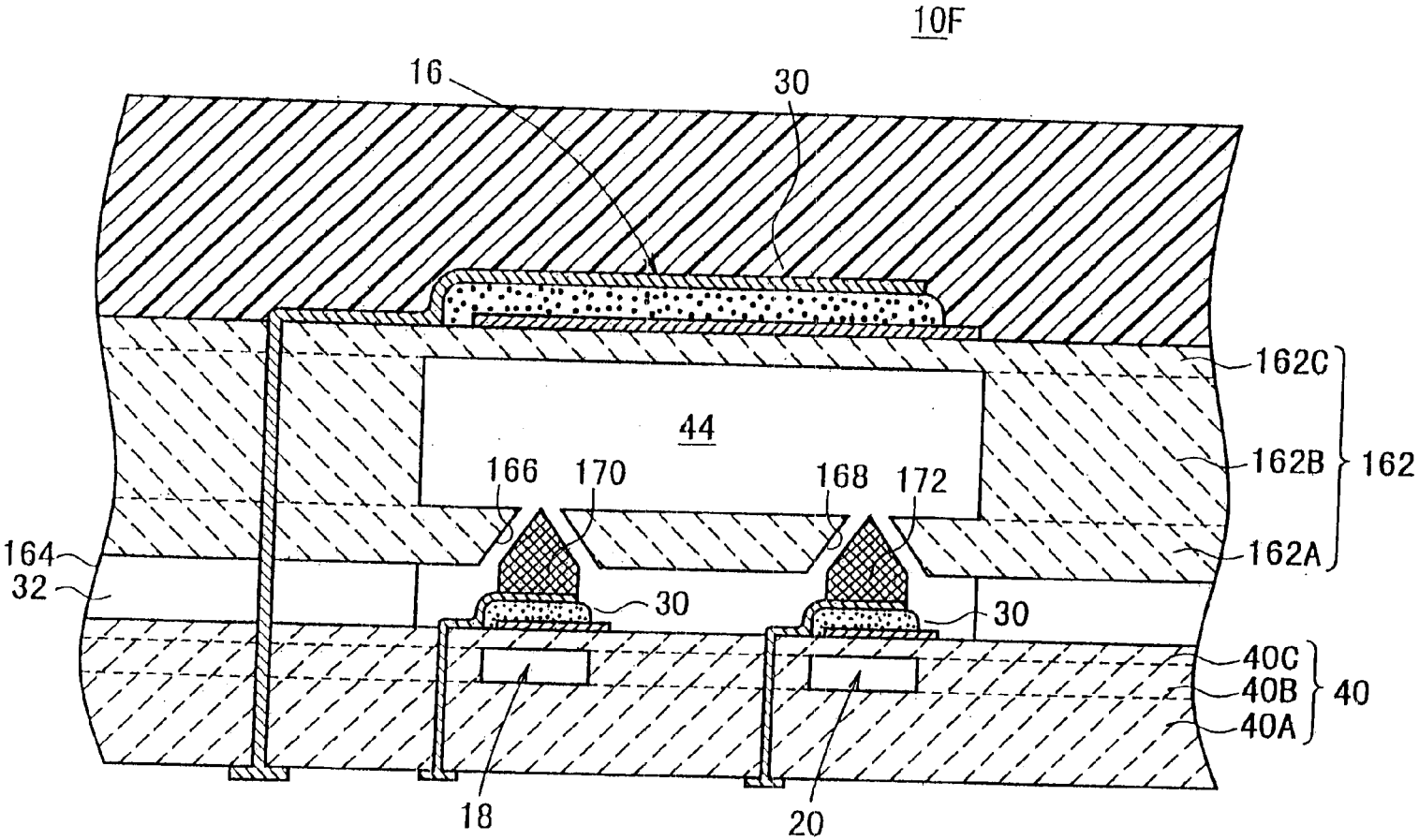
FIG. 45 shows a sectional view illustrating a pump according to a sixth embodiment.

Next, a pump 10F according to a sixth embodiment is constructed as shown in FIG. 45. That is, two substrates 40, 162 are stacked with a spacer substrate 164 being interposed therebetween. The lower substrate 40 is installed with the input valve section 18 and the output valve section 20, and the upper substrate 162 is installed with the pump section 16.

The spacer substrate 164 includes the introducing hole 32 which is formed on the introduction side of the input valve section 18, and the discharge hole 34 which is formed on the discharge side of the output valve section 20. A substrate 162A of the upper substrate 162 includes a first through-hole 166 which is formed at a portion corresponding to the hollow space 44 of the pump section 16 and corresponding to the input valve section 18, and a second through-hole 168 which is formed at a portion corresponding to the hollow space 44 of the pump section 16 and corresponding to the output valve section 20.

The displacement action in the vertical direction of the actuator section 30, of the input valve section 18 allows a conical-shaped displacement-transmitting section 170 formed on the input valve section 18 to close and open the first through-hole 166. The displacement action in the vertical direction of the actuator section 30 of the output valve section 20 allows a conical-shaped displacement-transmitting section 172 formed on the output valve section 20 to close and open the second through-hole 168.

As a result, the fluid, which is introduced via the introducing hole 32, is introduced into the hollow space 44 of the pump section 16 by the aid of the input valve section 18. The volume of the hollow space 44 is changed in accordance with the displacement action in the vertical direction of the actuator section 30 of the pump section 16, and thus the fluid in the hollow space 44 is discharged via the output valve section 20 and the discharge hole 34.

The pump 10F according to the sixth embodiment also makes it possible to facilitate the realization of the miniature and thin size of the pump 10F, in the same manner as the pump 10A according to the first embodiment. It is possible to make application to a variety of techniques including, for example, those concerning the medical and chemical analysis fields.

Figure 46:
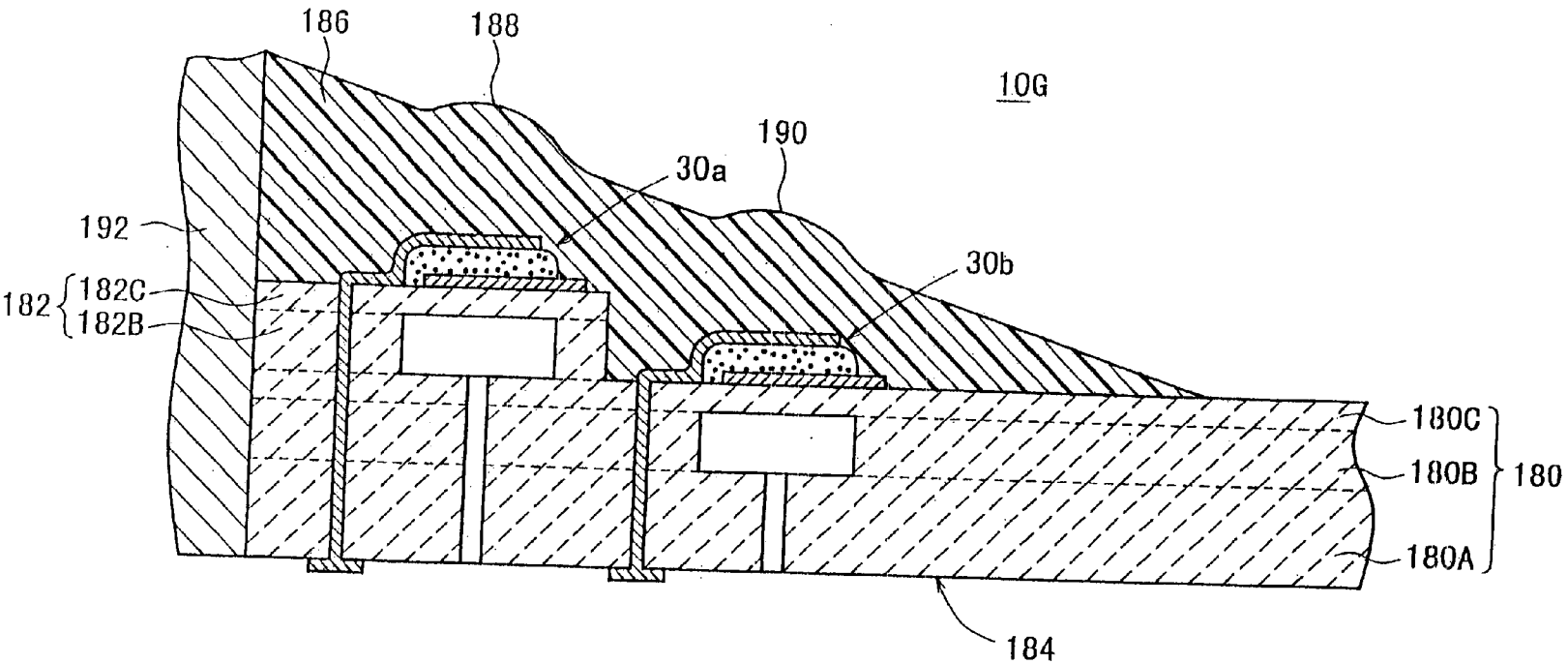
FIG. 46 shows a sectional view illustrating a pump according to a seventh embodiment.

The foregoing embodiments have been explained for the case in which the fluid is transported through the flow passage surrounded by the casing 14 and the displacement-transmitting section 66. Besides, as shown in FIG. 46, the present invention is also applicable to the transport of the fluid in an open system.

A pump 10G according to a seventh embodiment, which is applied to an open system, will be explained below with reference to FIGS. 46 to 47D.

The pump 10G according to the seventh embodiment includes a ceramic base 184 constructed such that a second substrate 182 comprising a second spacer layer 182B and a second thin plate layer 182C is stacked on a part of a first substrate 180 comprising a first substrate layer 180A, a first spacer layer 180B, and a first thin plate layer 180C.

A first actuator section 30*a* is formed on the second substrate 182 of the ceramic base 184. A second actuator section 30*b* is formed on a portion of the first substrate 180 in the vicinity of a step section disposed between the first substrate 180 and the second substrate 182.

A displacement-transmitting section 186, which is made of, for example, resin, is formed on the surface including the first and second actuator sections 30*a,* 30*b*. The upper surface of the displacement-transmitting section 186 is a tapered surface which is inclined along the difference in height of the ceramic base 184. Further, portions of the upper surface of the displacement-transmitting section 186, which correspond to the first and second actuator section 30*a,* 30*b,* are bulged upwardly respectively to construct a first dam section 188 and a second dam section 190. The ceramic base 184 and the displacement-transmitting section 186 are fixed and supported with certain rigidity by the aid of a casing 192 which is disposed on the side surface.

As shown in FIGS. 47A to 47D, the first and second dam sections 188, 190 have their heights which are set so that the bulges appear and disappear in accordance with the displacement action in the vertical direction of the first and second actuator sections 30*a,* 30*b*.

Next, explanation will be made with reference to FIGS. 47A to 47D for exemplary use of the pump 10G according to the seventh embodiment, for example, for exemplary use in which a certain amount of sample liquid 194 is successively transported.

Figure 47A:
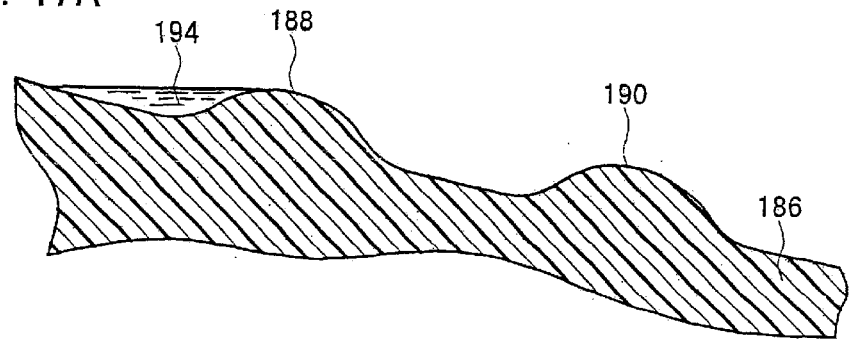
FIGS. 47A to 47D illustrate the operation of the pump according to the seventh embodiment.
Figure 47B:
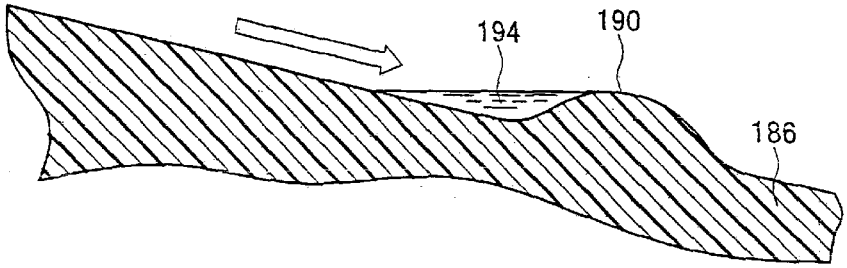

At first, as shown in FIG. 47A, the sample liquid 194 is supplied at a stage in which the first and second dam sections 188, 190 are bulged. The sample liquid 194 is dammed by the first dam section 188 to cause no downward movement. Subsequently, as shown in FIG. 47B, when the first actuator section 30*a* for the first dam section 188 is displaced downwardly to remove the bulge of the first dam section 188, the sample liquid 194, which has been dammed, moves toward the second dam section 190. The sample liquid 194 is dammed by the second dam section 190 to cause no downward movement.

Figure 47C:
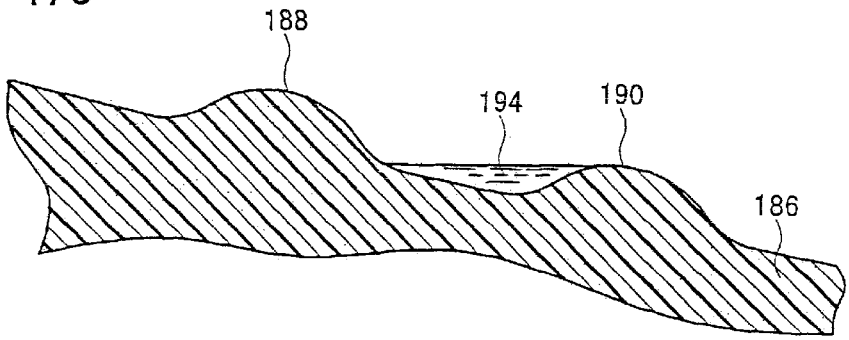

Subsequently, as shown in FIG. 47C, when the first actuator section 30*a* for the first dam section 188 is displaced upwardly again to generate the bulge of the first dam section 188, the sample liquid 194 in an amount corresponding to the volume of the portion (amount-measuring section 196) comparted by the first dam section 188 and the second dam section 190 remains in the amount-measuring section 196. The overflow sample liquid flows over the second dam section 190, and it is recovered.

Figure 47D:
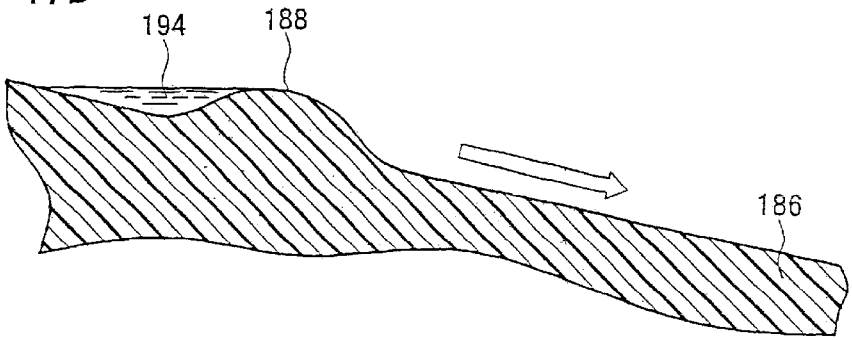

After that, as shown in FIG. 47D, when the second actuator section 30*b* for the second dam section 190 is displaced downwardly to remove the bulge of the second dam section 190, the sample liquid 194, which has been pooled in the amount-measuring section 196, moves downwardly along the tapered surface of the displacement-transmitting section 186.

As described above, when the pump 10G according to the seventh embodiment is used, for example, a constant amount of the sample liquid 194 can be successively moved. Therefore, the pump 10G can be applied, for example, to an apparatus for quickly analyzing a trace amount of protein or gene. Thus, it is possible to make contribution to the research for novel drugs and the analysis of genes.

It is a matter of course that the pump according to the present invention is not limited to the embodiments described above, which may be embodied in other various forms without deviating from the gist or essential characteristics of the present invention.

What is claimed is:

1. A pump comprising:

a casing including an input and an output, and a first surface extending from said input to said output, said input and said output comprising holes penetrating through said casing;

a main pump body including at least one pump section having an upper surface that cooperates with said first surface of said casing selectively to define a fluid passage between said pump section and said first surface without intervening elements, said fluid passage extending from said input to said output, wherein the flow of fluid from said input to said output is controlled by actuating said pump section to move said upper surface toward and away from said first surface of said casing;

wherein portions of said main pump body are rigidly supported by at least one of said casing and at least one support pillar for supporting said casing.

2. A pump comprising:

a casing including an input and an output, and a first surface extending from said input to said output, said input and said output comprising holes penetrating through said casing;

a main pump body including at least one actuator section in direct contact with a displacement-transmitting section, said main pump body also including at least one pump section having an upper surface that cooperates with said first surface of said casing selectively to define a fluid passage between said pump section and said first surface without intervening elements, said fluid passage extending from said input to said output, wherein the flow of fluid from said input to said output is controlled by actuating said pump section to move said upper surface toward and away from said first surface of said casing;

wherein portions of said main pump body are rigidly supported by at least one of said casing and an outer circumferential fixed section for supporting said casing.

* * * * *

UNITED STATES PATENT AND TRADEMARK OFFICE

CERTIFICATE OF CORRECTION

PATENT NO. : 6,666,658 B2 
DATED : December 23, 2003
INVENTOR(S) : Yukihisa Takeuchi, Tsutomu Nanataki and Iwao Ohwada It is certified that error appears in the above-identified patent and that said Letters Patent is hereby corrected as shown below:

Title page, Item [54] and Column 1, line 1,
Title, please change "MICROFLUIDIC PUMP DEVICE" to -- MICROFLUIDIC PUMP DEVICE WITH SUPPORT MEANS FOR PUMP BODY --

Title page,
Item [63], Related U.S. Application Data, after "Continuation of application No. 09/268,759, filed on Mar. 16, 1999," please add -- now U.S. patent No. 6,565,331, issued May 20, 2003 --.

Signed and Sealed this

Twenty-third Day of March, 2004

JON W. DUDAS
*Acting Director of the United States Patent and Trademark Office*